United States Patent [19]

Helle et al.

[11] Patent Number: 4,469,083

[45] Date of Patent: Sep. 4, 1984

[54] WOOD BURNING STOVE

[75] Inventors: Gordon W. Helle, Farmington; Homer C. Adams; Richard A. Kleine, both of Peoria, all of Ill.

[73] Assignee: UNR Industries, Inc., Chicago, Ill.

[21] Appl. No.: 270,835

[22] Filed: Jun. 5, 1981

[51] Int. Cl.[3] ..... F24C 1/14

[52] U.S. Cl. ..... 126/61; 126/65; 126/77; 126/83; 126/200; 126/289

[58] Field of Search ..... 126/60, 290, 61, 297, 126/62, 67, 65, 66, 77, 76, 83, 75, 193, 198, 121, 120, 200, 285, 289

[56] References Cited

U.S. PATENT DOCUMENTS

| | | | |
|---|---|---|---|
| 2,545,680 | 3/1951 | Wyatt | 126/77 |
| 4,095,581 | 6/1978 | Billmeyer et al. | 126/121 |
| 4,136,662 | 1/1979 | Willson | 126/61 |
| 4,141,336 | 2/1979 | Fitch | 126/77 |
| 4,210,119 | 7/1980 | Kincaid | 126/61 |
| 4,212,286 | 7/1980 | Shane et al. | 126/65 |
| 4,214,569 | 7/1980 | Heine | 126/67 |
| 4,329,930 | 5/1982 | Riley | 126/193 |
| 4,343,289 | 8/1982 | Zimmerman | 126/77 |
| 4,362,146 | 12/1982 | Schuller | 126/77 |

*Primary Examiner*—James C. Yeung
*Attorney, Agent, or Firm*—Clement and Ryan

[57] ABSTRACT

A stove for burning solid fuel such as firewood. a lower level air inlet opening is provided for so-called "primary air," and another air inlet opening is provided at a higher level for so-called "secondary air." The volume of air introduced into the stove from each inlet opening is separately controlled. An air metering means controls the amount of secondary air introduced into the stove through the higher level air inlet opening. The lower level air inlet opening and the air metering means both have a finite number of predetermined, fixed air transmitting conditions and no other air transmitting conditions. The lower level air inlet opening has preferably two predetermined, fixed air transmitting conditions—a maximum and a minimum. The air metering means has at least a predetermined, fixed maximum air transmitting condition and preferably also a predetermined, fixed minimum, transmitting condition. The level at which the two air inlet openings are located is specified. The cross-sectional area of the air passageway provided by the air metering means is carefully controlled in relation to the volume of the fire chamber. This is done either dimensionally or by a trial-and-error method in which the appropriate air transmitting condition for each of three defined modes of operation of the stove—rapid burning, normal burning, and banked—is determined. When a viewing box is employed with the stove, the air metering means is arranged so that its terminal aperture is a narrow, elongated slot which directs a thin, planar sheet of preheated air substantially across the width of the viewing window to prevent deposition of creosote and other undesirable solids on the window. Thermostat controlled automatic operation is provided to shift the stove from its rapid burning to its banked mode and vice versa, or from rapid burning to normal burning mode and vice versa, as circumstances require.

110 Claims, 24 Drawing Figures

Fig. 11
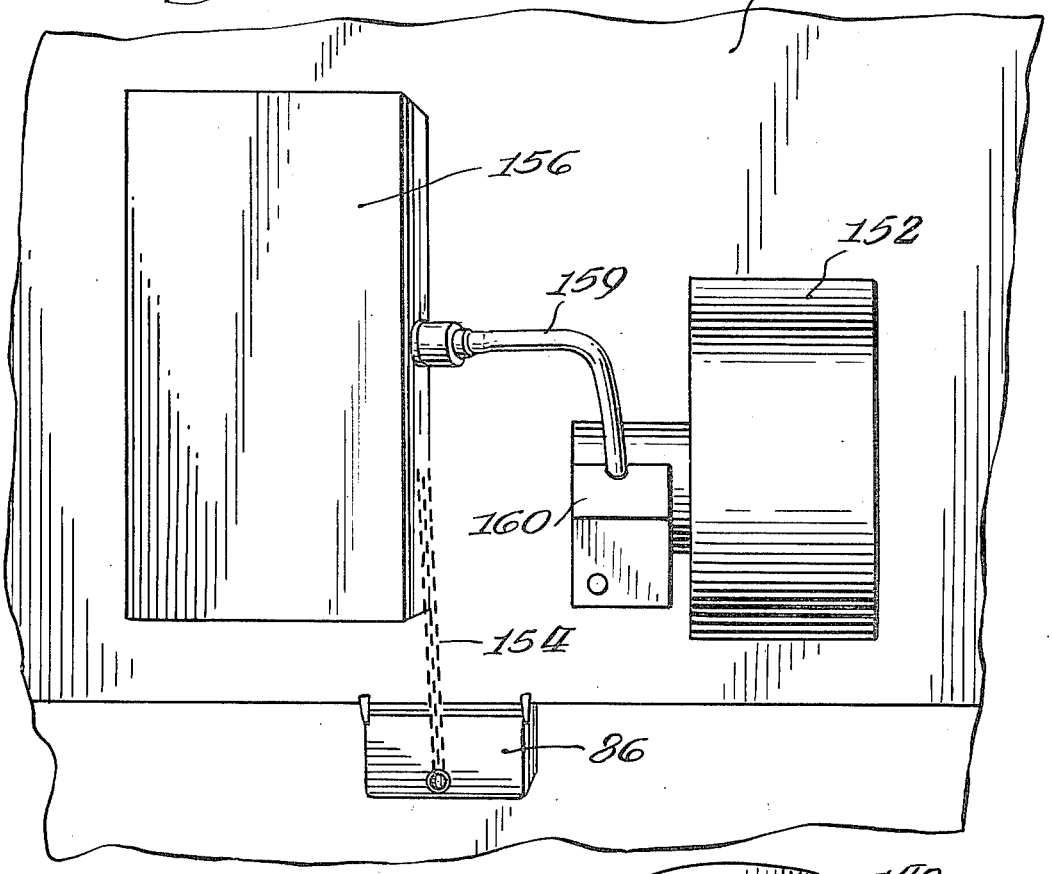
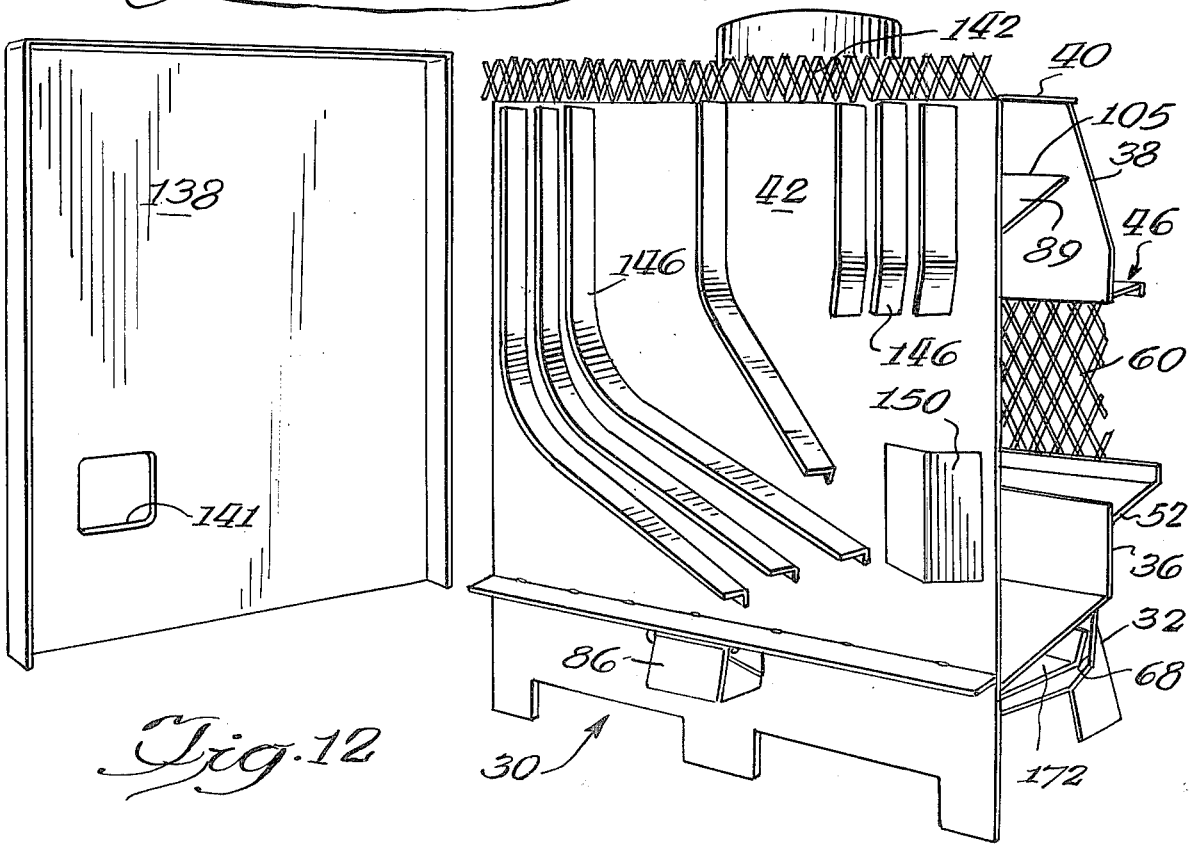
Fig. 12

WOOD BURNING STOVE

TECHNICAL FIELD

This invention relates to a stove for burning wood or any other solid fuel comprised of flammable solids that among other things produce one or more flammable gases when heated and burned, which stove is to be used as a space heater such as, for example, a radiant stove, a furnace add-on, a fireplace insert, or a heated air circulator.

BACKGROUND OF THE INVENTION

How The Combustion of Wood Proceeds

Firewood, the fuel for which the stove of this invention is primarily designed, is composed of (a) solid flammable materials, and (b) other materials that are driven off from the fuel as flammable gases when the fuel is heated and burned during combustion. The stove of this invention is designed for efficient combustion of both types of fuel—flammable solids, and flammable gases driven off from the solid fuel during heating and combustion.

Four Stages of Combustion

The constituents of wood include cellulosic materials, lignin, resin, oils, various extraneous materials such as tannin, and ash material. The process of combustion of these various constituents proceeds through four different temperature ranges, as follows:

(1) When the wood is first ignited, water is driven off as water vapor at about 200° to about 250° F.

(2) Pyrolysis of the wood—the chemical decomposition of the wood by the action of heat—proceeds in the temperature range of about 500° to about 750° F., producing charcoal, wood gas and wood oil vapors (3) The wood gas (containing carbon monoxide, methane, hydrogen, etc.) and the wood oil vapors ignite at about 1100° F. and above.

(4) Finally, at about 1200° to about 1800° F., the charcoal resulting from the pyrolysis of the wood combines with the oxygen of the air to form carbon dioxide and, if the oxidation process is not completed, carbon monoxide.

Primary and Secondary Combustion

The steps of pyrolysis of the wood and the oxidation of the resulting charcoal are commonly referred to as constituting "primary combustion," and the burning of the flammable gases resulting from the heating and combustion of the wood, including wood gas and wood oil vapors, is commonly referred to as "secondary combustion." It will be seen that in fact these two types of combustion may take place either consecutively or simultaneously, and thus may be either separate or mixed phenomena.

Primary and Secondary Air

Despite this fact, workers in this field sometimes speak as if the two phenomena are always wholly separate and distinct. The reason for this may be that air introduced for the main—though not the sole purpose—of supporting primary combustion is conveniently referred to as "primary air," while air introduced through a separate inlet for the main purpose—though sometimes not the sole purpose—of supporting secondary combustion is frequently for convenience referred to as "secondary air."

This terminology distinguishing between primary and secondary air is used (for reasons that will be apparent from the context) in certain places in this specification, although reference is sometimes made to "so-called" primary air and "so-called" secondary air in order to stress the fact that what is commonly called "primary air" practically always contributes to a limited extent to secondary combustion, and what is commonly called "secondary air" can—depending upon the level of its introduction into the fire chamber—contribute to a limited extent to primary combustion. In other contexts in this specification, the description of a particular source of air is given in terms of the level at which the air is introduced into the stove, rather than the type of combustion for which the air is primarily introduced.

Problem Of Incomplete Combustion

Indications Of Incomplete Conbustion

For two reasons, a freely burning fire in an ordinary wood burning stove or fireplace can be easily recognized as being very inefficient.

First, the visual appearance of a wood fire in the ordinary stove or fireplace shows that neither the solid, flammable constituents of the wood nor the flammable gases driven off by the heating and burning of the wood are completely oxidized. The yellowish-orange flames that are characteristic of the usual freely burning fire in a wood burning stove or fireplace show immediately that the combustion is incomplete, since the color of the flames is brought about by the heating to incandescence of tiny suspended particles of carbon that result from the partial oxidation of the carbon-containing substances in the wood or in the flammable gases driven off from the wood. In addition, whenever a wood burning stove or fireplace gives off smoke, this again shows the presence of very small, cooler particles of carbon suspended in the air rising from the fire, and provides another sign of incomplete combustion.

Second, flue gases containing unburned carbon monoxide, methane, and other flammable gases can ordinarily be detected in quite considerable amounts rising from the usual wood burning stove or fireplace. This is of course still another sign of incomplete combustion.

Prior Attempts To Solve Problem

Several different approaches to solving this problem of incomplete combustion have been attempted, but all of them present problems and none has achieved the success of the present invention. These prior attempts include the following:

(1) In order to increase the combustion of the solid constituents of the wood and of the resulting flammable gases, some stoves have merely provided a greater supply of air to the burning fire. This approach is self-defeating, since the indiscriminate introduction of a greater quantity of air simply makes the wood logs burn faster, and as a result (a) not only uses up more oxygen to produce the more rapid burning, but (b) at the same time increases the demand for still more oxygen to burn the greater volume of flammable gases produced by the higher rate at which the logs are undergoing pyrolysis.

(2) Some stoves employ downdraft tubes, or other downdraft arrangements, that provide air for primary and/or secondary combustion. Such tubes provide air by means of aspiration from the tubes, after a good draft has been established as a result of the upwardly flowing column of heated air that moves past the draft tube outlets as it rises from the burning fire. A stove of this type presents a serious problem of smoking when the fire is first started or when the fuel access door is opened, as the flue can not draw well in these situations.

In addition, it is generally difficult to start a fire with a downdraft stove because, until the stove flue is drawing well, the downdraft tubes are attempting to work against the law of nature that hot air always rises.

(3) A number of stoves provide air for secondary combustion at or somewhat below the top of the initial pile of logs on the fire grate, but either (a) provide no separate control of the amounts of so-called primary and secondary air that flow into the stove, or (b) do not sufficiently limit the amount of so-called secondary air that is introduced into the stove even when the flow of so-called primary air may be reduced or cut off altogether, and/or (c) permit too much of the secondary air to enter the fire chamber at too high a level.

In situation (a) just referred to, it is impossible to cut back the amount of primary air without cutting back the amount of secondary air, and therefore it is impossible, just as with the prior art stoves discussed in paragraph (1) above, to meet the demand for secondary air to burn the flammable gases resulting from the heating and combustion of the solid constituents of the wood logs as those solids are exposed to the flow of primary air. U.S. Pat. No. 4,015,579 and No. 4,136,662 (in the latter case, when doors 50 and 52 as shown in FIG. 4 of the drawing are closed) provide examples of this type of stove.

In situation (b), too much so-called secondary air stimulates not just secondary combustion but primary combustion as well. This heightened primary combustion again produces an increased demand—which simply cannot be met—for sufficient oxygen to make possible efficient combustion of the increased quantities of flammable gases derived from the heating and combustion of the solid constituents of the wood. U.S. Pat. No. 4,136,622 (when doors 50 and 52 shown in FIG. 4 are open, with damper blade 170 shown in the same Figure either open or partially or fully closed) provides an example of this type of stove.

In situation (c) care is not taken to direct a substantial portion of so-called secondary air coming into the stove toward the bottom portions of the fire chamber. As a result, an unacceptable fraction of the air enters the fire chamber at too high a level. U.S. Pat. No. 4,136,662 (when doors 50 and 52 as shown in FIG. 4 of the drawing are open) is an example of this type of stove.

(4) Several prior art stoves have separate inlets for so-called primary and secondary air, but introduce the secondary air well above the top of the logs initially piled up on the fire grate. This type of stove has the disadvantage that the gases driven off from the burning coals have a greater chance to cool off and thus the gases—since their ignition point is generally about 1100° F. or higher—tend to burn less efficiently, if at all, when they reach the secondary air that is introduced far above the top of the burning logs. If the gases do stay hot enough to utilize the oxygen of the secondary air in this type of stove, the resulting secondary combustion is very likely to take place in the stack, where it contributes little or nothing to the heating effect of the stove. U.S. Pat. Nos. 220,528 and 4,117,824 provide examples of this type of stove.

Prior Universal Reliance On Experimentation By User

In addition to the particular shortcomings present in the various prior art wood burning stoves discussed in paragraphs (1) through (4) above, every stove of which applicants are aware that was known prior to the present invention had a general defect that made it inherently inefficient and unreliable to use: All prior art stoves have relied on experimentation by the user to find the most effective mode of operation. Because the experience, knowledge, and judgment of all users vary within wide limits, and because the problem of selecting the best operating mode by experimentation is so complicated, reliance on experimentation by the user is a poor expedient that inevitably gives haphazard and unreliable results.

Prior to the present invention, the state of affairs just described was accepted as a necessary evil inherent in all wood burning stoves. In discussing this matter, an official government publication prepared by the U.S. Dept. of Energy for users of wood burning stoves, after pointing out that the flow of air determines whether the fire burns slowly or quickly, states as follows (U.S. Dept. of Energy Doc. DOE/CS-0158, *Heating With Wood,* May 1980):

"But the air controls not only determine the rate of burning, they also determine the efficiency of the combustion process, because they also affect the third essential for combustion—temperature.

"Turning the damper down, as is often done for long burns, results in a cool fire. Because of the low temperatures, the gases produced by pyrolysis leave the fire unburned, and a potentially valuable amount of heat is lost.

"Compare this with a fire burning with the damper wide open. The fire is hot enough to burn the gases but high temperatures create a draft so strong that heat is lost up the chimney before it can be transferred to your house. It may seem as if there is no way to win, so a compromise is necessary."

This publication of the U.S. Dept. of Energy goes on to state:

"All we can tell you is that the best position is somewhere in-between these two, and a little experimentation will help you discover where that position is for your particular stove."

In other words, this official publication is resigned to an "in-between" mode of operation that loses some of the gases produced by pyrolysis, and loses other heat because of too strong a draft. The publication seeks to encourage the user of the wood burning stove by referring to the required experimentation as being only "a little experimentation," but significantly it gives no leads as to how that experimentation should proceed, and it clearly concedes that some significant loss of the heating value of the wood will necessarily occur as a result of the compromise that the user is instructed to seek.

Other Defects In Prior Art Stoves

Still another defect in some prior art stoves is presented by the airtight construction of the fire chamber or fire box, which has been resorted to by some who have recognized the difficulties inherent in individual, experimental selection of operating conditions, and have sought to introduce a degree of certainty in the control of the fire. But closing off the fire chamber completely to circulation of air from outside the stove is actually quite dangerous. If the fire is snuffed out by closing off the introduction of all air, and there is no appreciable draft in the stove, a quantity of carbon monoxide and other flammable gases may accumulate in the stove and produce a dangerous explosion—if the interior of the stove is at the time still at or above the ignition temperature of the accumulated gases—when the fuel access door is opened and a quantity of air is admitted into the fire chamber.

In prior art stoves having viewing windows for observing the wood fire within the fire chamber, another problem that is related to incomplete combustion of the fuel has been the deposition of creosote and other solids on the interior surface of such windows. This type of deposition clouds or blackens the viewing window, and of course interferes with the viewer's observation of the fire.

Prior art stoves have attempted to meet this problem by expedients exactly opposite to the means utilized in the present invention, and with signally less success. Some prior art stoves have, for example, passed quite large quantities of cool air over the interior surface of the viewing window. (See U.S. Pat. Nos. 3,757,766, 3,986,488, 4,121,560 and 4,136,662.) By way of further example, in some prior art patents the emphasis has been on forming oppositely directed, swirling vortexes from the air introduced adjacent the viewing window or windows of the stove. (See U.S. Pat. Nos. 3,986,488 and 4,076,009.) Both these approaches are diametrically opposed to the approach utilized in the present invention.

The present invention avoids all the disadvantages of the prior art just described, by carefully controlling in a novel and wholly unexpected way the location and volume of introduction of so-called primary and secondary air so as to achieve (1) remarkably improved efficiency of combustion at various temperatures, and with various durations of burning, that are tailored to meet the typical user's needs, and (2) freedom from troublesome deposition of creosote and other solid materials on any viewing window through which the burning fire is observed.

SUMMARY OF THE INVENTION

Distinct Modes Of Operation

The novel construction of the stove of this invention makes it possible in the operation of the stove to shift the emphasis from primary combustion of the firewood to secondary combustion and back again, depending upon the type of fire that is desired. As a result, the stove has at least two, and preferaby three, distinct modes of operation—which three modes may be referred to as a "rapid burning mode," a "normal burning mode," and a "banked mode" of operation. In its preferred form, the stove shifts itself automatically back and forth between modes as needed.

The importance of providing three modes of operation in a wood burning stove is best understood by noting that the typical user of such a stove desires to use the stove in three quite different ways depending upon the occasion and the time of day:

1. The stove is sometimes used as a fireplace is used, to provide high, yellowish-orange, sometimes leaping, flames that have a soothing, almost hypnotic effect when an observer sitting in front of the fire watches the ever changing patterns of the flames.

2. When the stove is used principally for its heating effect during the day, a less vigorous and less picturesque but more economical type of fire, with the blue and yellowish-blue flames characteristic of a more efficient type of combustion, is desired.

3. When a lower level of heat for a longer duration is desired—as for example during the night—a still lower level of combustion is necessary.

The stove of this invention makes possible all three of the described modes of operation on a reliable and consistent basis. The stove in its preferred form is so constructed that after a freely burning fire has been established, with flames having the yellowish-orange color characteristic of incomplete combustion seen above at least a portion of the firewood being burned (the "rapid burning mode"), and the so-called primary air inlet is thereafter closed or otherwise reduced to its predetermined, fixed minimum air transmitting condition, the fire converts itself into a bed of glowing coals with flickering blue and yellowish-blue flames above the coals, showing a highly efficient burning of the solid constituents of the wood and also of the flammable gases driven off from the heated or pyrolyzed wood (the "normal burning mode").

The stove of this invention is preferably capable of still a third mode of operation, in which the so-called primary air inlet opening is closed or otherwise reduced to a predetermined, fixed minimum air transmitting condition and the amount of air introduced into the so-called secondary air inlet opening or openings is likewise reduced to a predetermined, fixed minimum. As a result of these settings, the combustion of a bed of glowing hot coals and grayish red coals is sustained, but no substantial quantity of flames of any kind is visible above the pile of burning coals (the "banked mode" of operation).

As will be seen, in the rapid burning mode of operation of the stove of this invention, the main—but not the sole—emphasis is on primary combustion. After the operation of the stove is shifted to the normal burning mode, the main—but not the sole—emphasis between the two modes is achieved by separate and careful control, in terms of both the amount and level of introduction of air into the fire chamber, of (1) so-called "primary air," whose main function is to bring abut the initial burning or pyrolysis of the firewood (i.e., primary combustion), and (2) so-called "secondary air," whose main function is the burning of the flammable gases that are driven off from the heated and burning wood (i.e., secondary combustion).

Finite Number Of Air Transmitting Conditions For Air Inlet Means

To avoid the uncertainties and inconsistencies in the operation of prior art stoves because of their reliance on experimentation by the user for selection of the proper mode of operation, every embodiment of the stove of the present invention operates with a degree of careful control of the combustion process that at least provides what may be characterized as a semi-automatic manner of operation. After a fire has been established in the stove of this invention by conventional start-up methods and the user has selected one of a limited number of modes of operation, the stove in its preferred embodiments can be relied on to shift itself into certain other modes in a manner that is actually fully automatic.

In all prior art stoves known to applicants the draft opening or openings—which function as an air metering means—have an infinite or unlimited number of possible air transmitting conditions. In the present invention, once the user has made a selection as to which of a limited number of levels of combustion is desired when relatively low combustion is the goal (for example, the normal burning mode of operation or the banked mode of operation referred to above), the openings through which air is admitted to the stove have only a finite or limited number of predetermined, fixed air transmitting conditions, and no other air transmitting conditions. In preferred embodiments of the stove, only two or three of such predetermined, fixed air transmitting conditions are provided for each opening through which air enters the stove.

The stove of this invention in every embodiment is so constructed that it has at least two modes of operation, the second of which provides a lower level of combustion.

First, a lower level air inlet means has a finite or limited number of predetermined, fixed air transmitting conditions. Preferaby it has two predetermined, fixed air transmitting conditions, one of which is a maximum and one a minimum condition, and no other air transmitting conditions. The maximum air transmitting condition provides air for the first of the three modes of operation described above, and the minimum condition provides air, if any, for the other two modes.

A second air inlet means—which includes one or more openings—is provided in a wall of the fire chamber at a level above the lower level air inlet means. The flow of air into the fire chamber through this second air inlet means is carefully controlled by an air metering means that has a finite or limited number—preferably no more than two or three—of predetermined, fixed air transmitting conditions, and no other air transmitting conditions, when the user of the stove places a preselector means in one of a limited number of predetermined positions. The air metering means provides air for the various modes of operation described above, depending upon the amount of air transmitted in the respective air transmitting conditions.

The path by which air flows from outside the stove through the second opening into the fire chamber is entirely separate from the path by which air flows from outside the stove through the lower level air inlet opening into the fire chamber.

Rapid Burning Mode

During the rapid burning mode of operation described bove, sufficient air is introduced into thestove both at a lower level and at a higher level to sustain a freely burning fire with yellowish-orange flames, but not to heat the top or front of the stove cabinet above an acceptable temperature. What is an "acceptable temperature" for the front or top of the stove cabinet depends upon the type of space heater involved—a radiant stove, a furnace add-on, a fireplace insert, or a heated air circulator for use in a residential area of a house, etc.—and the particular environment in which the stove is to be used. For a heated air circulator used in the living area of a home, for example, an acceptable temperature will typically be no more than about 750° F., and preferably no more than about 600° F.

With a freely burning fire such as in the rapid burning mode of the present stove, secondary air is introduced into the stove in an amount sufficient to burn only some portion of the flammable gases driven off from the burning wood. In other words, in this mode of operation, the main emphasis is on primary combustion.

(As used in this specification and the appended claims, the term "middle level," when used to describe the location of an air inlet opening or aperture in a wall of the stove cabinet or of the fire chamber, refers to any such opening or aperture whose bottom edge is located at a level above the fire grate from about 1/10 to about ⅓ of the predetermined average height of the fire chamber of the stove, and whose top edge is located at a level above the fire grate between about ½ and about 4/5 of the fire chamber average height. Reference in this specification and claims to the "average height" of the fire chamber of a stove is to the average height measured (in a manner explained in more detail below) from the fire grate at the bottom of the chamber to the upper wall at the top of the chamber. The term "lower level" when used to describe the location of an air inlet opening in a wall of the stove cabinet or of the fire chamber refers to any such opening at a level either entirely below, or in the general vicinity of, the fire grate at the bottom of the fire chamber, or in other words at a level adjacent the fire grate.)

Normal Burning Mode

During the normal burning mode of operation of the stove of the present invention, so-called secondary air is introduced into the fire chamber at a middle level—with little or no air introduced into the stove at a lower level—in an amount such that the total amount of air introduced is sufficient to keep the glowing hot coals burning with blue and yellowish-blue flames above the coals, and (after approximately 15 minutes) to burn the majority of the flammable gases driven off from the heated and burning wood, but not sufficient to maintain a freely burning fire. In this mode of operation, the main emphasis is on secondary combustion.

Banked Mode

Finally, during the banked mode of operation, the rate at which both primary and secondary combustion proceed is markedly reduced. This is accomplished by introducing so-called secondary air into the fire chamber at a middle level (preferably, with no air introduced at a lower level) in an amount such that the total amount of air introduced is sufficient to sustain the combustion of a bed of glowing hot coals and grayish-red coals on the fire grate, but (after approximately 15 minutes of such combustion) not sufficient to produce any substantial quantity of visible flames above the pile of coals.

The stove of this invention is provided in some embodiments with a fire grate for the burning of a predetermind weight of firewood or other solid fuel, piled to a predetermined height above the fire grate. The description of the types of combustion that define the characterisitc modes of operation of the stove of this invention is given for a fire that is observed when no more than this predetermined weight of standard test wood (as defined below in this specification) is positioned on the fire grate in a pile that rises to a height no greater than the predetermined maximum height, and a barometric damper is employed providing a controlled draft of about 0.05 inch of water column. In each case the fire should have burned for at least about 30 minutes after ignition, but not so long that the fuel has been substantially transformed into charcoal.

The described control of the amount and level of introduction of air into the fire chamber of a wood burning stove to produce the defined modes of burning has, so far as the prior art shows, never been attempted before. Applicants have not only shown that this type of stove is possible, but that it produces surprisingly high levels of efficiency in the operation of the stove in both the normal mode of operation and in the banked mode of operation.

Air Inlet Means For Primary And Secondary Air

The air inlet means that provides most, if not all, the air for primary combustion during the rapid burning mode of operation of the stove of this invention is the lower level air inlet mens that communicates with the fire chamber at the bottom of the chamber—and preferably from entirely below the fire grate. As pointed out above, this lower level air inlet means has a predetermined, fixed maximum air transmitting condition and a predetermined, fixed minimum air transmitting condition, which latter condition is preferably completely closed. If desired, the lower level air inlet means may include more than one air inlet opening.

In addition to the lower level air inlet means, the stove has an air inlet means that communicates with the fire chamber of the stove at a higher level, preferably at a middle level as defined above—i.e., with its bottom edge at a level above the fire grate that is about 1/10 to about $\frac{1}{3}$ of the predetermined average height of the fire chamber and its top edge at a level above the fire grate that is between about $\frac{1}{2}$ and about 4/5 of the average height of the fire chamber. If desired, this air inlet means may also include more than one air inlet opening.

Improved results are obtained if the bottom edge of the middle level air inlet means is located at a level above the fire grate between about $\frac{1}{8}$ and $\frac{1}{4}$ of the fire chamber average height, and its top edge is at a level between about 3/5 and about $\frac{3}{4}$ of the fire chamber average height, above the grate. The preferred levels for the bottom and top edges of the middle level air inlet means are approximately 1/6 of the fire chamber average height above the grate, and approximately $\frac{2}{3}$ of the fire chamber average height above the grate, respectively.

Since the top of a pile of burning logs or other pieces of firewood is highest when the fire is first lit, the fraction of the height of such a pile at which the so-called secondary air is introduced into the fire chamber will of course change when the size of the pile diminishes as the fire proceeds to burn down. Once a person skilled in the design of wood burning stoves has selected the volume and average height of the fire chamber that is desired for a particular model stove, the approximate height to which firewood is likely to be piled upon the fire grate by one using the stove is immediately apparent. Thus, with each stove there will be a physical limit on the maximum height to which the wood can be piled. At the other extreme, if the stove is to be used for anything more than a very short time, which will ordinarily be the case, the user can be expected not to introduce a very small charge of firewood into the stove when the fire is first lit.

Given the probable height to which a user will pile firewood in any wood burning stove of a given fire chamber volume and height, the approximate level of introduction of secondary air in relation to the height of that pile can be estimated for the initial period of burning of the fire. Later, of course, if the fuel is burned up without adding more firewood, the top of the pile of logs or glowing coals gradually moves downward as the wood is consumed by the fire. When a given charge of firewood placed on the grate burns down to mere ashes (which drop down through the fire grate into the ash collecting space below the fire chamber), the fraction of the height of the pile of burning fuel that represents the fixed level at which secondary air is introduced into the fire chamber becomes larger and larger as the pile of fuel diminishes in size.

Nevertheless, it has been found, quite unexpectedly, that when the stove of this invention is operated in its normal burning mode from and after the time at which a freely burning fire is first established until the firewood has been entirely consumed, the introduction of so-called secondary air into the fire chamber in a zone that extends from between about 1/10 and about $\frac{1}{3}$ of the average height of the fire chamber above the fire grate at the bottom to between about $\frac{1}{2}$ and about 4/5 of that average height above the grate at the top turns out to be the most effective level that is possible for a fixed location. The bottom of this zone is well below the top of the usual pile of logs on the fire grate in the beginning of the fire, is somewhere near the middle of the pile after the fire has continued for a time, and is somewhat above the diminishing pile of coals at the end of the fire.

The defined level of introduction of so-called secondary air in relation to the height of the fire chamber produces very efficient combustion, on the average, throughout the entire life of the fire. In other words, the prescribed level of introduction of so-called secondary air into te fire chamber is neither too far below the probable top of the original pile of firewood at the beginning of the fire, nor too far above the top of the burning fuel at the end.

Air Metering Means For Secondary Air

Another important feature of th stove of this invention mentioned briefly above is the inclusion of air metering means, which has at least a maximum predetermind, fixed air transmitting condition and (after a preselector means is moved into one of a limited number of predetermined positions to select a desired mode of combustion) may have one or more other predetermined, fixed air transmitting conditions, finite in number, to provide communication between the air surrounding the stove and the middle level air inlet opening or openings into the fire chamber. Good results are achieved when this metering means in its predetermined, fixed maximum air transmitting condition provides a passage for air flow that has a cross sectional area between about 0.6 sq. in. and about 1.2 sq. in. for every cubic foot of volume of the fire chamber. Improved results are obtained if the figure in question is between about 0.7 sq. in. and about 1.1. sq. in. for every cubic foot of the indicated volume, and still further improvement is obtained if the figure is between about 0.8 and about 1. The preferred figure is about 0.9 sq. in. for every cubic foot of volume of the fire chamber.

Another feature of the stove of the present invention is the further limitation of the air metering means, when desired, to a predetermined, fixed minimum air transmitting condition in which it provides a passage for air flow having a cross sectional area between about 0.09 sq. in. and about 0.55 sq. in. per cubic foot of volume of the fire chamber, which gives satisfactory results during the banked mode of operation of the stove. Improved results are produced when this figure is between about 0.13 sq. in. and about 0.45 sq. in., and still further improvement when it is between about 0.17 and 0.3 sq. in., per cubic foot of the indicated volume. Optimum results are obtained if the figure is about 0.2 sq. in. per cubic foot of the indicated volume. This selective limitation of the amount of so-called secondary air introduced into the fire chamber through the middle level air inlet opening is effective, as stated, to produce the banked mode of operation of the stove that is described above.

Reliability, Consistency And Automatic Capability

The principal advantages of having a finite number of mined, fixed values and no other values-for various air transmitting conditions of the air inlet openings in the stove of this invention are threefold—(1)reliability of results, (2) consistency of results, and (3) adaptability to semi-automatic or fully automatic operation.

In the usual wood burning stove of the prior art that has only a single air inlet opening for admitting both primary and secondary air, the size of the opening is varied by manual movement of an adjustable draft. If the prior art stove has two separate inlets for so-called primary and so-called secondary air, they are frequently both manually adjustable by the user.

Since in either case the manual adjustment can give the opening any size gradually varying between fully open and fully closed dependent upon the selection made by the user, the opening presents an infinite number of possible sizes. The results achieved by a prior art stove having inlet openings as just described thus depend finally upon the user's experience with wood burning stoves in general, and the individual stove being used in particular, and his judgment in applying all that experience.

With the stove of the present invention, the user merely needs to decide which mode of operation he wishes to use, and the stove does the rest. Moreover, if the stove is adapted for automatic, thermosstat-controlled operation, the user merely needs to set the thermostat or thermostats at the desired levels and the stove will even shift from its usual rapid burning mode to its normal burning mode, and back, as circumstances require. In a preferred embodiment the stove can shift itself from banked mode to a second rapid burning mode (with a smaller amount of secondary air), and back, as circumstances require.

The heating action of this stove is thus both reliable and consistent, is not left to experimentation by the user of the stove, and in preferred embodiments can be semi-automatic or fully automatic in operation. None of these advantages are available with prior art stoves.

Other Features

The shape of the terminal aperture of the air meeting means of the stove of this invention is also of importance. Best results are obtained if this aperture has the shape of an elongated slot, with a satisfactory ratio of the length of the slot to its width being about 75:1. Improved results are obtained with a ratio of about 150:1 or greater.

It is preferred, when the fire chamber is longer than it is wide, that the elongated slot extend at least along one of the long sides of the chamber. Whatever the shape of the fire chamber, combustion is improved if the terminal aperture extends substantially from one vertical wall of the fire chamber to the opposite vertical wall of the chamber.

The path followed by the incoming air after it exits from the air metering means is an important part of this invention. The air metering means and its terminal aperture, together with all the structural members of the stove cabinet and any fire viewing box adjoining the fire chamber, must be disposed and arranged to guide a part of the air admitted through the air metering means, when the stove is in its normal burning mode of operation, along paths that enter the fire chamber through the lower portions of the middle level air inlet opening.

This structural limitation helps to assure that so-called secondary air entering the fire chamber will flow through the middle level air inlet opening or openings well distributed vertically throughout that opening or openings. This is important because the more widely diffused the pattern of distribution is with which the air enters the fire chamber, the more effectively will the oxygen of the air be made available for the combustion of the burning wood piled up across the length and breadth of the fire grate.

Still another feature of preferred embodiments of the stove of this invention is the control of the ratio of the amount of so-called secondary air admitted to the fire chamber through a middle level air inlet opening, with its associated air metering means in its maximum predetermined, fixed air transmitting condition, to the amount of so-called primary air admitted to the fire chamber through the lower level air inlet opening when the latter opening is also in its predetermined maximum air transmitting condition. Satisfactory results are obtained with the stove of this invention in which this ratio is between about 1:1 and about 5:3. The preferred ratio is about 6:5.

Stoves made in accordance with this invention may include a shallow air transmitting channel adjacent the fire chamber for preheating air that comes into contact with the exterior wall of the fire chamber before it is introduced into the stove. This helps avoid any chilling effect that the newly introduced air may have on the flammable gases driven off from the wood being pyrolyzed or burned.

Fire Viewing Box

If such a stove includes a fire viewing box extending forward from the stove cabinet, with air metering means for so-called secondary air located at the front portion of the viewing box, the preheated air provided as just discussed may among other things assist in keeping the interior surface of the fire viewing window clean and free from deposit of solid particles such as creosote. The air from the shallow air transmitting channel is discharged as a thin, planar sheet of preheated air a first part of which moves across substantially the width of the viewing window. This first part of the sheet of air is then guided (by the top wall of the viewing box and any downwardly extendng wall at the upper rear portion of the viewing box, when the air metering means is located in the bottom wall of the viewing box) through the fire viewing chamber toward the middle level air inlet opening into the fire chamber.

Having completed its function of assisting in keeping the viewing window clean and having then been guided into the fire chamber, the preheated air mixes with and moves upward with the column of hotter gases rising through the fire chamber from the burning fuel on the fire grate. At the same time, it is believed that some part of the thin sheet of air introduced from the shallow air transmitting channel into the fire viewing chamber flows substantially directly across the viewing chamber to the fire chamber since the fire chamber and fire viewing chamber are substantially free of any structure to prevent such flow at approximately the level of the lower portion of the middle level air inlet opening through which the fire viewing chamber communicates with the fire chamber.

Heated Air Passageways

In one embodiment of the stove of this invention, means are provided defining at least one air heating passageway adjacent the fire chamber, but having no fluid communication with the chamber. Air from the space to be heated is admitted into one end of this passageway, absorbs heat from the walls defining the fire chamber, and is discharged in its resulting heated condition from the passageway at the other end. Heat conductive elements may be mounted on the exterior walls defining the fire chamber, to extend into the air passageways and increase the heat exchange between the fire chamber walls and the air passing through the passageway.

A more detailed explanation of the invention is provided in the following description and appended claims taken in conjunction with the accompanying drawings.

BRIEF DESCRIPTION OF THE DRAWNGS

In the drawings:

FIG. 11 is a fragmentary rear perspective view of the wood burning stove of FIGS. 1–7, showing the control means for adjusting the temperature of the stove and the rate of circulation of heated air from the stove;

FIG. 12 is an exploded view of the rear of the stove of FIGS. 1–7, showing part of the means for circulating heated air from the stove, the right-hand portion of the stove being shown in section;

Figure 5:
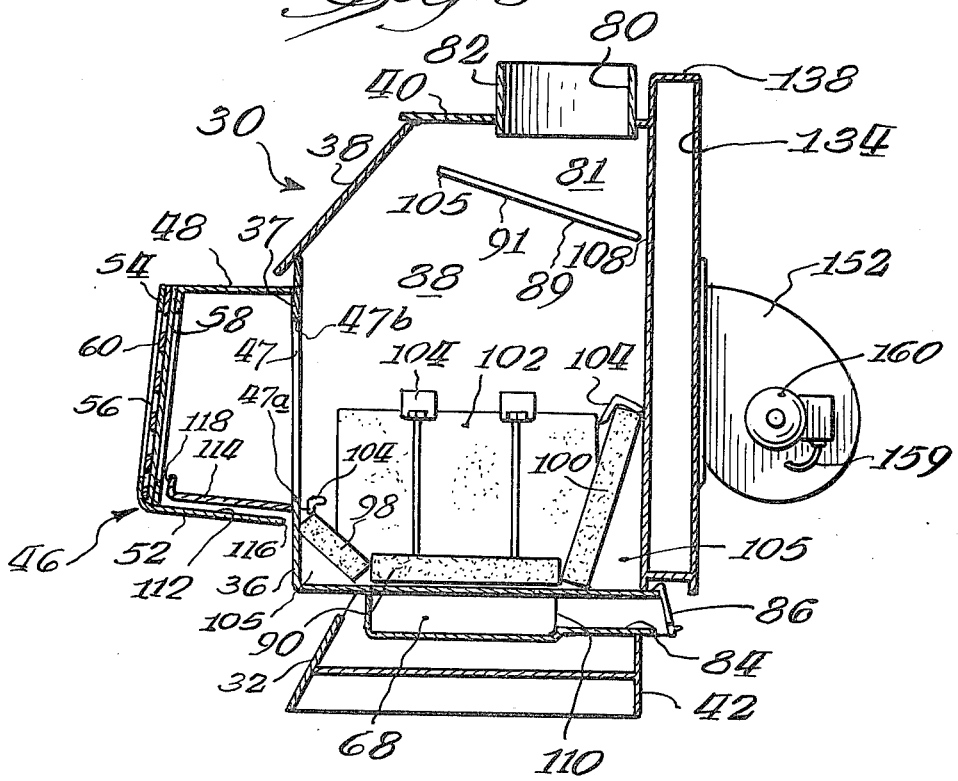
FIG. 5 is a cross sectional view of the wood burning stove of FIG. 1, taken along line 5—5 of FIG. 2, with the air deflecting fins at the rear of the stove omitted for clarity.
Figure 18:
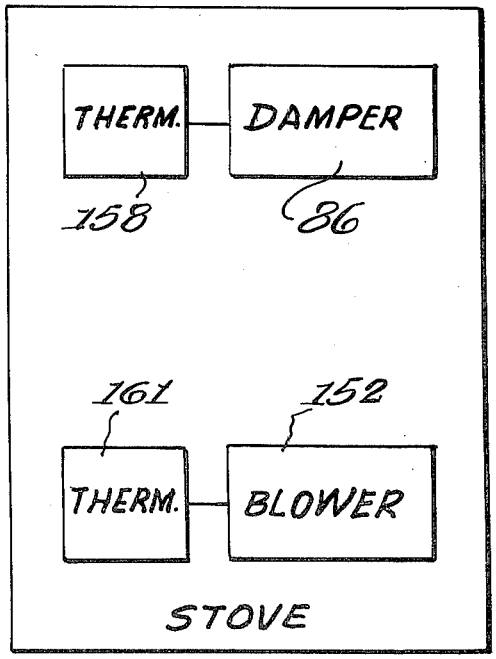
Figure 19:
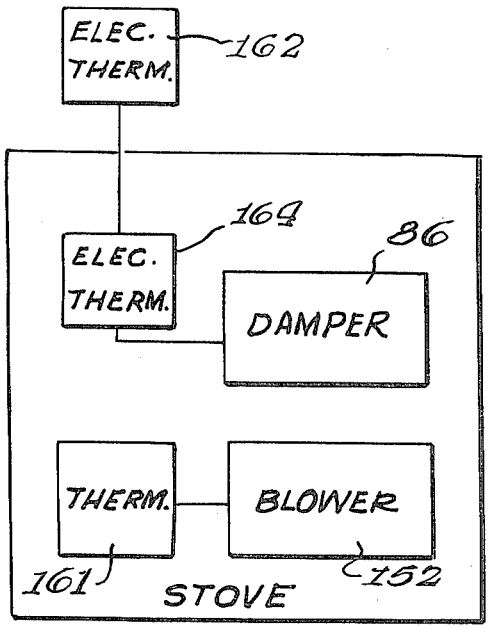
Figure 20:
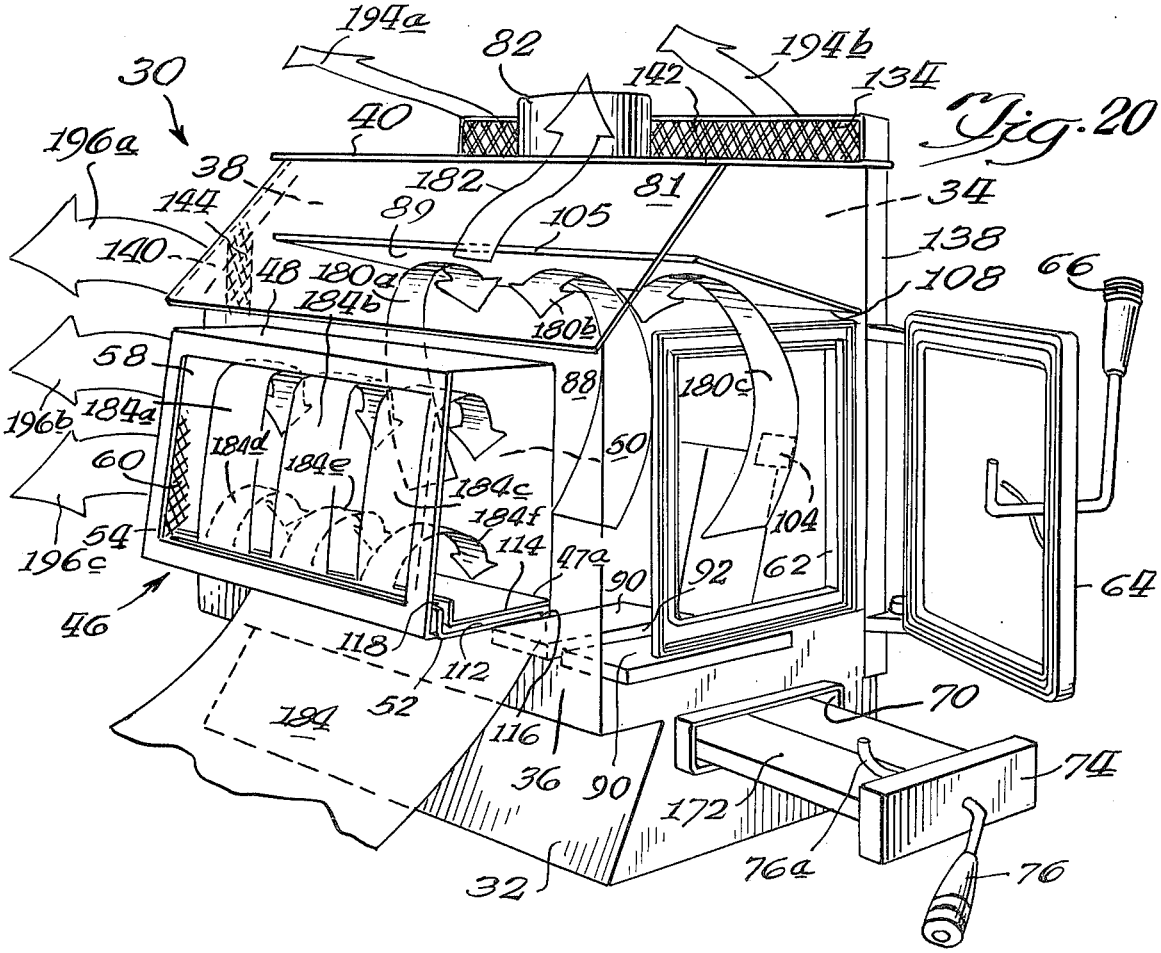
Figure 21:
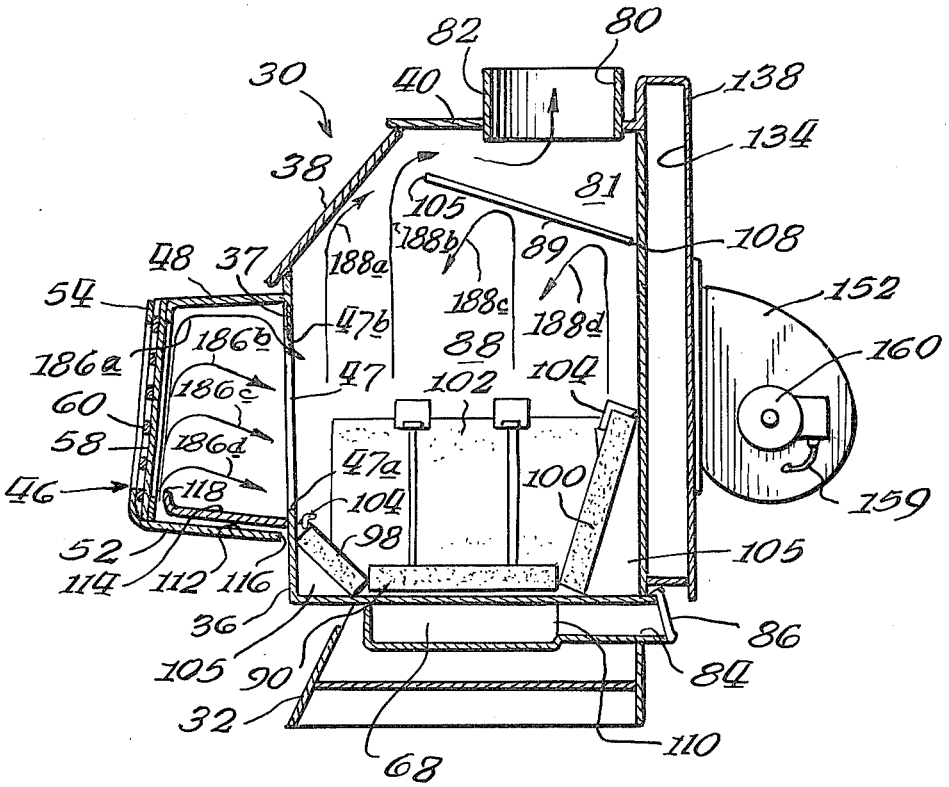
Figure 22:
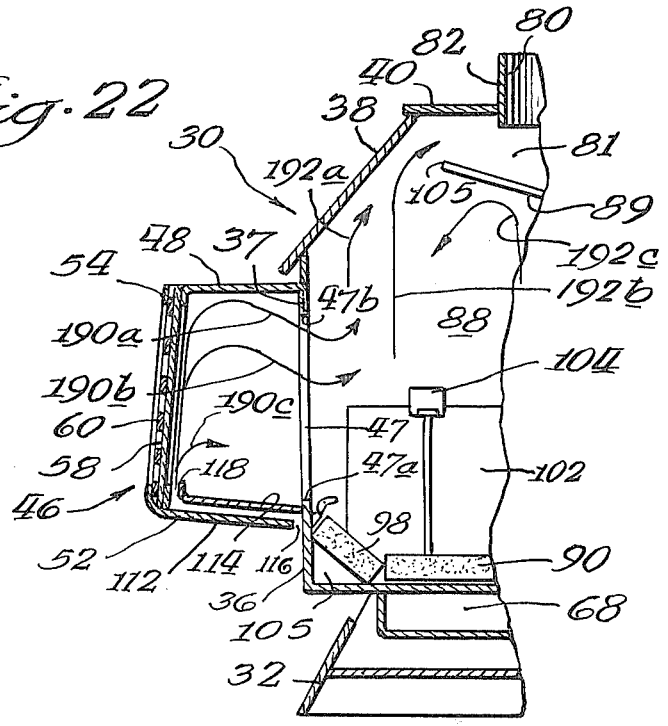
Figure 23:
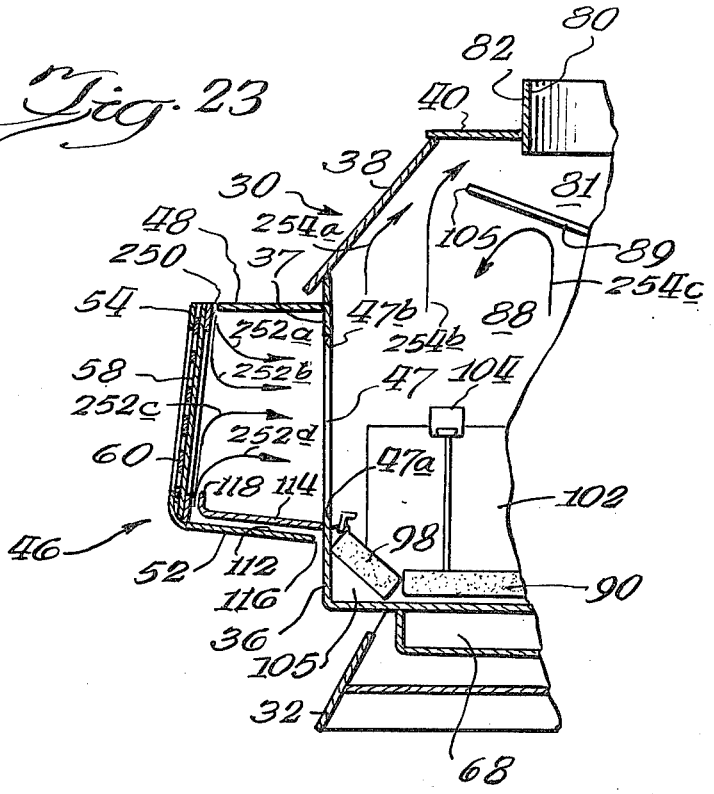
Figure 24:
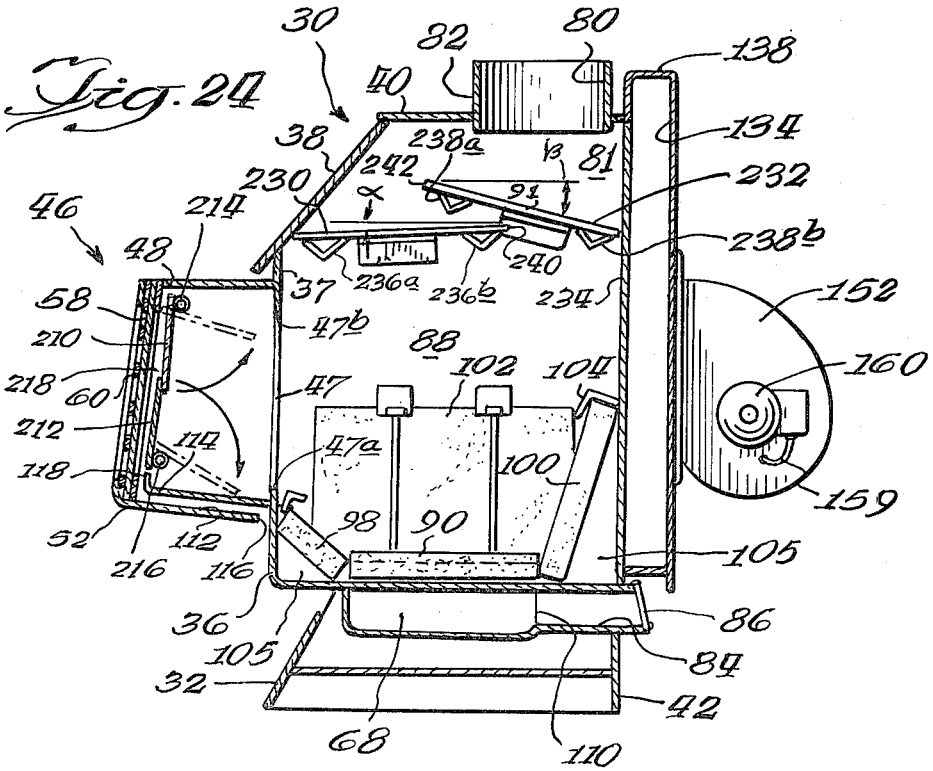

FIG. 18 (on the same sheet with FIGS. 13–15) is a diagrammatic showing of means for controlling the temperature of, and rate of air circulation from, a wood burning stove according to this invention;

FIG. 19 is a diagrammatic showing of another means for controlling the temperature of, as well as the rate of circulation of heated air from, a wood burning stove according to this invention;

FIG. 20 is an idealized perspective showing of the circulation of air into, through and out of the wood burning stove of FIGS. 1–7 when the stove is operated in its normal burning mode, with a number of parts of the stove shown in transparent form for clarity;

FIG. 21 is an idealized illustration, in section, of the general paths followed by streams of air in the stove of FIGS. 1–7 when the stove is operated in its normal burning mode;

FIG. 22 is a similar illustration of the general paths followed by streams of air in the stove of FIGS. 1–7 when the stove is operated in its rapid burning mode;

FIG. 23 is a similar illustration of the general paths followed by streams of air in another embodiment of the stove of this invention when the stove is operated in its normal burning mode; and FIG. 24 is a cross sectional view similar to FIG. 5 of a stove of this invention including a preferred form of baffle plate arrangement at the top of the fire chamber of the stove, as well as a set of doors adapted to protect the viewing window of the stove from deposit of creosote and other solids during operation of the stove in its banked mode.

DETAILED DESCRIPTION OF SEVERAL EMBODIMENTS

Figure 16:
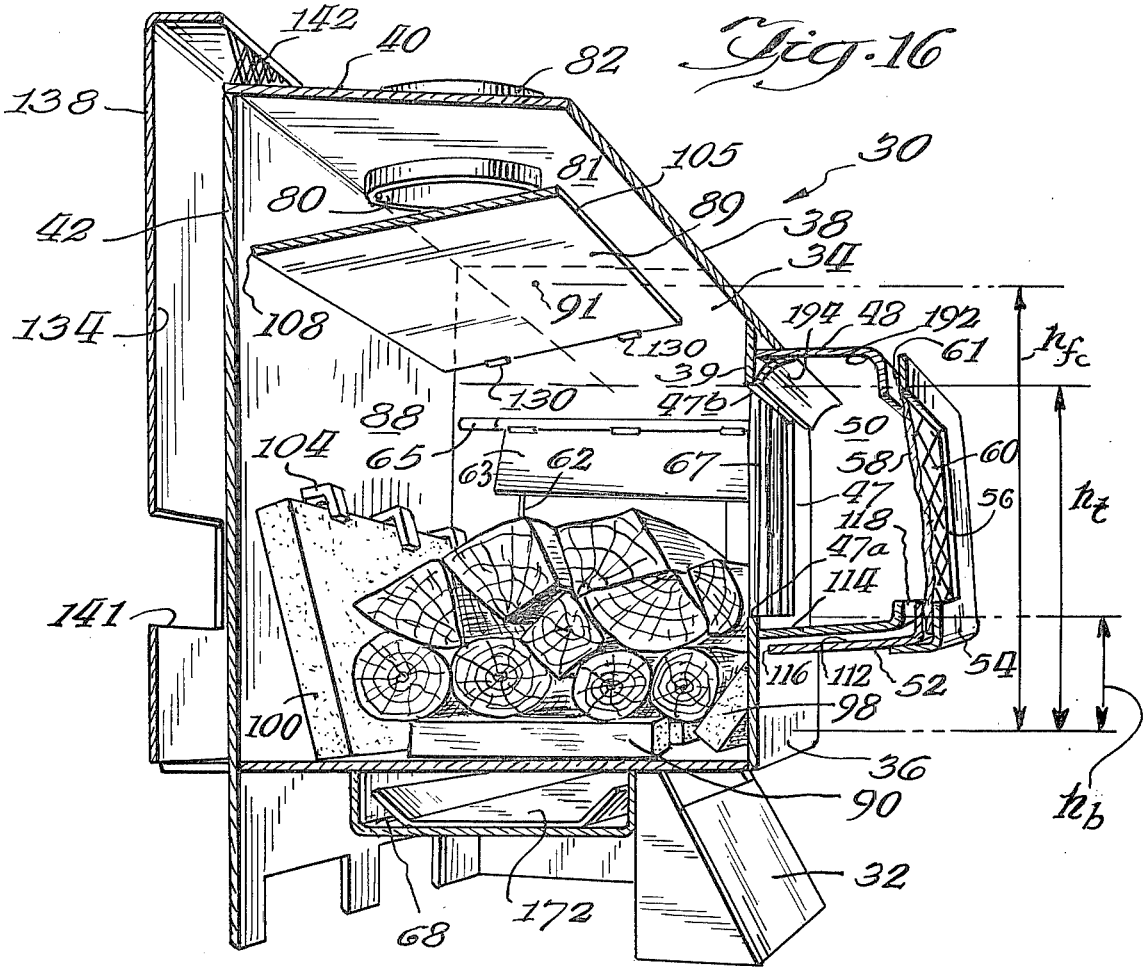
FIG. 16 is a perspective view of a wood burning stove similar to the embodiment of FIGS. 1–7, with an alternative position for the middle level air inlet opening, showing a sectional view on a plane perpendicular to the long axis of the stove, and with the blower fan omitted for clarity.
Figure 17:
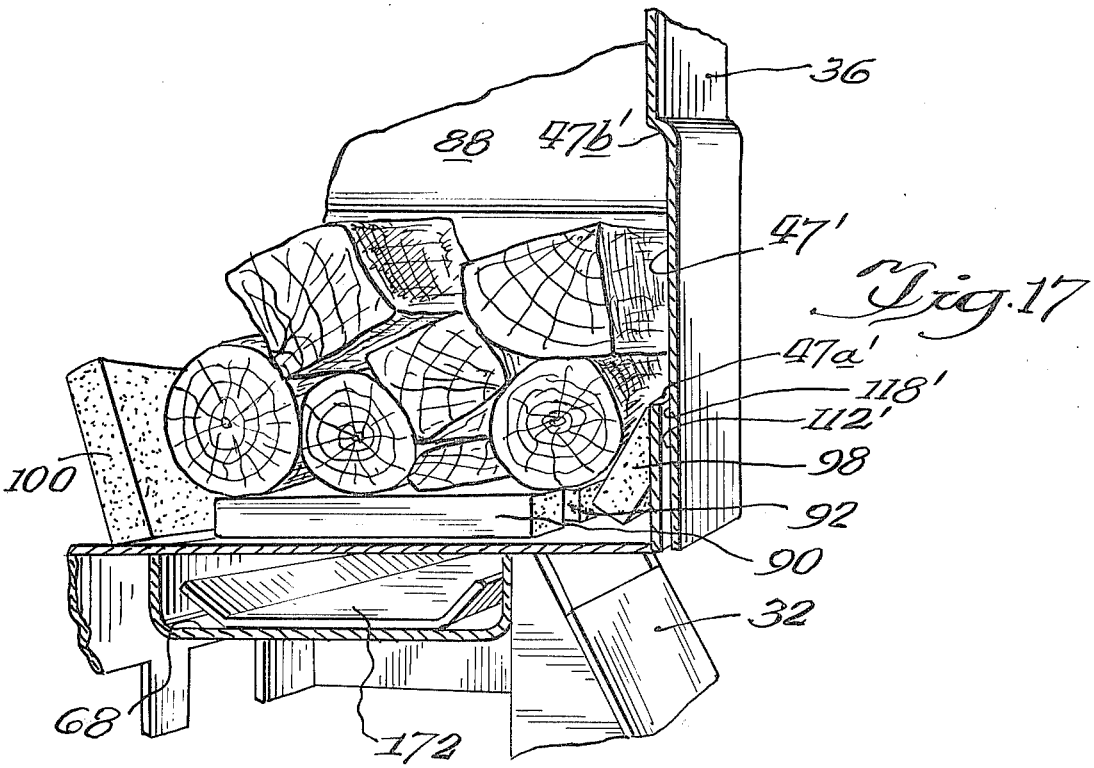
FIG. 17 is a fragmentary perspective view, similar to a portion of FIG. 16, showing another modification of the position and type of the middle level air inlet opening.

One embodiment of the stove of this invention is shown in FIGS. 1–7, 11–13, 15, 18 and 20–22. FIGS. 8–10 and 14 show modifications of a fire viewing box that can be employed with this stove. FIGS. 16 and 17 show modifications of the position and type of middle level air inlet opening. FIG. 19 shows a modification of the control system for the temperature and air circulation rate for a stove according to this invention. FIGS. 23 and 24 show other embodiments of the stove of this invention.

The Stove Cabinet

Figure 1:
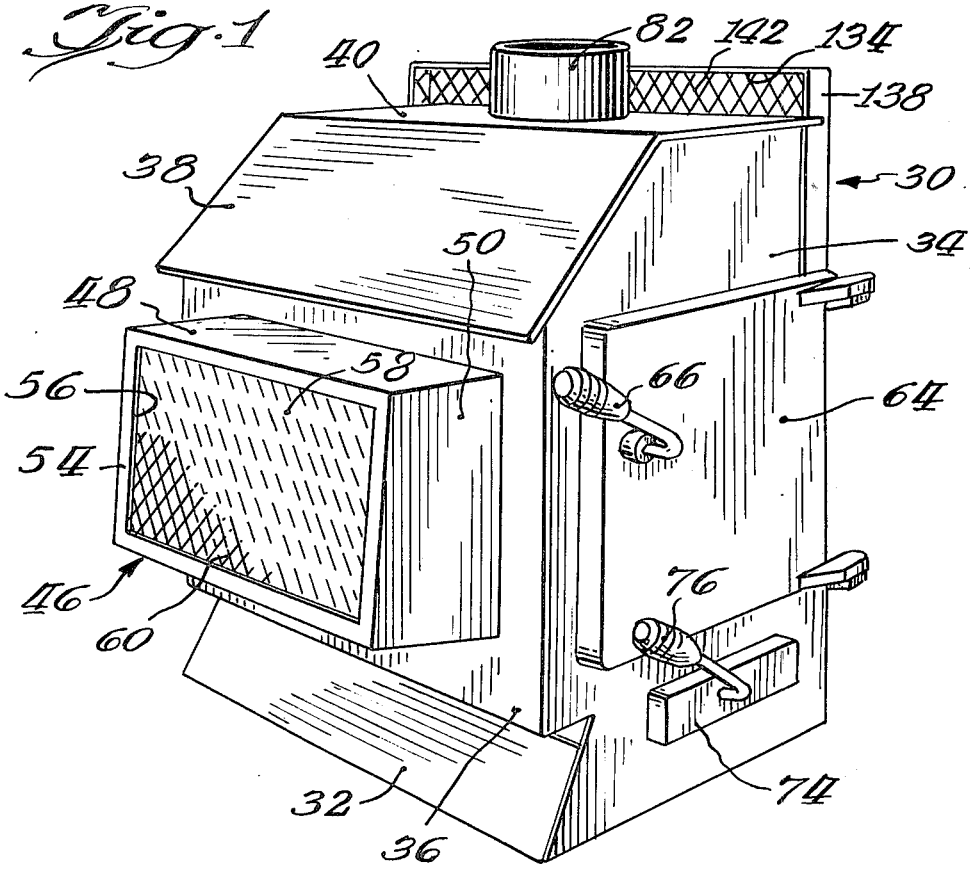
FIG. 1 is a perspective drawing of one embodiment of the wood burning stove of this invention, including the stove cabinet and a fire viewing box extending forward therefrom.
Figure 3:
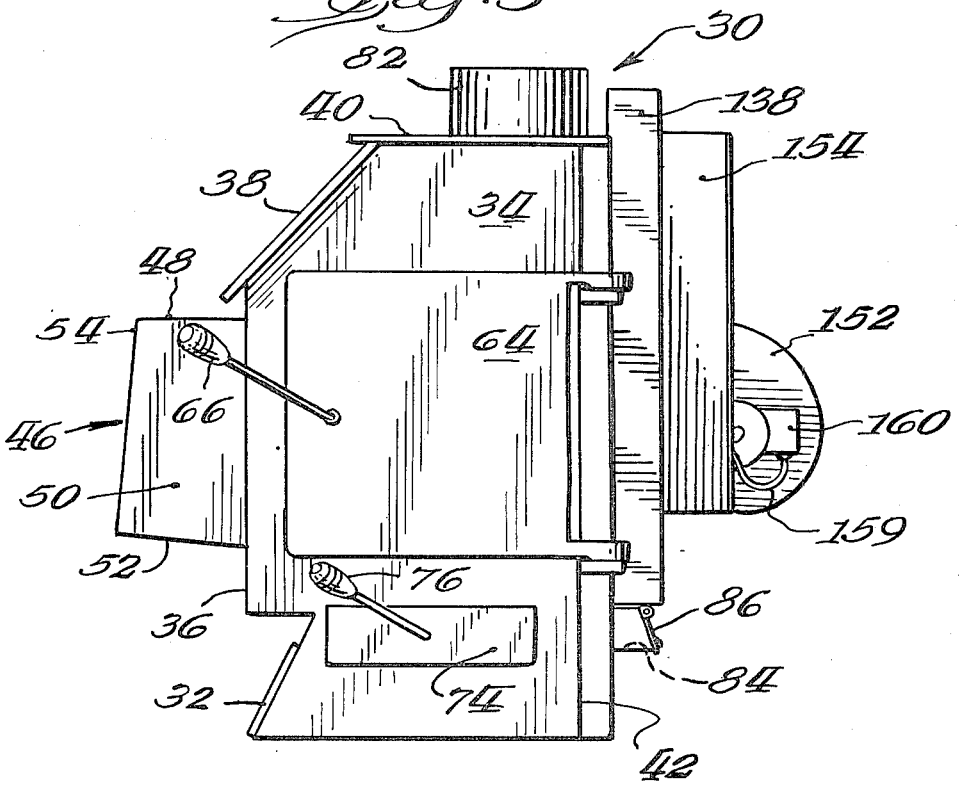
FIG. 3 is an end elevation of the same stove.
Figure 4:
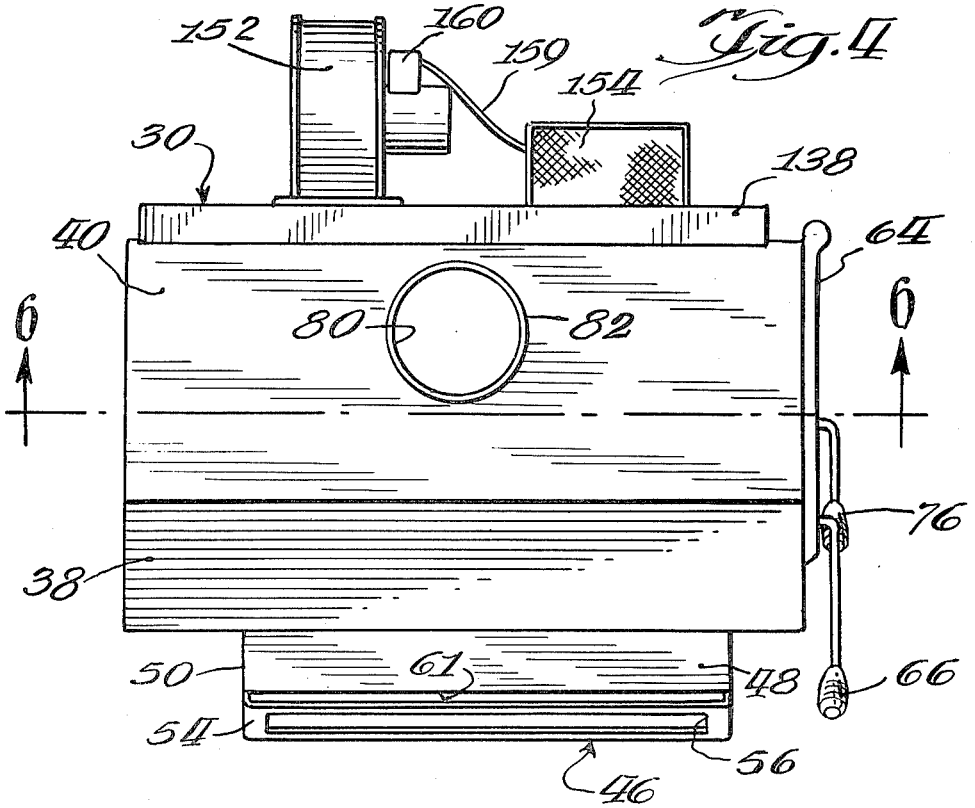
FIG. 4 is a top plan view of the same stove.

FIG. 1 gives a perspective view of a wood burning stove constructed according to the principles of this invention. The stove includes cabinet 30 in which a fire grate, fire chamber, and ash pan (all to be described in more detail below) are located. Cabinet 30 includes base 32, a pair of end walls 34, front wall 36, sloping top wall 38, top wall 40, and rear wall 42 (FIGS. 3,5 and 12).

In the embodiment shown, fire viewing box or chamber 46 extends forward from front wall 36 of cabinet 30 to provide a convenient way for the user of the stove to observe the wood fire burning in the fire chamber. As will be explained below, fire viewing box 46 communicates with the interior of the fire chamber through a large aperture or window 47 referred to hereinafter as the middle level air inlet opening—in front wall 36 of the cabinet (FIG. 5).

Figure 8:
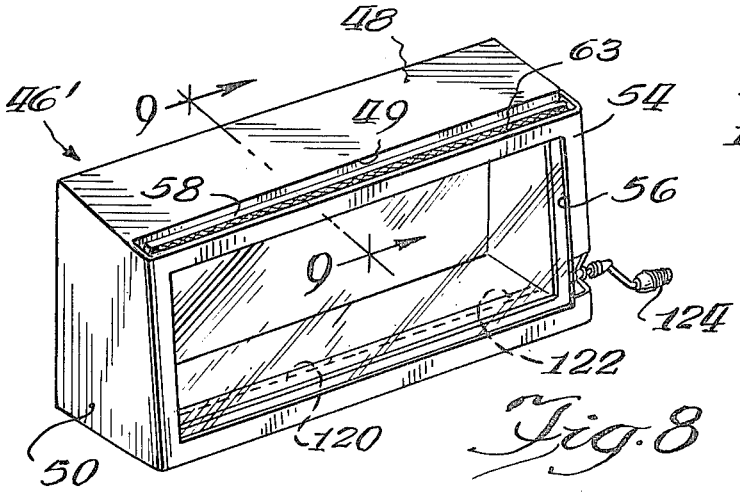
FIG. 8 is an isometric view of another embodiment of a fire viewing box that can be used in place of the embodiment shown in FIGS. 1–7, with a portion of the front wall of the box broken away to show a detail of construction and the protective grating for the fire viewing window omitted for clarity.

The viewing box includes top wall 48, end walls 50, bottom wall 52, and front wall 54. Opening 56 in front wall 54 accommodates planar, transparent viewing window 58, which in the embodiment shown in FIG. 1 has protective grill 60 positioned in front of it in the opening. Since the coefficients of heat expansion of the materials of which top wall 48 and window 58 are formed are different, the width of aperture 61 in which the window is received (FIGS. 4, 10, 14 and 16) is slightly greater than the thickness of the window. To keep this part of fire viewing chamber 46 substantially airtight, the resulting narrow gap between top wall 48 and window 58 is filled with packing 63 formed of a resilient, nonflammable material such as ceramic rope (FIG. 8).

Figure 6:
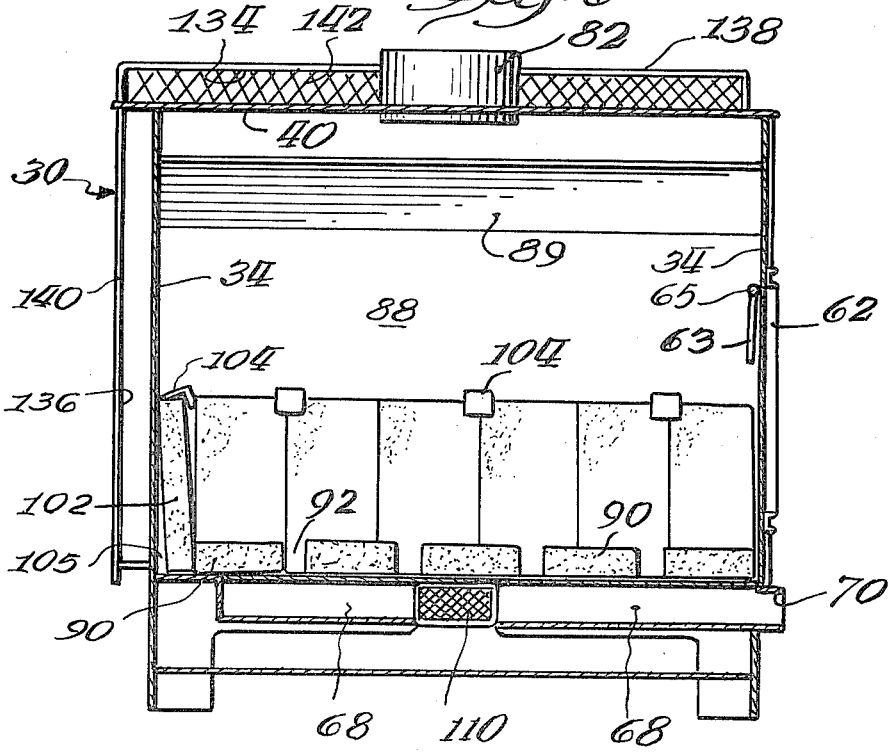
FIG. 6 is a cross sectional view of the same stove, taken along line 6—6 of FIG. 4, with the air deflecting fins at the left end of the stove, as well as the covers for the fuel access opening and the ash removal opening, omitted for clarity.

As best seen in FIGS. 6 and 20, fuel access opening 62 for depositing pieces of solid fuel upon the interior fire grate is provided in the right-hand end of the stove shown in FIG. 1. This opening is closed during operation of the stove by hinged door 64, to produce a substantially airtight cover for the opening. Door 64 can be opened or closed by means of handle 66.

Although this stove is intended primarily for use with logs or other pieces of wood as the fuel, it may if desired be used with other solid fuels, such as coal, that are comprised of flammable solids that among other things produce flammable gases when heated and burned.

Figure 14:
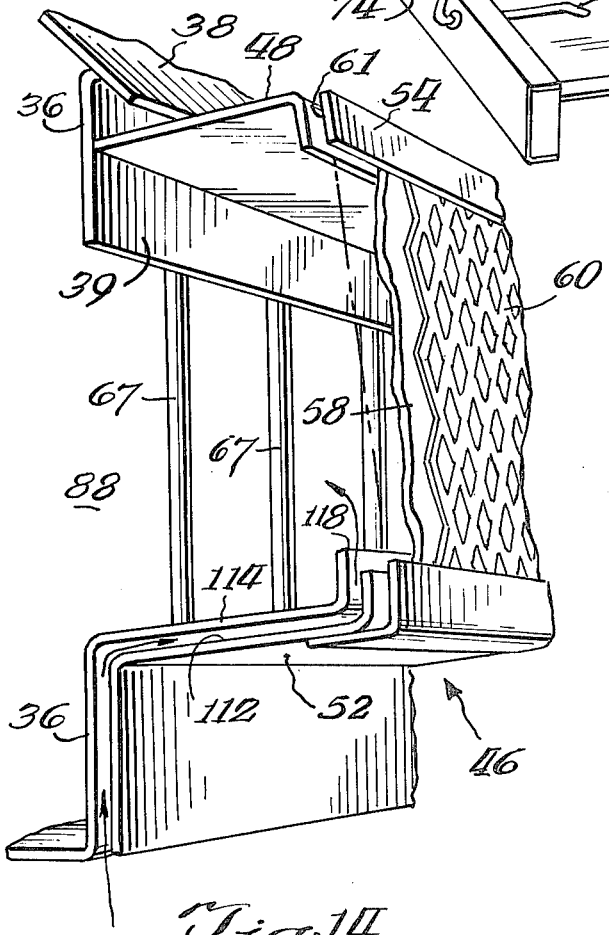
FIG. 14 is a fragmentary perspective view of a fire viewing box and associated heated air inlet channel that may be employed with the stove of FIGS. 1–7, taken in section along a plane perpendicular to the long axis of the viewing chamber.

Guard bars 67, as shown in FIGS. 14 and 16 prevent any logs or other pieces of solid fuel from accidentally falling into fire viewing chamber 46 when the fuel is being deposited on the fire grate.

As shown in FIG. 5, ash collecting space 68 is located within the interior of stove cabinet 30 directly beneath the fire grate, which is at the bottom of the fire chamber. Ash removal opening 70 (FIGS. 6 and 20), which communicates with ash collecting space 68, is provided at the bottom of end wall 34 shown at the right-hand side of FIG. 1. Cover plate 74 is provided for this ash removal opening, to produce a substantially airtight closure for the opening. Cover plant 74 may be removed or pushed back into place, to open or close the ash removal opening, by means of handle 76. Handle 76 may also be used, as will be explained below, to pull the ash pan out from the interior of the stove cabinet when ashes are to be removed.

Exhaust leaving fire chamber 88 escapes from stove cabinet 30 through exhaust outlet opening 80 in top wall 40 (FIG. 5), which opening communicates with the top portion of the cabinet, exhaust space 81. Flue 82 conveys the exhaust from the wood burning stove, through opening 80, to a stack or chimney leading to the outside of the building in which the stove is located. A damper may be provided in flue 82 to reduce or substantially close off the flow of air or exhaust through the flue when this is desired.

As seen in FIG. 5, lower level air inlet opening 84 communicates with fire chamber 88 at the bottom of the chamber. Lower level air inlet opening 84 has predetermined, fixed maximum and minimum air transmitting conditions; the latter is preferably a completely closed condition. Except for any opening that may be present when lower air inlet opening 84 is in its minimum air transmitting condition, hinged cover 86 provides a substantially airtight closure of this opening.

Stove cabinet 30 as just described and any adjoining fire viewing chamber such as described below in this specification are of substantially airtight over-all construction, except for the openings (designated 62, 70, 80 and 84) just described, and the air metering means to be hereinafter described.

The features of the stove construction described thus far are conventional, although every feature described is not present in every prior art stove. The provision of a specially defined middle level air inlet opening or openings in addition to the lower level air inlet opening, the location and size of the various air inlet openings, the provision of air metering means having predetermined, fixed maximum and minimum air transmitting conditions for the middle level air inlet opening, and the arrangement of the elements of the stove cabinet and its fire viewing box to guide so-called secondary air through the lower portion of the middle level air inlet opening constitute important parts of this invention, and will be described in more detail below.

The Fire Chamber

As seen in FIG. 5, fire chamber 88 is defined by fire grate 90 at its bottom, generally vertical front wall 36, rear wall 42, and end walls 34, as well as an upper wall. In the embodiment shown, the upper wall is defined by slopping top wall 38 and baffle plate 89.

Upwardly extending front fire brick 98, rear fire brick 100, and fire brick 102 at the other end of the fire chamber 88 from fuel access opening 62 define the space in which pieces of wood to be burned in the stove are received. Brackets 104 hold generally upright fire bricks 98, 100 and 102 in place. Fire grate 90 is designed to receive a predetermined weight of pieces of solid fuel piled to a predetermined maximum height.

Baffle plate 89 is positioned to slant upward from back to front. This positioning of the baffle plate tends to deflect substantial portions of rising currents of gas and air from the burning fuel on the fire grate back into fire chamber 88. At the same time, opening 105 between the front edge of the baffle plate and sloping top wall 38 permits the exhaust from the stove to pass upward out of the upper portion of fire chamber 88 into exhaust space 81. Exhaust space 81 is defined by baffle plate 89 and by sloping upper wall 38, upper wall 40 and rear wall 42 of the stove cabinet. The exhaust space thus lies between and communicates with fire chamber 88 and exhaust outlet opening 80.

The shape of fire chamber 88 will depend to an extent upon the ultimate use to which the stove of this invention is to be put. With an air circulator such as is shown in FIGS. 1–7, appropriate dimensions may be a length-to-width ratio of about 3:2 with a height-to-width ratio of about 1:1.

The size of fire chamber 88 will depend upon the space to be heated and the various conditions under which the stove is to be used—such as the outside temperature, wind conditions, extent of insulation of surrounding walls, etc.

Level of Air Inlet Openings

The level of the air inlet openings into the fire chamber of the stove of this invention, as already mentioned above, is an important feature of the invention.

Lower Level Opening

As best seen in FIGS. 5 and 6, lower level air inlet opening 84 communicates, through grill 110, with ash collecting space 68, which is entirely below the bottom of fire chamber 88. This is the preferable location for introduction of so-called primary air into the fire chamber. It is not necessary in the stove of this invention that so-called primary air be introduced at this preferable level entirely below the bottom of the fire chamber, as in FIGS. 5 and 6, but it is necessary that it be introduced at least somewhere adjacent the bottom of the fire chamber.

In any event, the path through which air flows from outside the stove into the lower level air inlet opening, and from there into the fire chamber, must be entirely separate from the path through which air flows from outside the stove into the fire chamber through the middle level air inlet opening or openings to be described below.

Middle Level Opening

The positions of bottom edge 47*a* and top edge 47*b* of middle level air inlet opening 47 are determined by reference to the average height of fire chamber 88 measured from the fire grate at the bottom of the chamber to the upper wall at the top of the chamber. This average height is measured in FIG. 5 from the top of the fire bricks that comprise fire grate 90 to a point 91 that lies about two-thirds of the way from the back to the front of baffle plate 89, the upper wall of the fire chamber. The levels of bottom edge 47*a* and top edge 47*b* are also measured from fire grate 90.

(Whenever reference is made in this specification or claims to the "average height" of the fire chamber in any case which a single baffle plate forms the upper wall of the fire chamber (as for example in the embodiment shown in FIG. 5), the measurement is made, as just indicated, to a point that lies about-two-thirds of the way from the back to the front of the baffle plate that comprises the upper wall. If a plurality of overlapping baffle plates is used, as shown for example in FIG. 24 below, the average height of the fire chamber is measured from the fire grate to midpont 91', measured from back to front, of the uppermost baffle plate of the plurality of baffles. If no baffle plate is employed, the average height of the upper wall of the fire chamber above the fire grate is determined by measuring the height at typical points and striking an average.)

In the embodiment shown in FIG. 5, the height $h_b$ of bottom edge 47*a* of middle level air inlet opening 47 is approximately 1/6 of the average height of the fire chamber $h_{fc}$. Height $h_t$ of top edge 47*b* is approximately $\frac{2}{3}$ of the average height of the fire chamber above the fire grate.

In the embodiment of FIG. 16, bottom edge 47*a* of middle level air inlet opening 47 is located at a level $h_b$ above the fire grate 90 that is approximately $\frac{1}{4}$ of the average height $h_{fc}$ of fire chamber 88. Top edge 47*b* of the middle level air inlet opening in that Figure is located at a level $h_t$ above fire grate 90 equal to approximately 4/5 of the average height of the fire chamber above the grate.

Satisfactory results are obtained when the bottom edge of the middle level air inlet opening is at a level of about 1/10 to about $\frac{1}{3}$ of the average height of the fire chamber. Improved results are obtained if the bottom edge of the middle level air inlet opening is at a level between about $\frac{1}{8}$ and about $\frac{1}{4}$ of that average height. The preferred level of the bottom edge of the middle level air inlet opening is at about 1/6 of the fire chamber average.

With respect to the top edge of the middle level air inlet opening, satisfactory results are obtained when it is at a level between about $\frac{1}{2}$ and about 4/5 of the average height of the fire chamber. Improved results are obtained if the top edge is at a level between about 3/5 and about $\frac{3}{4}$ of the fire chamber average height, and the preferred level of the top edge of the middle level air inlet opening is at about $\frac{2}{3}$ of that average height.

Volume of Air Introduced Into Fire Chamber

Control of the volume of air introduced into the fire chamber through the middle level air inlet opening is an important part of this invention. In the preferred embodiment of the stove of this invention, the ratio of the volume of air introduced through the lower level and middle level air inlet openings is also controlled.

All the discussion below concerning control of the volume of air introduced into the fire chamber assumes that the stove will be operated with a controlled draft of about 0.05 inch of water column, whether achieved with a barometric damper or an equivalent manual damper, chimney construction, or fan induced draft. However, a stove constructed as described below can operate satisfactorily under other draft conditions as well.

Dimensions of Air Metering Means For Middle Level Opening

In the embodiment of FIG. 5, shallow air transmitting channel 112 extends along the bottom of viewing box 46. The bottom wall of channel 112 is integral with viewing box bottom wall 52, and the other wall of channel 112 is upper wall 114, which comprises the bottom wall of the fire viewing chamber inside box 46. Air enters channel 112 at slot 116, and exits from the channel at the termination thereof through narrow aperture 118.

Air transmitting channel 112 preferably has a cross sectional area approximately the same shape and dimensions as they cross sectional area of aperture 118 when it is in its predetermined, fixed maximum air transmitting condition.

In the embodiment shown, upper wall 114 is curved in the last portion of channel 112 immediately adjacent terminal aperture 118. It is preferred, as shown in FIGS. 14 and 16, that both lower wall 52 and upper wall 114 of channel 112 are curved along paths parallel to each other so that the channel has a curved cross section in the last portion thereof immediately adjacent aperture 118.

In addition to providing a means for protecting air to be admitted into viewing box 46 and helping determine the shape of the stream of air that flows into the viewing box (both of which effects are discussed below), channel 112, with its openings 116 and 118, comprises an air metering means that determines the amount of air that ultimately reaches middle level air inlet opening 47. Preferably air metering means provides communication at all times between the air surrounding the stove and middle level air inlet opening 47.

When lower level air inlet opening 84 is in its minimum air transmitting condition (preferably with cover 86 totally closed), air metering means 112 admits into the fire viewing chamber of box 46 an amount of air that, when directed through middle level air inlet opening 47, will provide the amount of so-called secondary air that is appropriate, among other things, to maintain a limited amount of primary combustion together with an amount of secondary combustion that will produce the burning of at least the majority, and ordinarily a much larger portion, of the flammable gases driven off from the burning wood. The determination of the amount of air to be introduced into fire chamber 88 through air metering means 112 is described more fully below.

Air metering means 112, fuel access opening 62, ash removal opening 70, and lower level air inlet opening 84 all can be selectively opened or closed (or, where applicable, placed in their maximum or minimum air transmitting condition) independently of each other.

During operation of the stove of this invention, the air in the interior of fire viewing box 46 constitutes a reservoir of air—or a body of air in what might be called a "pre-mixing zone"—from which so-called secondary air is withdrawn to pass through middle level air inlet opening 47 into fire chamber 88. At the same time, the withdrawn air is continuously replaced by incoming air from air transmitting channel 112 that circulates within the viewing chamber.

The amount of so-called secondary air that must be continuously withdrawn and replaced in order to maintain the stove in its desired mode of operation is determined according to the principles of this invention by either of two methods. The first of these methods, which may be called a "dimensional method," is to dimension air metering means 112 so as to provide a passage for air flow that has a cross sectional area of a specified amount in relation to the volume of fire chamber 88.

Air metering means 112 has at least a predetermined, fixed maximum air transmitting condition and, in an embodiment to be discussed below, has a predetermined, fixed minimum air transmitting condition as well, in which latter condition it allows the passage of air but in a reduced amount. Satisfactory results are obtained with the stove of this invention when air metering means 112 in its predetermined, fixed minimum air transmitting condition provides a passage for air flow having a cross sectional area between about 0.6 sq. in. and about 1.2 sq. in. for every cubic foot of volume of fire chamber 88. Improved results are obtained when air metering means 112 in its maximum air transmitting condition provides a passage for air flow having a cross sectional area between about 0.7 sq. in. and about 1.1 sq. in. for every cubic foot of volume of the fire chamber. Still further improved results are obtained if the described cross sectional area is between about 0.8 in. and about 1 sq. in. for every cubic foot of volume of the fire chamber, and a value of about 0.9 for this figure is preferred.

In determining the volume of fire chamber 88, it is necessary only to compute the approximate volume of the space within which combustion ordinarily takes place. This space is defined by the various physical elements that are located within stove cabinet 30 and by the plane of middle level air inlet opening 47 at the front of the fire chamber.

The longitudinal cross section of fire chamber 88, as seen in FIG. 6, is substantially rectangular in shape, with the exception of the small volume occupied by end fire bricks 102. The lateral cross section of fire chamber 88, seen in FIG. 5, has the shape of an irregular polygon, outlined generally by fire grate 90, front fire bricks 98, the plane of middle level air inlet opening 47 and front wall 36, sloping top wall 38, the opening at front edge 105 of baffle plate 89, the baffle plate itself, rear wall 42, and rear fire bricks 104. Dead spaces 105 are thus not included in the computation of the volume of the fire chamber.

Nor is the volume of viewing chamber 46 included in the computation, because that chamber (as explained above) merely acts as a reservoir, or pre-mixing zone, where air is being continuously introduced and withdrawn. Since the very hot flammable gases from the burning fire move straight up from the fire and remain entirely in fire chamber 88, with substantially no portion of these gases flowing into the viewing chamber, no oxygen is required for any combustion process in the latter space. Thus the space in question should not be included in any calculation that is intended to show the degree of richness in oxygen that is required to sustain combustion in the desired mode.

The figures given for the effective cross sectional area of air metering means 112 in relation to the volume of fire chamber 88 are specified for air being introduced under natural aspiration conditions, with the pressure difference that moves air into and through the metering means being unassisted by any mechanical propulsion means such as a blower fan. If a fan or other means for accelerating introduction of air into the stove is employed, an equivalent volume of air will be introduced with a smaller effective cross sectional area for the air metering means being employed. The velocity of the incoming air will be increased, but the total volume of air will be the same.

The higher velocity of the incoming air when a blower fan is used may have a greater effect in keeping the interior surface of viewing window 58 clear of creosote or other undesirable solids. However, the increased velocity will reduce the preheating achieved by air transmitting channel 112, and if this effect is not countered by a step such as lengthening the channel, the resulting cooler air will tend to decrease both the efficiency of the secondary combustion taking place in fire chamber 88 and the window cleaning effect of the sheet of air.

As explained below in connection with FIG. 23, other openings may be provided in fire viewing box 46 or in fire chamber 88 (in the latter case, at a middle level as defined above) through which air can be introduced into the fire chamber in addition to the air metering means exemplified in the embodiment of FIGS. 1–7 by air transmitting channel 112. Other openings of this type may be used if the design principles of this invention directed to avoiding introduction of too much so-called secondary air into fire chamber 88 at too high a level are observed. If any such other openings are present, the effective cross sectional area of those openings must be added to that of channel 112 in computing the cross sectional area of the air metering means in the practice of the present invention.

Ratio Of Lower And Middle Level Air

For best results, the amount of air admitted to fire chamber 88 through air metering means 112 the so-called secondary air—should be at least equal to the amount of air introduced through lower level air inlet opening 84—the so-called primary air—when both of them are in their maximum air transmitting conditions. This ratio of so-called secondary and so-called primary air is expressed, of course, for the rapid burning mode of operation of this stove, when lower level air inlet opening 84 is completely open.

When this feature is included in the stove of this invention, satisfactory results are provided when the indicated ratio is between about 1:1 and about 5:3. The preferred value for this ratio is about 6:5.

These preferred conditions are consistent with the results of tests directed to the question of the preferred ratio of so-called secondary air to the so-called primary air as reported at pages 19–21 of Quarterly Report No. WB-5of the Dept. of Mechanical Engineering of Auburn University entitled "Improving the Eficiency, Safety and Utility of Wood Burning Units" (Dec. 15, 1978).

Observable Rapid Burning And Normal Burning Modes of Operation

A second method of determining the desired sizes of lower level air inlet opening 84 and of air metering means 112, which may be called an "observational method," is to perform a carefully controlled test while varying those sizes until certain observable results are obtained. The conditions for the test to be carried out with any given stove are as follows:

(1) Only standard test wood should be employed. When the term "standard test wood" is used in this specification and claims, it means hardwood (such as oak, hickory, elm or ash) having about 20 to 30 percent of moisture by weight and having the form of logs or pieces with the following characteristics:

Approximately 9/10 as long as the length of the fire grate.

Generally circular, semi-circular, square, or triangular in transverse cross section.

Approximately 3"–6" in diameter or thickness.

(2) A charge of standard test wood should be placed on the fire grate in a predetermined weight that will bring the pile of logs no higher than about ⅔ of the average height of the fire chamber. In other words, the average height of the fire chamber should be at least one-and-a-half times the height of the pile of firewood.

(3) During the test, no more than this predetermined weight of standard test wood should be on the grate at any given time, but additional fuel may be added as needed so long as the predetermined total weight of fuel is never exceeded. As will be understood by one experienced in the combustion of wood and the operation of wood burning stoves, during the test being described only relatively small quantities of fuel should be added at any fiven time, in order not to produce too great a change in the character of the burn at that time. Such a person will further understand that when additional fuel is added, not only should the quantity be limited but before the fire is checked for the presence of flames of a specified kind the entire pile must have been burning for at least the same length of time as specified below for the burning of the initial pile of logs, i.e., at least about 30 minutes.

(4) During the test, a barometric damper is employed to provide a controlled draft of about 0.05 in. of water column.

The general size and shape of standard test wood is specified in order that the volume and surface area of each individual piece will not vary too greatly from piece to piece. The total volume occupied by all the pieces of wood taken together determines how much fire chamber space is left into which air can be introduced to support combustion, and the total surface area of all pieces, excluding the area of any surfaces that abut other surfaces, determines the total exposed surface area of logs over which combustion proceeds. These two figures in turn determine the quantity of air that must be introduced into the fire chamber to burn the fire wood most effectively in the various modes in which the stove is operating. Standardizing the indicated characteristics of the fire wood used in this test helps assure that the results of the test will be reliable.

At least two distinct modes of operation (which have been discussed above) can be observed when a stove is tested according to the standard test just described. These modes are:

(1) The "rapid burning mode of operation," in which a freely burning fire is developed, with yellowish-orange flames present above at least a portion of the solid fuel on the grate.

(2) The "normal burning mode of operation," in which the combustion of a bed of glowing hot coals is sustained on the fire grate, and (when this mode has become stabilized after approximately 15 minutes of burning) only flickering, blue and yellowish-blue flames are visible above the bed of glowing hot coals. The blue flames are more easily seen if the amount of light outside the stove is reduced as mush as feasible. In this mode, combustion of at least the majority, and usually a very much larger proportion, of the flammable gases driven off from the bed of hot coals is maintained.

The observational method involves trial-and-error adjustment of the size of both lower level air inlet opening 84 and air metering means 112. Although the size of the lower level air inlet opening in its maximum air transmitting condition is not so critical as the size of the air metering means 112, it is preferred, as indicated above, that the amount of air admitted through the former opening in its maximum condition be no longer than the amount admitted through the metering means.

Employing the test conditons described above in the first step of the observational or trial-and-error method, the cross sectional areas of lower level air inlet opening 84 and metering means 112 are adjusted so that when they are both in their maximum air transmitting conditions, air is introduced into fire viewing chamber 46, and from there into fire chamber 88, in an amount sufficient to sustain the rapid burning mode of operation of the stove, but not sufficient to heat the exposed top or front of the stove above an acceptable temperature.

Observation of this condition is made after the fire has become well established—in other words, after the pile of logs has been burning for at least about 30 minutes after ignition but has not yet been substantially transformed into charcoal. The minimum period of burning is necessary to permit the stove to heat up to a stable condition. The reason for avoiding the charcoal stage in this test is that it would be more difficult to achieve a rapid burning or normal burning mode with only charcoal as the fuel.

As pointed out above, the acceptable temperature for a wood burning stove depends upon the use for which it is intended. With an air circulator of the type illustrated in FIGS. 1–7 that is to be used in the living area of a residence, the exposed top or front of the stove should not rise above about 750° F., and preferably not above about 600° F. Opening 84 and metering means 112 are enlarged or made smaller, as necessary, to meet the criteria stated for the rapid burning mode of operation.

The second step in this test to determine the desired sizes of lower level air inlet opening 84 and air metering means 112 is to move cover 86 to put the lower level air inlet opening in its minimum air transmitting condition (preferably with the cover entirely closed), and permit combustion to proceed in the stove for approximately 15 minutes. Air metering means 112 is of the proper size if, after the test has proceeded for approximately 15 minutes under the stated test conditions the amount of air passing into fire viewing chamber 46 and from there into fire chamber 88 is of an amount that is sufficient to sustain a normal mode of operation as described above. If any increase or decrease in the size of air metering means 112 is required in order to meet the stated criteria for the normal burning mode of operation of the stove, the required adjustment should be made. This may require an accompanying adjustment of the size of the lower level air inlet opening in its maximum air transmitting condition, if the preferred relationship between the air transmitting capacity of the two openings for the rapid burning mode is to be maintained.

In any event, after the second step of this method (described in the immediately preceding paragraph) is completed, the first step (described in the fifth through the second immediately preceding paragraphs) should be repeated to see whether the criteria for the rapid burning mode are still met. Should this result in any change in either opening 84 or metering means 112, the procedure described should be repeated until the respective criteria for the two modes of operation of the stove are met.

Banked Mode Of Operation

The preferred form of the stove of this invention has still a third, very important mode of operation. This is the "banked mode of operation," which again involves careful control of the amount of air passing through the air metering means and from their through the middle level air inlet opening of the stove.

Figure 9:
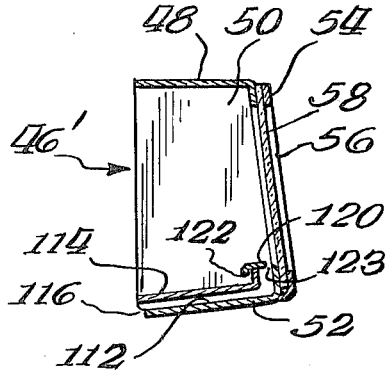
FIG. 9 is a cross section view of the viewing box of FIG. 8, taken along line 9—9 in the latter figure.
Figure 10:
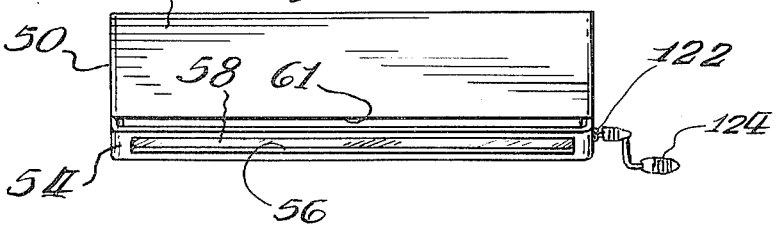
FIG. 10 is a top plan view of the fire viewing box of FIG. 8.

FIGS. 8–10 illustrate an alternative embodiment of a fire viewing box 46', which differs from box 46 only in that air metering means 112 has both a predetermined, fixed maximum and a predetermined, fixed minimum air transmitting condition. These conditions aree achieved by operation of a preselector means in the form of damper means 120. Damper 120 is pivotally mounted on pivot pin 122, and can be moved on that pivot from one position to another by handle 124.

In the embodiment shown in FIG. 9, damper blade 120, when fully closed, is spaced slightly from viewing window 58, to produce a narrow aperture 123 that provides a predetermined, fixed minimum air transmitting condition for air metering means 112.

When damper blade 120 is positioned by actuation of handle 124 to put air metering means 112 in condition to permit the flow of a predetermined small amount of air through narrow aperture 123, the stove is caused to function in its banked mode of operation. In this mode, sufficient air is introduced into fire viewing chamber 46 and from there into fire chamber 88 that it will, togehter with any air introduced through lower level air inlet opening 84 in its minimum air transmitting condition, sustain the combustion of a bed of glowing hot coals and grayish red coals on the fire grate. After approximately 15 minutes of such combustion, the amount of air introduced into the fire chamber in this banked mode of operation should not be sufficient to produce any substantial quantity of visible flames above the pile of coals.

As best seen in FIG. 9, damper blade 120 can be moved from one predetermined position (i.e., substantially horizontal) that produces a narrow aperture 123 for passage of the desired amount of secondary air for the banked mode of operation, to a second predetermined position (extending upward) that produces an aperture equal to or greater than the cross sectional area of air channel 112 for passage of the desired amount of secondary air suitable for either the normal burning mode or rapid burning mode of operation of the stove. Rotatable damper blade 120 thus operates as a preselector means for selectively placing air metering means 112 in one of two predetermined, fixed air transmitting conditions. The user of the stove rotates damper blade 120 into one of the two predetermined positions just described depending upon whether he desires to operate the stove in its banked mode of operation or its normal burning mode of operation when lower air inlet opening 84, for so-called primary air, is in its minimum (preferably closed) air transmitting condition.

It is seen that air metering means 112 has a maximum and a minimum air transmitting condition, respectively, depending upon whether preselector mmeans 120 is in its upwardly extending predetermined position or its horizontal predetermined position, both as just described. It will also be seen that when preselector means 120 is in one of those two predetermined positions, air metering means 112 has no other air transmitting conditions than its maximum and its minimum conditions. It is this limitation of the number of air transmitting conditions of air metering means 112 (for so-called secondary air) to two predetermined, fixed conditions, together with the limitation of the air transmitting condition of lower air inlet opening 84 (for so-called primary air) to two predetermined, fixed conditions, that achieves the reliable, consistent control of the desired mode of combustion that is the hallmark of this invention.

The spacing of damper blade 120 from viewing window 58 when the damper is in its fully closed position that will produce the banked mode of operation of the stove can be determined in either of two ways.

First, the desired spacing of damper blade 120 from window 58 can be determined by what again may be called a "dimensional" method. Satisfactory results are obtained when a passage for air flow is provided at gap 123 having a cross sectional area between about 0.09 sq. in. and about 0.55 inches for every cubic foot of volume of the fire chamber. Improved results are obtained when these figures are between about 0.13 sq. in. and about 0.45 sq. in. for every cubic foot of volume of the fire chamber. Further improvement is obtained when the value of these figures is between about 0.17 and about 0.3, and the preferred value is about 0.2 sq. in. for every cubic foot of volume of the fire chamber.

Second, the proper spacing of blade 120 from window 58 can be determined, using what may again be called an "observational method," by observation of the nature of the combustion proceeding in the fire chamber under the standard test conditions described above. The proper spacing of the blade is that which under the standard test conditions described will provide enough air to sustain a bed of glowing hot coals and grayish red coals as described above, but (after about 15 minutes) will not produce any substantial quantity of visible flames.

The values stated for the dimensional design method are based primarily on the length of time a given weight of firewood continues to burn and produce a certain minimum heat output as measured, for example, by the temperature of the exhaust as it leaves the fire chamber. Because the purpose of operating the stove of this invention in its banked mode is to keep the wood fire going as long as possible with a useful minimum heat output, the minimum temperature for the exhaust in this mode of operation is preferably set at some fairly low figure such as, for example, about 140° F., which it is believed is equivalent to an exterior temperature at flue 82 of about 100° F.

This low a figure for the temperature of the exhaust carries with it, unfortunately, the disadvantage that the temperature within fire viewing chamber 46 drops correspondingly, and thus whenever the flow of air is metered through air metering means 112 at an especially low figure, there will be a tendency for creosote or other solids to deposit on the interior surfaces within chamber 46 and especially on viewing window 58.

Depending upon the type of wood being burned in the stove, this deposition of creosote or other solids may occur at a level of introduction of air into fire chamber 88 that is represented by an air flow through a passage having a cross sectional area of as high as 0.2 sq. in. per cubic foot of volume of the fire chamber. Since, as stated above, this is a preferred level of introduction of air into the stove of this invention to produce the most efficient long term burn with an acceptable minimum product of heat, it is advantageous to accept the compromise represented by the resulting creosote condition and simply to compensate for it.

One method of compensating is to provide for the insertion of a shield of some type to be positioned over the interior surface of fire viewing window 58 to avoid any deposite of creosote or other solid matter on the window when the stove is operated in its banked mode. When the stove is thereafter returned to its rapid or normal mode of operation, the shield may be removed. Any creosote or other solids deposited elsewhere within fire chamber 88 or fire viewing chamber 46 will ordinarily be burned off when the stove resumes one of those more vigorous modes of operation.

One form that may be taken by a shield to protect viewing window 58 from deposition of creosote is illustrated in FIG. 24. Protective doors 210 and 212 are rotatably mounted on shafts 214 and 216, respectively. Protective doors 210 and 212 overlap in abutting engagement when in the position shown in FIG. 24. When the stove is in its banked mode of operation, the doors are kept in this position, to protect the interior surface of window 58 from creosote and other solids.

Air entering air metering means 112 is heated as it passes through that channel. It exits through terminal aperture 118 and enters space 218 between window 58 and protective doors 210 and 212. The air then exits from space 218 through the crevices surrounding the protective doors. This flow of air, in co-operation with the draft within the stove, keeps creosote laden smoke from space 218 and thus keeps it from coming into contact with the interior surface of window 58.

When the stove is operated in its normal burning mode or in its rapid burning mode, protective doors 210 and 212 may be swung open by handles (not shown) that extend outside viewing box 46. In these modes of operation, the protective doors occupy positions such as shown in dashed line in FIG. 24.

Shape And Extent Of Terminal Aperture Of Air Metering Means

Best results are obtained with the stove of this invention if terminal aperture 118 of air metering means 112 has the shape of an elongated slot. A satisfactory ratio of the length of the elongated slot to its width is at least about 75:1. Improved results are obtained when this ratio is at least about 150:1.

The location of the slot in relation to the shape and dimensions of the fire chamber is also important. It is preferred, when the fire chamber is longer than it is wide, that the elongated slot extend along the long side of the chamber. Combustion in the stove is further improved if the slot extends substantially from one end of fire chamber 88 to the other.

The described shape of terminal aperture 118 causes the air flow from air metering means 112 to take the shape of a thin, planar sheet of air. This not only lends itself to the window cleaning action for the fire viewing chamber described below, but also facilitates controlled introduction of the air at the desired location in fire chamber 88.

The location of the slot along the long side of the rectangular fire chamber minimizes the distance that incoming air must travel for maximum diffusion through the fire chamber. Put another way, it minimizes the volume of the fire chamber that is located remote from the terminal aperture of the air metering means, on the far side of the chamber. When the elongated slot of terminal aperture 118 extends from one end of fire chamber 88 to the other, this improves the combustion by introducing air into the fire chamber with as nearly uniform distribution throughout the chamber as can be achieved.

The Baffle Plate

Baffle plate 89 extends substantially from one end wall 34 to the other end wall 34 of stove cabinet 30. However, as pointed out above, it provides clearance 105 at its front edge for exhaust to pass from fire chamber 88 to exhaust space 81, and from there out exhaust outlet 80. At the rear portion of baffle plate 89, it extends to within a short distance of rear wall 42 of the stove cabinet, to provide a narrow ash drop aperture 108, through which solid particles falling out of the exhaust can fall downward into fire chamber 88 and from there into ash collecting space 68.

For best results, baffle plate 89 is maintained in a position in which it slants upward from back to front on spaced support means such as brackets 130 shown in FIG. 16. These brackets occupy no more than a small fraction of the perimeter of baffle plate 89, in order to keep the flow of heat from the baffle plate at as low a level as is consistent with the support required for the plate. The maximum fraction of the baffle plate perimeter represented by the support brackets is preferably about 1/10.

Baffle plate 89 may, if desired, lie loosely upon support means 130. In this case, the plate may be provided with means such as downwardly extending protrusions 132 that keep it in a proper position to maintain ash drop aperture 108. Or, if desired, baffle plate 89 may be attached to at least some of support means 130.

As pointed out above, secondary combustion proceeds in the upper portion of fire chamber 88 most efficiently if the temperature is maintained at or above 1100° F., the approximate temperature at which the flammable gases driven off from the burning wood ignite. The described methods of attachment of baffle plate 89 to end walls 34 minimize heat flow from the plate to the end walls, and in this way help to maintain the temperature in the upper portion of the fire chamber at the desired minimum level. To further minimize heat loss from the baffle plate, support means 130 may, if desired, be formed of a heat insulating material.

A double baffle plate at the top of fire chamber 88 may be used to good advantage. The upper wall defining the fire chamber, as shown in FIG. 24, may be formed of two baffle plates 230 and 232, spaced in overlapping relationship with plate 230 in the lower position. Lower plate 230 is positioned to slant upward from fire chamber front wall 37 and sloping top wall 38 to a point in the rear half of fire chamber 88. Upper plate 232 is positioned to slant upward from rear wall 234 of fire chamber 88 to a point in the front half of fire chamber 88. Plate 230 is preferably positioned at an angle $\alpha$ to the horizontal, while plate 232 is positioned at a larger angle $\beta$ to the horizontal. Baffle plate 230 lies upon support means **236*a* and 236*b*, while baffle plate 232** lies upon support means 238*a* and 238*b*. The support means are carried by the end walls of fire chamber 88.

As a result of this arrangement of baffle plates, substantial portions of rising currents of gas and air from the burning fuel on fire grate 90 are deflected back from baffle plate 230 into fire chamber 88, and then follow a serpentine path around plate 230 and through gap 240 between the two plates. Exhaust then passes upward from fire chamber 88, past front edge 242 of upper baffle plate 232, into exhaust chamber 81. It is believed that combustion continues until the rising gases and exhaust flow past front edge 242 of upper plate 232, thus increasing the efficiency of the burn in fire chamber 88.

Air Circulating Means

Figure 2:
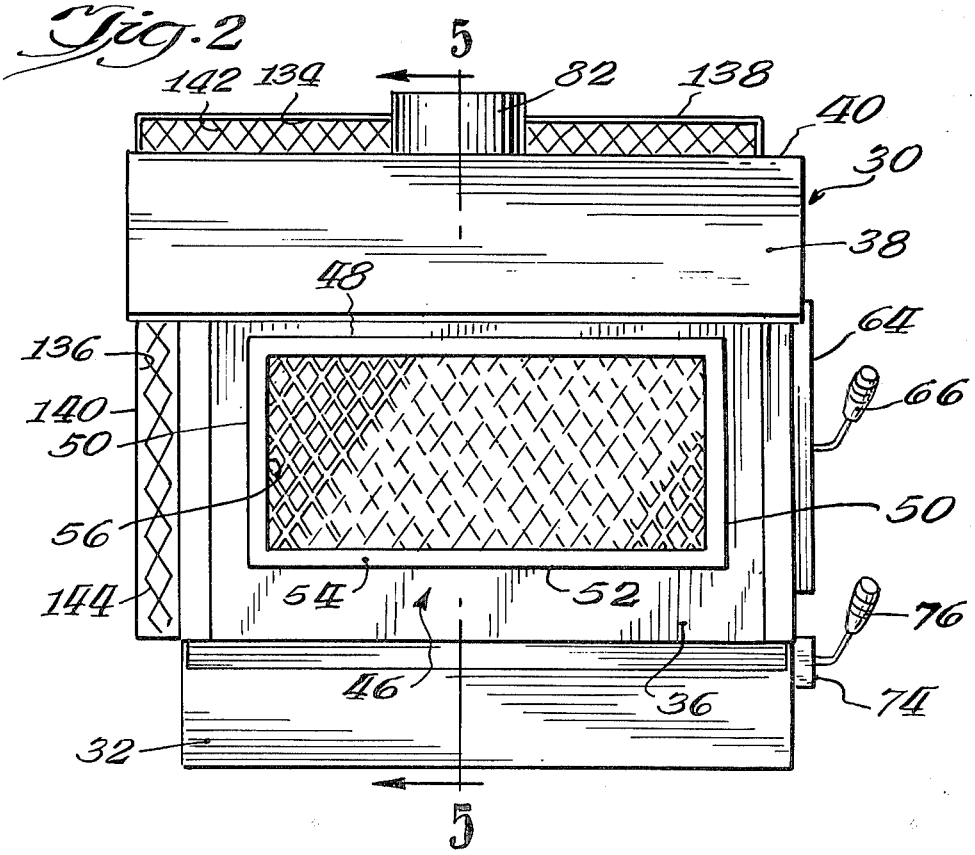
FIG. 2 is a front elevation of the stove shown in FIG. 1.

The stove of FIGS. 1–7 is provided with air circulating means at the rear and top of the stove, and at the left-hand end as seen in FIG. 2. Air heating passageway 134 is located at the rear of fire chamber 88, where heat from the fire chamber passes through rear wall 42. Air heating passageway 136 lies at one end of fire chamber 88, where heat passes through end wall 34.

Rear air heating passageway 134 is defined by rear shroud 138 (best seen in FIGS. 2, 5 and 12), and end air heating passageway 136 is defined by shroud 140 (best seen in FIGS. 2 and 6). These passageways have no fluid communication with fire chamber 88. Air is admitted into the passageways through opening 141 (FIGS. 12 and 16), to absorb heat from rear wall 42 and end wall 34 of fire chamber 88. The air in its resulting heated condition is discharged from passageway 136 at its outer end. The discharge ends of passageways 134 and 136 are provided with grills 142 and 144, respectively.

Figure 7:
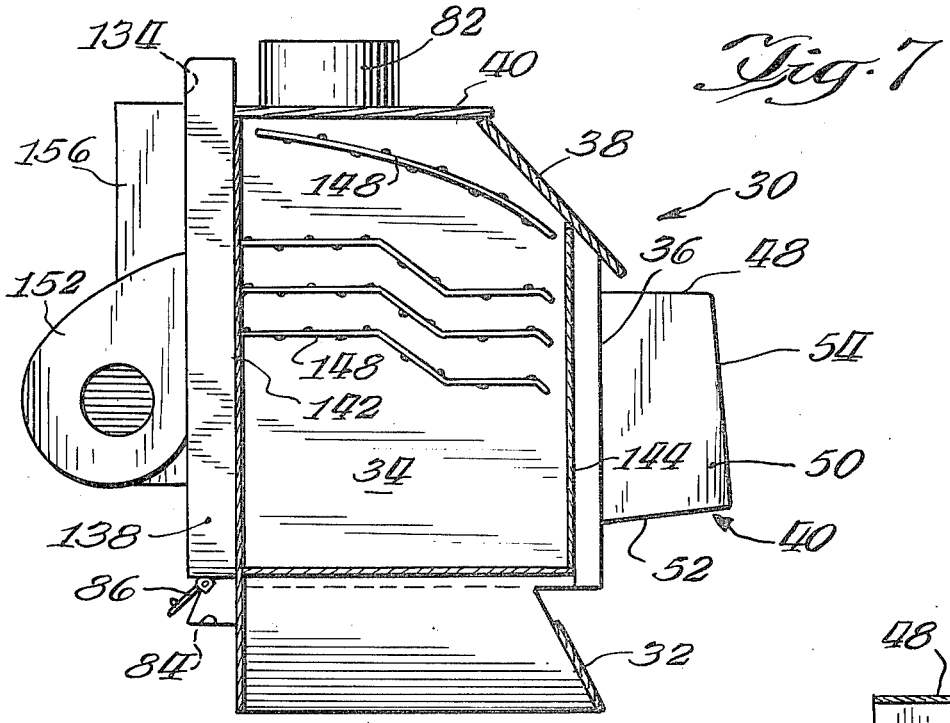
FIG. 7 is an end view of the stove of FIGS. 1–6 taken from the left-hand side of FIG. 2, with the end shroud for an air circulating passageway removed for clarity.

To facilitate the transfer of heat to the air passing through air passageway 134, heat conductive elements in the form of fins 146 are attached to rear wall 42 of fire chamber 88 (FIG. 12). Similarly, heat conductive fins 148 are located in air passageway 136, attached to end wall 34 (FIG. 7). Baffle 150, as seen in FIG. 12, deflects air that comes through inlet 142 from blower fan 152, and helps direct it through air passageways 134 and 136.

The path followed by the air thereafter through the air passageways is determined by metal fins 146 and 148. Fins 146 flare outwardly into rear air passageway 134 from the general location of inlet 141. Fins 148 flare downwardly into side air passageway 136 from the inlet end of the passageway adjacent opening 141.

Air is moved into air passageways 134 and 136 to be heated there, and then blown outward from stove cabinet 30, by mechanical blower fan 152, the operation of which is controlled (as explained in the next section of this specification) by a thermostat responsive to the temperature of the stove.

Automatic Operation of Stove

Two aspects of the stove of this invention may be operated automatically - the opening and closing of the lower level air inlet opening, and the blowing of air through and out of the heated air passageways.

In the stove of FIGS. 1–7, cover 86 for lower level air inlet opening 84 operates as a damper. As seen in FIG. 11, damper means 86 is connected by means of chain 154 to electrical control box 156. Damper 86 may be selectively moved from a maximum open to a minimum open condition (preferably entirely closed), and back again, by operation of thermostat 158 (FIG. 18, on the same sheet with FIGS. 13–15) mounted on the interior wall of rear shroud 138 or side shroud 140, which define the respective air passageways through which air to be heated by the stove flows.

Thermostat 158 may be a high limit bi-metallic thermostat that operates to close lower level air inlet opening 84 when the temperature of the heated air rises to, say 160° F. The result of this arrangement, which is shown diagrammatically in FIG. 18, is to reduce or cut off altogether the amount of so-called primary air flowing into the fire chamber as soon as a rapid burning rate of combustion is no longer necessary because the temperature of the air discharged from the stove has risen to a sufficiently high figure.

Thermostat 158 and the applicable electrical control in electrical control box 156 are arranged in a conventional manner. When the temperature of the air in the shroud where thermostat 158 is located rises to the temperature at which the thermostat is set, the applicable electrical control in box 156 releases chain 154 to permit cover 86 to fall to its closed position by force of gravity. If the temperature of the air shroud falls somewhat below the temperature at which thermostat 158 is set, the applicable electrical control activates chain 156 to raise cover 86 again to its open condition.

When damper blade 120 of air metering means 112 (described above with reference to FIGS. 8–10) is in its upwardly extending or open position, this puts air metering means 112 in its predetermined, fixed maximum air transmitting condition, and thus when cover 86 is moved into its open position as just described, the stove will move from its normal burning mode of operation to its usual rapid burning mode of operation. When damper blade 120 of air metering means 112 is in its horizontal or closed position, this puts air metering means 112 in its predetermined, fixed minimum air transmitting condition, and thus when cover 86 is moved into its open position the stove will move from its banked mode of operation to a second rapid burning mode (with a predetermined, fixed maximum amount of so-called primary air introduced into the fire chamber) that, as already mentioned above, involves a smaller amount of secondary air than is involved in the stove's usual rapid burning mode of operation.

It is seen that the stove of FIGS. 1–7 has three modes of operation - its usual rapid burning mode, its normal burning mode and its banked mode. Because the stove of FIGS. 8–10 has a second rapid burning mode of operation as described above, that stove has not three, but four, modes of operation, although the air metering means for so-called secondary air still has only two air transmitting conditions.

FIG. 18 also provides a diagrammatic showing of means to turn blower fan 152 on and off - thermostat 161. Thermostat 161 may be a bi-metallic, ON/OFF thermostat mounted on the interior wall of rear shroud 138 or end shroud 140. The thermostat may be designed, for example, to turn blower fan 152 on whenever the temperature of the air being heated by the stove rises to 110° F. or higher, and to turn fan 152 off when the temperature of the heated air falls to, say, 90° F. This action will mean that heated air above a selected temperature will be blown into the space to be heated, but if the wood fire burns low or entirely out and the temperature of the air thus falls too low, the stove will not continue to discharge the cooler air.

FIG. 19 gives a diagrammatic showing of an alternative arrangement for operation of damper 86. In this embodiment, two electrical thermostats 162 and 164 are connected in series, to control the operation of the damper. Thermostat 162 may be a low limit, bimetallic, wall mounted thermostat that can be manually set to a desired temperature such as, for example, 68° F. When the temperature of the room or other space to be heated falls below 68° F., the thermostat will be actuated to close the electrical circuit controlled by it and thereby put that circuit in condition to open damper 86. Thermostat 164 may be a high limit electrical thermostat mounted on the interior wall of either rear shroud 138 or end shroud 140. Normally conductive, this thermostat may be adapted to open the electrical circuit that controls damper 86 when the temperature of the heated air from the stove rises to 160° F. or higher.

The electrical controls that are actuated by the thermostats as just described are contained in electrical control box 156. As shown in FIG. 11, cable 159 connects control box 156 electrically with electric motor 160, which drives blower fan 152.

As will be seen, the interaction of thermostats 162 and 164 causes damper 86 to open when the temperature in the space to be heated drops below the temperature at which thermostat 162 is set, and keeps damper 86 open so long as the temperature of the heated air leaving the stove to enter the space being heated does not rise above 160° F.

Figure 13:
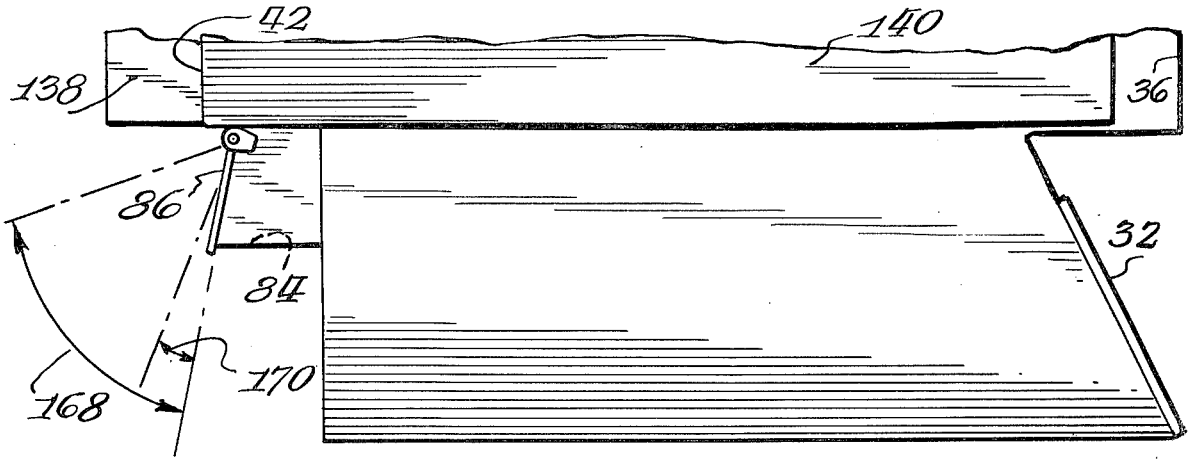
FIG. 13 is a fragmentary end elevation, from the same end as in FIG. 7, showing a portion of the means for controlling the air transmitting condition of the lower level air inlet opening of the stove of the latter figure.

As already stated above, the preferred minimum air transmitting condition for lower level air inlet opening 84 is with cover 86 completely closed, so that all so-called primary air is cut off. In the embodiment shown in FIGS. 1–7, cover 86 is completely closed when lower level air inlet opening 84 is in its minimum air transmitting condition FIG. 13 shows the position 168 of cover 86 when air inlet opening 84 is in its maximum air transmitting condition, and also indicates an alternative minimum air transmitting condition 170 that may, if desired, be employed in a stove utilizing the principles of this invention.

Pre-Heating Of Air For Middle Level Opening

As explained above, bottom wall 52 of fire viewing box 46 and bottom wall 114 of the fire viewing chamber define shallow air transmitting channel 112 which acts as an air metering means and also functions to shape a thin, planar sheet of air that is discharged into fire viewing chamber 46 from aperture 118.

During operation of the stove, the temperature within fire viewing chamber 46 remains very much lower than the temperature produced by the combustion that is proceeding within fire chamber 88. It does, however, rise to a temperature above the ambient temperature outside stove cabinet 30 and viewing box 46. In addition, bottom wall 114 of the fire viewing chamber becomes heated to some extent by conductance of heat from front wall 36 of the stove cabinet.

As a result of two heating effects described, air that enters shallow air transmitting channel 112, which extends along the entire bottom wall of viewing box 46, becomes heated to an extent before it enters the fire viewing chamber.

This preheating affect is increased when the shallow air transmitting channel of air metering means is extended, as shown in FIG. 14, not only along the entire bottom wall 52 of viewing chamber 46, but also along front wall 36 of fire chamber 88. Other means, such as insulation of bottom wall 52 of viewing box 46 against loss of heat to the surrounding atmosphere, may be employed, if desired, to increase the preheating of the thin sheet of air admitted to the stove through air metering means 112.

Reliability And Consistency Of Operation

A stove constructed according to this invention works substantially as well with softwood as with hardwood, provided both types of wood are present as pieces which individually have generally the same shape and volume and have been dried to approximately the same percent moisture.

The only difference between the operation of this stove with softwood and hardwood is that with hardwood, because of the greater density of such wood, a larger weight of fuel can be burned as a single charge. With one embodiment of this stove, for example, the stove accepts and burns very efficiently a charge of hardwood weighing about 60 pounds, while the same stove takes only about 32 pounds of softwood.

It is believed that the explanation as to why the stove burns softwood substantially as well as hardwood lies in:

(1) The careful control -- through predetermined, fixed, maximum and minimum air transmitting conditions of lower level air inlet opening 84 and air metering means 112 -- of the amount of air admitted into fire chamber 88 for every cubic foot of volume of that chamber;

(2) The fact that pieces of wood that have generally the same shape and volume will have generally the same configuration and occupy about the same general amount of space when piled on the fire grate, and will thus leave about the same volume in the fire chamber into which air can be introduced to maintain the combustion process;

(3) The fact that the combustion process proceeds initially at the surface of the wood, and pieces of wood of generally the same shape and volume piled up in generally the same configuration have roughly about the same surface area; and (4) While the more dense hardwood provides a greater weight of wood to be burned and thus requires a larger total amount of oxygen, it burns more slowly than softwood does and thus at any given time does not present a demand for oxygen that is significantly different from the oxygen demanded for the burning of softwood.

The stove of this invention can also be used to greater or less advantage with other solid fuels -such as pressed sawdust, pressed corn cobs, other pressed biomass material, wood chips, peat, coal, charcoal or the like-that upon heating and burning produce one or more flammable gases. The size of the charge of fuel will have be varied with the type of fuel.

Even when the preferred fuel of air dried hardwood logs of the preferred size and shape is used, the user will find it very difficult with prior art stoves to select the proper size draft openings for various operating conditions. The user will be able to select the proper size air inlet openings, if he can do it at all, only after long experience with a particular stove and extensive experimentation with various draft settings. This will require both a general knowledge of wood burning stoves, and a particular familiarity with the individual stove being used.

If the draft setting or settings are too low, prior art stoves will generate creosote and smoke, which will obscure any viewing window that is included in the stove, and in every case will produce unwanted deposits on the interior walls of the stove and in the flue. Moreover, if the door or other cover for the fuel access opening is opened while the stove is generating a large amount of creosote and smoke, these materials will puff out into the room through the open door.

If the draft setting or settings are too high, the stove will fail to burn a large part of the flammable gases driven off from the firewood during pyrolysis of the wood, and as a result a substantial amount of the heating value of the fuel will be wasted. Moreover, the fire in the stove may "run away" and grow much too hot; the top of a stove with such an improper setting has been known to grow actually red hot, with the characteristic cherry red color that indicates a temperature of about 1200° F.

In contrast to prior art stoves with draft settings that depend upon experimentation by the individual user, the stove of the present invention can be safely left unattended. Even without the feature of automatic operation, the amount of air introduced into the stove through air metering means 112 will reliably and consistently be an amount that will produce satisfactory combustion in the stove. With thermostat controlled automatic operation, the stove will operate in its banked mode if room thermostat 162 is set at a low temperature, and in its normal burning mode if the room thermostat is set at a somewhat higher temperature.

If the conditions under which the stove is operated require still more heat, thermostat 162 and 164 in the air heating passageway will cooperate to open cover 86 of lower level air inlet opening 84 and convert the stove to its rapid burning mode of operation. On the other hand, if the heated air from the stove gets too hot, thermostat 158 or 164 will be actuated to close cover 86 and cut off the entrance of air through lower level air inlet opening 84.

This manner of operating the stove of this invention is made possible by the fact that the determination of the proper size of lower level air inlet opening 84 and air metering means 112 for their respective predetermined, fixed maximum and minimum air transmitting conditions (regardless of whether the dimensional method or the observational method discussed above is used for determination of these parameters) produces very satisfactory combustion in all three modes of operation of the stove -- rapid burning, normal burning, and banked.

Once the desired mode is selected by the user, or selected automatically by operation of the thermostats used with the stove, the stove will respond automatically to produce the needed mode of operation. And this will be done reliably and consistently, regardless of what the experience or judgment of the person using the stove may be.

Air Paths Into And Through Fire Chamber

FIG. 20 illustrates in an idealized manner the general paths followed by streams of air that are admitted into, and pass through, the fire chamber of the stove shown in FIGS. 1–7 during the normal burning mode of operation of the stoge. For clarity, end wall 34, front wall 36, and sloping top wall 38 of stove cabinet 30, as well as end wall 50 of viewing box 46 and flue 82, are shown in transparent form in this Figure.

Two fire bricks 90, with open space 92 between them, are shown as typical of the construction of the fire grate. As explained above, air entering lower level air inlet opening 84 proceeds through grill 110 to ash collecting space 68, and from there up through the fire grate (FIG. 5). Arrows 180*a*, 180*b*, and 180*c* illustrate generally how this air mixes with and then rises with flammable gases from the wood being burned, moving up through fire chamber 88 until the resulting mixture strikes baffle plate 89.

As indicated in FIG. 20, the air and gases are deflected back downward from baffle plate 89 into the fire chamber. Meanwhile, as indicated by arrow 182, exhaust passes from fire chamber 88, through clearance space 105 between the front edge of baffle plate 89 and sloping top wall 38 of the stove cabinet, into exhaust space 81. From there, the exhaust moves up through flue 82, and on to the stack or chimney.

Air entering slot 116 at the rear of bottom wall 52 of viewing box 46 is represented in FIG. 20 by a wide band designated by the numeral 184. For clarity, after it has passed through air metering means 112 and out narrow aperture 118, this wide band is shown as being broken up into six arrows designated 184*a* through 148*f*. In actual fact, the air exiting from aperture 118, preheated as already discussed by its passage through air transmitting channel 112, has the form of a thin, planar sheet of air as it first leaves the aperture.

It is believed that a part of the air leaving aperture 118 tends to remain a thin, planar sheet until it has reached top wall 48 of viewing box 46. Thus, the preheated air represented by arrows 184*a*, 184*b*, and 184*c* moves upward across substantially the width of the interior surface of viewing window 58, so as to prevent the viewing window from being obscured by deposition of creosote or other solid particles thereon.

Keeping the window clean in this way is but one advantage of the preheating provided by the stove of this invention. Another important advantage of the preheating is to increase the efficiency of the combustion process by diminishing the cooling effect of the so-called secondary air that is introduced into fire chamber 88 to be mixed with the very much hotter column of air and gases rising from the burning firewood.

Arrows 184*d*, 184*e*, 184*f* represent another part of the sheet of air that exits from terminal aperture 118. This part of the air flows through viewing chamber 46 substantially directly to fire chamber 88, which it enters at approximately the level of bottom edge 47*a* of middle level air inlet opening 47. As will be seen, both viewing chamber 46 and fire chamber 88 are substantially free of any structure that would prevent such flow.

Other parts of the air that exit from aperture 118, which are not represented by arrows in FIG. 20, move through fire viewing chamber 46 and into fire chamber 88 at levels other than those at which arrows 184*a* through 184*f* are drawn. A substantial portion of the air that flows from terminal aperture 118 is directed by air metering means 112 and aperture 118, and is guided by the structural members of stove cabinet 30 such as window 58, top wall 48, downwardly extending wall 37, and bottom wall 114 of viewing chamber 46, to follow paths that enter fire chamber 88 in the lower portions of middle level air inlet opening 47.

The air flow described thus far in connection with FIG. 20 occurs during the normal burning mode of operation of the stove. FIG. 21, a cross sectional view similar to FIG. 5, provides another showing of the stove of this invention in its normal burning mode, with a set of arrows representing, again in idealized form, the flow of air through viewing chamber 46 that takes place during that mode.

Arrow 186*a* represents that part of the thin, planar sheet of air exiting from aperture 118 that sweeps across window 58, while arrows 186*b*, 186*c*, and 186*d* represent other parts of the air that trail off at various levels and flow at those levels through viewing chamber 46 into fire chamber 88. Of these latter arrows, arrows 186*c* and 186*d* represent the portion of the incoming air that is directed and guided along paths that enter fire chamber 88 through the lower half of middle level air inlet opening 47, where it mixes with, and moves upward with, the column of hotter gases rising from the burning fuel.

The rising column of very hot gases in fire chamber 88 is represented in FIG. 21 by arrows 188*a* through 188*d*. The portion of the rising column of gases represented by arrow 188*a* is deflected inward somewhat into fire chamber 88 by sloping front wall 38, and the portions of the column represented by arrows 188*c* and 188*d* are deflected downward and inward into chamber 88 by tilted baffle plate 89.

Because the greater heat generated in the rapid burning mode of operation of the stove of this invention creates a much stronger updraft in fire chamber 88, and as a consequence in viewing chamber 46 as well, the flow of air from terminal aperture 118 through the viewing chamber into the fire chamber differs in some respects during the rapid burning mode of operation from the flow that has just been described for the normal mode. FIG. 22, which is a cross sectional view similar to a portion of FIG. 5, shows in idealized form the flow of air during the rapid burning mode.

Arrow 190*a* represents that part of the thin, planar sheet of air exiting from aperture 118 that sweeps across window 58 during the rapid burning mode. This part of the air flow continues upward until its strikes upper wall 48 of viewing box 46. It is then guided by upper wall 48 and downwardly extending rear upper wall 37 of viewing box 46 through the viewing chamber toward fire chamber 88. Another part of the thin sheet of air leaving terminal aperture 118, indicated by arrow 190*b* in FIG. 22, flows through viewing chamber 46 at a lower level than the air indicated by arrow 190*a*.

Apparently the strong updraft created in viewing chamber 46 by the vigorously burning fire in chamber 88 during the rapid burning mode pulls air into viewing chamber 46 at a higher velocity than it enters the viewing chamber during the normal burning mode of operation. This causes a larger portion of the entering air to be pulled up toward the top of the viewing chamber. It is nevertheless believed that, depending upon the strength of the updraft in chamber 46, there may be some smaller part of the air exiting from aperture 118 during the rapid burning mode of operation that flows fairly directly to the lower portion of middle level air inlet opening 47 and then into fire chamber 88. This part of the air flow in the viewing chamber is represented by arrow 190*c*.

The air flowing through the viewing box into fire chamber 88 mixes there with the gases resulting from the combustion process, and with whatever part of the air that entered through lower level air inlet opening 84 has not as yet been used up in the combustion process, to move upward as a part of the column of very hot gases and air rising from the burning fuel. In FIG. 22, arrows 192*a* and 192*c* represent those parts of this rising column that are deflected inward by sloping top wall 38 and baffle plate 89, respectively, of stove cabinet 30.

Tests involving the introduction of dense smoke from outside the stove into slot 116 largely verify the descriptions just given of the flow of air from terminal aperture 118 of air metering means 112 through viewing chamber 46 and into fire chamber 88, in both the rapid and normal burning modes of operation of the stove of this invention.

Returning now to FIG. 20, air entering rear air passageway 134 from the space around the stove is heated in the manner explained above and exits -- as indicated by arrows 194*a* and 194*b* -- from the top of the passageway. Air also enters side passageway 136 from the space around the stove, is heated, and exits -- as indicated by arrows 196*a*, 196*b*, and 196*c* -- at the front of the passageway.

FIG. 17 shows an embodiment of the stove according to this invention in which the air exiting from the terminal aperture of the air metering means enters fire chamber 88 directly. This embodiment has no fire viewing box and therefore includes an alternative form of a middle level air inlet opening 47′ and air metering means 112′. Air metering means 112′, with its terminal aperture 118′, is located immediately adjacent fire chamber 88.

With air metering means located this close to the fire chamber, the stream of air emerging from the middle level air inlet is introduced immediately into the combustion that is proceeding in the fire chamber, where it mixes with the rising column of very hot flammable gases, and in the rapid burning mode with any air that entered through lower lovel air inlet opening 84 and has not yet been consumed in the combustion process.

Additional Guide Lines For Design Of Stove Of This Invention

In addition to the features specified above for a wood burning stove constructed according to this invention, certain other guide lines can be set forth that will be of help to one skilled in the art in designing such a stove. Although these guide lines have broad applicability, for clarity they are expressed below as applied to specific embodiments of the stove of this invention as disclosed in this application.

1. Because in the embodiment of FIGS. 1–7 upper wall 48 of viewing box 41 is located at a relatively high level in order to provide a good angle at which the burning wood fire can be observed, it is especially advantageous for a substantial part of fire chamber front wall 39 lying directly above middle level air inlet opening 47 -- or the equivalent, upper rear wall 37 of viewing box 46 -- to extend vertically downward well below top wall 48 of viewing chamber 46. The vertical surface of downwardly extending wall 37 or 39 helps direct downward that part of the air from terminal aperture 118 that sweeps past viewing window 58 to strike viewing box upper wall 48, and thus helps to avoid introducing too much so-called secondary air into fire chamber 88 at too high a level.

In the embodiment of FIG. 5, upper rear wall 37 of fire viewing chamber 46 extends vertically downward from the top wall of the viewing chamber a distance equal to approximately 1/7 of the height of viewing chamber 46 measured at the rear of he chamber.

2. If it is desired to make viewing chamber 46 relatively shallow from front to back, it may be helpful to have the wall directly above middle level air inlet opening 47 (or the upper rear wall of the viewing box) extend still farther vertically downward below upper wall 48 of the viewing chamber. In the embodiment of FIG. 14, for example, viewing chamber 46 is only about one-half as deep from front to back as it is high. As a result, part 39 of front wall 36 extends downward from wall 48 in this embodiment distance of about 1/5 the height of viewing chamber 46 measured at the rear of the chamber.

3. The air that strikes upper wall 48 of viewing box 46 can be most effectively prevented from entering fire chamber 88 at too high a level if concavely curved surfaces are provided at the top inside portion of viewing box 46. As shown in FIG. 16, these may be, for example, at corner 192 at the front end of top wall 48, and curved guide member 194 at the rear of the top wall.

The ultimate purpose of the design guide lines just discussed is to combat the introduction of too much so-called secondary air into the fire chamber at too high a level. The guide lines are in effect corollaries of the principle stated above that in the stove of this invention air metering means 112, its terminal aperture 118, and all of the structural members of stove cabinet 30 and of any fire viewing box such as box 46 should be disposed and arranged to guide a part of the air admitted through the air metering means, when the stove is in its normal burning mode of operation, along paths that enter fire chamber 88 through the lower portions of middle level air inlet opening 47.

Supplemental Air Metering Means

If desired, an additional air metering means may be used with the stove of this invention to supplement air metering means 112 discussed above. FIG. 23 shows one such supplemental air metering means.

FIG. 23 illustrates, in a manner similar to FIG. 21, the general paths followed by streams of air that are admitted into viewing box 46 through air metering means 112 and supplemental air metering means 250, which is located directly behind viewing window 58 in top wall 48 of viewing box 46. The situation shown in FIG. 23 is that which prevails when lower level air inlet opening 84 is closed by cover plate 86, so that no so-called primary air enters fire chamber 88.

Arrows 252*a* and 252*b* indicate in an idealized manner the general paths followed by the thin, planar sheet of air entering supplemental air metering means 250 from the space above viewing box 46. Arrows 252*c* and 252*d* indicate in a similar idealized manner the general paths followed by the thin, planar sheet of air that enters viewing box 46 from terminal aperture 118 of air metering means 112 at the bottom of the viewing box. These streams of air cooperate to help keep the interior surface of viewing window 58 free of depositon of creosote and other undesirable solids.

So long as the volume of air entering supplemental air metering means 250 from outside viewing box 46 is not too large, the air is apparently preheated to a limited extent by its contact with upper wall 48 and front wall 54 of the viewing box, both of which are at temperatures well above room temperature when the stove is in use. The air entering supplemental air metering means 250 will not, of course, be preheated to the same extent as the air that passes through air metering means 112 and out terminal aperture 118 at the bottom of the viewing box.

It is important that too large a volume of air that enters through supplemental air metering means 250 -- and is thus preheated to only a limited extent -- not be admitted into viewing box 46. To this end, slot 250 must be kept quite narrow, preferably no wider than about 1/16".

The general flow of air and gases in fire chamber 88 after the so-called secondary air from air metering means 112 and supplemental air metering means 250 passes through viewing box 46 into fire chamber 88 is shown in FIG. 23 by arrows 254*a*, 254*b* and 254*c*. As pointed out above, when the dimensional method is employed to determine the air transmitting capacity of the air metering means, the effective cross-sectional area of any openings such as supplemental air metering means 250 must be added to that of channel 112 in computing the cross-sectional area of the air metering means through which so-called secondary air is admitted into fire chamber 88.

The Ash Pan

Figure 15:
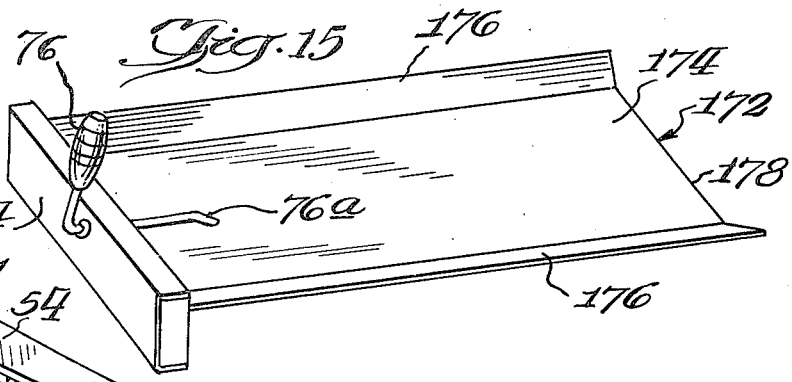
FIG. 15 is an isometric view of an ash pan employed with the embodiments of FIGS. 1–7.

FIG. 15 illustrates an ash pan 172 which may be used with the stove of this invention.

The ash pan has one end wall 74 which serves as the cover for ash removal opening 70 (FIGS 6, 16 and 17). Bottom wall 174 and slanting side walls 176 complete the ash pan. As will be seen, the pan is free of any end wall at end 178, at the opposite end of ash pan 172 from end 74.

In use, when the ash pan has filled up with ashes that drop down through openings 92 between the fire bricks of grate 90, handle 76 may be turned to release extension 76*a*, and the pan then pulled out of ash removal opening 70 for disposal of the ashes. When pan 172 is replaced by sliding it back into ash collecting space 68, the fact that there is no end wall at end 178 of the pan means that any ashes that have accumulated and remain in space 68 will be scooped up by the ash pan for later removal from the stove, rather than being pushed back into a pile that would have to be removed by a separate scooping-out process.

EXAMPLES

A series of examples in which wood burning stoves are subjected to practical test conditions will illustrate the various aspects of this invention.

In each of the Examples, the fuel used is "standard test wood" as defined above in this specification.

In each Example from No. 1 through No. 10, the stove is charged with about six to eight pieces of standard test wood having a total weight of approximately 32 lbs. The logs are piled in three layers to a height of about 8" to 10" above the fire grate. The logs of the size specified, arranged on the fire grate in the manner described and of the indicated weight, are referred to in Examples 1–10 as a "standard charge" of firewood.

In Example 11, because the purpose of the tests is to see how long the stove tested can be operated in its banked mode, a quantity of firewood larger than a "standard charge" is employed. In that Example, ten pieces of standard test wood, all being of a fairly large diameter or thickness and having a total weight of approximately 60 lbs., are used.

In all the Examples, the stove is operated with a barometric damper that provides a controlled draft of about 0.05 inch of water column.

Example 1

In this Example, a stove of the type shown in U.S. Pat. No. 4,117,824 is employed. This stove has secondary draft tubes that introduce conventionally defined secondary air at a location well above the top of the burning logs, near the top of the fire chamber. The inlet into the fire chamber from these draft tubes is at a level above the fire brick bottom of the fire chamber equal to approximately ¾ of the average height of the fire chamber measured from the bottom to the upper wall of the chamber. A glass observation door permits the monitoring of combustion within the stove.

Wood logs making up a standard charge of firewood are first lit and permitted to burn for about 30 minutes to develop into a freely burning fire, with secondary air introduced through the secondary draft tubes. The secondary air is later shut off.

No difference is observed in the burning of the wood logs whether with or without the introduction of secondary air at the indicated location near the top of the fire chamber. In both cases, the fire consists of yellowish-orange flames that are characteristic of incomplete combustion. Apparently, if a secondary burn is taking place at all, it does not occur in the fire chamber of the stove, but rather in the flue pipe.

The temperatures of the exposed front and top of the stove are about 800° F. and about 850° F., respectively, and the external flue temperature measured directly above the stove is about 550° F.

Example 2

In this Example, a stove of the type shown in U.S. Pat. No. 4,136,662 is employed. In this stove the cross sectional area of primary air inlet slot 168 is about 5 sq. in., of secondary air inlet opening 164 about 2 sq. in., and of secondary air inlet slots 36' and 38' about 23 sq. in. (FIG. 4 of U.S. Pat. No. 4,136,662.) The volume of the fire chamber is about 4.4 cu. ft. Secondary air inlet slots 36' and 38' (when hinged doors 50 and 52 are open and damper 170 is closed) thus provide a passage for flow of so-called secondary air having a cross sectional area of about 5.7 sq. in. for every cubic foot of volume of the fire chamber.

With damper blade 170 and hinged doors 50 and 52 open all the way, the wood logs of a standard charge are lit and permitted to burn for about 30 minutes to develop into a freely burning fire. At this stage the flames are the yellowish-orange color that indicates incomplete combustion. The temperatures of the exposed front and top of the stove and of the flue air are about 650° F., about 700° F., and about 650° F., respectively.

Doors 50 and 52 are then closed to shut off the introduction of secondary air through openings 36' and 38'. At this stage the fire continues to burn with yellowish-orange flames, but at a lower level of burning and with a lower production of heat. The temperatures of the front and top of the stove and of the flue drop to about 500° F., about 550° F., and about 400° F., respectively.

With damper 170 moved into a partially closed position, the yellowish-orange fire continues at a still lower level of burning, with an increased quantity of smoke and a still lower production of heat. In this stage the indicated temperatures drop farther, to about 400° F., about 450° F., and about 300° F., respectively.

Damper 170 is then moved into its fully closed position, in an effort to put the stove in condition for overnight heating. In this condition, the fire in the stove burns still lower, and after an hour or so of burning goes out completely.

Example 3

Using the same stove as in Example 2, damper blade 170 is put in its closed position but hinged doors 50 and 52 are left open. This test is designed to show how long the introduction of so-called secondary air through openings 36' and 38' will keep the log fire burning.

With the stove in the indicated condition, and a standard charge of firewood on the fire grate, the fire burns uncontrollably, with the temperature of the exposed front and top of the stove and of the flue being about 600° F., about 650° F., and about 600° F., respectively. The result is that the fire burns itself out completely in three or four hours, or in other words in the equivalent of only a fraction of a night.

Example 4

In this Example, a stove of the type illustrated in FIGS. 1–7 of this application is employed. The volume of the fire chamber (located between the fire bricks lining the fire grate and the baffle at the top of the chamber) is about 3.85 cu. ft. The average height of the fire chamber measured from the fire brick that lines the grate at the bottom of the chamber to the tilted baffle plate at the top of the chamber is about 15.75".

The volume of the fire viewing chamber in front of and communicating with the fire chamber is about 0.8 cu. ft., and the area of the aperture through which the fire viewing chamber communicates with the fire chamber is about 194 sq. in. The viewing box is about 6" from front to back, and at the back is about 10¾" high. The area of the glass viewing window in the front wall of the viewing box is approximately 165 sq. in.

In the present Example, air metering means 112 extends across the bottom wall 52 of viewing box 46. Terminal aperture 118 of the air metering means, located at the front of the viewing box, is about 3/16" wide and about 22" long, which gives it a cross sectional area of about 4.1 sq. in., or about 1.1 sq. in. per cubic foot of volume of the fire chamber.

Bottom edge **47*a* of middle level air inlet opening 47 is located at a level approximately 2.75" about the fire grate upon which logs to be burned in the stove are positioned. It is thus about 4"–6" below the top of the logs in a standard charge of firewood when the logs are first arranged in place upon the grate, and about 2" above the top of the bed of glowing coals resulting from the burning of the firewood after the coals have burned down very nearly to the end. The level at which bottom edge 47*a* of the middle level air inlet opening is located is approximately 1/6 of the average height of fire chamber 88 above the fire bricks that form grate 90** at the bottom of the chamber.

Top edge **47*b* of the middle level air inlet opening is located approximately ⅔ of the average height of fire chamber 88 above fire grate 90**.

Lower level air inlet opening 84, with a cross sectional area of about 3.2 sq. in., admits air from the space surrounding the stove into ash collecting space 68 located directly beneath fire grate 90. The resulting ratio of the quantity of air admitted to fire chamber 88 through middle level air inlet opening 47 when air metering means 112 is in its maximum air transmitting condition to the quantity of air admitted through lower level air inlet opening 84 when it is in its maximum air transmitting condition is approximately 1.3:1.

After a standard charge of firewood placed upon the fire grate is lit, combustion is permitted to proceed until there is a freely burning fire in the stove, with the high, yellowish-orange flames that are characteristic of such a fire. At this point, the exposed top and front of the stove are at temperatures of about 500° F. and 650° F., respectively, and thus are not above an acceptable temperature. The external flue temperature is about 575° F. The temperature of the heated air as it is blown outward from the stove is about 160° F.

Blower 152 is turned on and off automatically through the use of thermostat 159, which is mounted on an interior wall of air heating passageways 134 and 136, and is responsive to the temperature of the air in those passageways. In the stove tested in this Example, thermostat 159 is a bimetallic ON/OFF thermostat adapted to turn blower fan 152 on when the air temperature rises to 110° F., and to turn it off if the temperature falls to 90° F. or lower.

To test the automatic operation of blower fan 152 that blows air into air heating passageways 134 and 136, lower level air inlet opening 84 is closed by shutting damper 86 manually for a period of time. This reduces the intensity of the fire in the stove immediately, and the temperature of the air blown out from the stove drops in about two minutes to about 100° F. When the temperature of the air in the air heating passageways falls below the predetermined temperature of 90° F. at which the thermostat controlling the operation of the blower is set, which may occur ten minutes or so after the damper is shut, the blower turns off.

As a result of the fact that blower fan 152 does not operate to blow air into the space to be heated whenever the temperature of the air heated by the stove drops below a certain predetermined temperature, if the fire happens to go out for any reason the blower does not cause the resulting unheated air to be blown into the space to be heated.

A few seconds after lower level air inlet opening 84 is closed in this Example to test the automatic operation of blower fan 152, combustion noticeably slows down within the stove and the yellowish-orange flames of the freely burning fire are replaced by low, flickering, blue and yellowish-blue flames, while a bed of hot coals continues to glow on the grate. After this mode of operation continues for about 5 minutes, the temperatures of the exposed front and top of the stove and of the exterior of the flue are about 400° F., 450° F., and 300° F., respectively. At least by this time, substantially all the flammable gases present in the fire chamber from the heated and burning wood are burned up, so that those gases do not pass out through the flue.

When the damper is opened to admit lower level air again, the fire immediately starts to burn vigorously and within about 5 minutes or so the temperature of the heated air produced by the stove comes back up to about 110° F. When the temperature rises to this level, the blower turns on again.

Example 5

The test of this Example is carried out with the same stove immediately after the test of Example 4 is completed. In this Example, damper 86 closes off primary air inlet opening 84 altogether, and damper blade 120 is moved into position to define an aperture 123 about 1/32" in width, to simulate overnight use of the stove. In this condition, aperture 123 provides a passage for air flow having a cross sectional area of about 0.18 sq. in. for every cubic foot of volume of fire chamber 88.

When damper 86 is closed, the freely burning fire is replaced by a bed of glowing red coals and grayish red coals, with no substantial quantity of visible flames above the bed of coals. This level of combustion continues for somewhat longer than 12 hours, or the equivalent of a full overnight use of the stove. During this time, the temperature of the room heated by the stove remains at about 65° F.

Example 6

In this test, a stove of the general type described in Example 4 above is used, but air inlet aperture 118 near the front of bottom wall 52 of viewing box 46 is closed off and the only opening for the introduction of so-called secondary air is a series of holes bored in the top wall of viewing box 46 near the front of the box, in a manner similar to openings 36' at the top of the viewing box of the stove of U.S. Pat. No. 4,136,662. The holes have a total cross sectional area of about 0.5 sq. in. The ratio of their cross sectional area to the volume of fire chamber 88 is about 0.128 sq. in per cubic foot of fire chamber volume. The holes are spaced from each other by land areas that are about 2" wide.

A fire is started in the stove with a standard charge of firewood, and after about a one-hour period of a freely burning fire, glass viewing window 58 becomes blackened throughout most of its area. There is apparently little, if any preheating of the air that enters through the holes at the top of the viewing box without passing through any means such as air transmitting channel 112. The temperature of the incoming air is about 200° F. just inside the inlet holes.

Example 7

In this test, the stove of Example 6 is employed except that the air inlet holes at the top of the viewing box are closed off and the glass of viewing window 58 is raised in its side positioning slots to produce an air inlet opening about 3/16" wide and about 22½" long extending across the bottom portion of the front wall of viewing box 46.

A fire is started in the stove with a standard charge of firewood on the fire grate, and permitted to burn freely. Viewing window 58 becomes blackened throughout a part of its area, but not so rapidly as in Example 6.

This test confirms that an air inlet opening in the form of an elongated, continuous slot produces a more efficient cleaning effect than the discrete holes of the previous Example, which are separated by land areas of significant width.

The tendency of the entering air to keep the window clean is present even though there is only a relatively small amount of preheating of the air. The temperature of the incoming air is about 250° F. just inside the inlet slot.

Example 8

In this Example, the stove of Example 7 is employed except that the glass of viewing window 58 is seated in its bottom positioning slot to close off the aperture used in Example 7, and an air inlet slot about 3/16" wide and 22½" long is located in the front portion of the bottom wall 52 of viewing box 46. Air from the space around the stove enters this slot directly without passing through any narrow channel 112 at the bottom of the viewing box such as shown in FIG. 5 of this application.

When a fire is started with a standard charge of firewood on the fire grate and permitted to burn freely, the blackening effect on the glass viewing window is observable, but is not so extensive nor so rapid as in Example 7. The exposure of the incoming air to the portion of bottom wall 52 of viewing box 46 immediately adjacent the air inlet slot apparently produces somewhat more preheating of the air, and thus a somewhat greater tendency to keep the viewing window clean, than in Example 7. The temperature of the incoming air is measured at about 300° F. just inside the air inlet slot in this Example.

Example 9

In this Example, the stove of Example 4 is employed. In this stove incoming air is formed into a thin sheet of preheated air, as explained above in this specification, by passing through narrow channel 112 at the bottom of viewing box 46, and is then discharged upward to pass across viewing window 58.

In this test a fire is started with a standard charge of firewood on the fire grate. The temperature of the preheated air entering viewing chamber 46 through aperture 118 of air metering means 112—after the fire in the stove is well enough established to heat front wall 36 of fire chamber 88 and bottom wall 114 of fire viewing chamber 46 up to typical operating temperatures—is about 400° F. when lower level air inlet opening 84 is open, and about 300° F. when it is completely closed.

In this test, no deposits are observed on the viewing windows even after 24 hours of continuous use of the stove, with lower level air inlet opening 84 open for a total of about 10 hours and closed for the remaining 14 hours of the 24-hour period.

Additional fuel is added to bring the standard charge of firewood up to its original amount from time to time during the test.

Example 10

In this Example, the stove of Example 4 is used except that it is modified to produce a series of levels at which bottom edge 47*a* of middle level air inlet opening 47 is located, and also a series of cross-sectional areas for aperture 118 of air metering means 112.

To achieve the effect of lowering the level of bottom edge 47*a*, two rows of extra fire brick are placed on top of fire grate 90 to bring the level of the fire grate closer to bottom edge 47*a*. A test is carried out with only one row of extra fire bricks on the fire grate, which gives a value for $h_b$—the height of bottom edge 47*a* of middle level air inlet opening 47 above grate 90—of 1.37", and a volume for fire chamber 88 of about 3.67 cu. ft. (FIG. 5). A second test is carried out with two rows of extra fire bricks on fire grate 90, which gives a value for $h_b$ of zero inches and a volume for fire chamber 88 of about 3.49 cu. ft.

The extra fire brick is then removed from the stove and the level of bottom edge 47*a* of middle level air inlet opening 47 is thereafter progressively raised by positioning a vertical plate inside fire chamber 88 next to front wall 36 of the fire chamber and raising the plate by successive 1" increments. In this series of tests the volume of the fire chamber remains the same, about 3.85 cu. ft. Tests are carried out for various values of $h_b$ for the bottom edge of the middle level air inlet opening from 2.75" (with no plate in place) up to 7" (with the plate raised by that amount).

Terminal aperture 118 of air metering means 112, through which so-called secondary air is admitted into fire chamber 88, has a length of about 22". The tests of this Example are carried out with aperture 118 having a width first of about 1/4", then successively about 7/32", 3/16", 1/32", ⅛" and 1/16", making a set of six tests in all for each successive value of $h_b$, the height of the bottom edge 47*a* of the middle level air inlet opening 47. A set of six test is performed for each level of bottom edge 47*a* of middle level air inlet opening 47 at which $h_b$ equals 0", 1.37", 3.75", 4.75", and so on by additional 1" increments up to 10.75", making 60 tests in all.

All the tests are carried out with top edge 47*b* of middle level air inlet opening located at a level above fire grate 90 about ⅔ the average height of the fire chamber above the grate.

At the beginning of each set of six tests for a given level of bottom edge 47*a* of middle level air inlet opening 47, a standard charge of firewood is deposited on fire grate 90, and the fire is permitted to burn long enough to establish a freely burning fire, when lower level air inlet opening 84 is closed. No additional fuel is added to the fire until all six tests for that given level of bottom edge 47*a* have been completed. The wood fire in the stove is permitted to burn for 15 minutes to reach a state of equilibrium after each modification of the cross sectional area of terminal aperture 118 is effected, and then the test observations are made. Because lower level air inlet opening is closed, the mode of operation of the stove is the normal mode of operation.

The results of the set of six tests are evaluated—for adequacy of heating, uniformity of heating, and observable type of combustion—for each level of bottom edge 47*b*. These tests show that satisfactory results are obtained when the bottom edge 47*a* of the middle level air inlet opening 47 is at a level of about 1/10 to about ⅓ of the average height of the fire chamber, improved results are obtained if that edge is at a level between about ⅛ and about ¼ of the fire chamber average height, and best results are obtained when that edge is at about 1/6 of the fire chamber average height above the fire grate.

With respect to the volume of air admitted to fire chamber 88 through air metering means 112, satisfactory results are obtained when air metering means 112 provides a passage for air flow having cross sectional area between about 0.6 sq. in. and about 1.2 sq. in. for every cubic foot of volume of fire chamber 88. Improved results are obtained when these figures are between about 0.7 sq. in. and about 1.1 sq. in., and still further improved if they are between about 0.8 sq. in. and about 1 sq. in. A value of about 0.9 sq. in. for every cubic foot of volume of fire chamber 88 is preferred.

The optimum type of combustion that is looked for in all these tests is that which produces a bed of hot coals with low, flickering, blue and yellowish-blue flames visible above the bed of glowing hot coals, which is characteristic of the normal mode of operation of the stove.

Example 11

In this Example, the stove of Example 4 is operated in the banked mode, with damper blade 120 variously in a position to provide gap 123 about 22" long and having a width of 5/32", ⅛", 3/32", 1/16", and 1/32". Ten pieces of standard test wood, having a total weight of about 60 lbs, are employed for each test.

A separate test is carried out for each value of the width of gap 123. In each such test, combustion is permitted to proceed until there is a freely burning fire in the stove, with the high, yellowish-orange flames that are characteristic of such a fire. Damper 86 is then closed to cut off lower level air inlet opening 84, thereby putting the stove in its banked mode.

The banked mode of operation is then continued to determine how long the temperature of the exterior of the chimney just above the stove can be maintained at or above 155° F. At this temperature, it is believed that the temperature of the flue gas is about 200° F. at exhaust opening 180, or in other words at about the temperature at which creosote begins to deposit within the stove. So long as the stove maintains at least this temperature, it is considered to be performing adequately in its blanked mode.

Satisfactory results are obtained when a passage for air flow is provided by gap 123 having a cross sectional area between about 0.09 sp. in. and about 0.55 sq. in. for every cubic foot of volume of fire chamber 88. Improved results are obtained when these figures are between about 0.13 sq. in. and about 0.45 sq. in. for every cubic foot of volume of the fire chamber, and further improvement is obtained when the value of these figures is between about 0.17 and about 0.3. Best results—i.e., a burn with the temperature of the exterior of the chimney at 145° F. or higher for over twelve hours—are obtained when gap 123 has an effective cross sectional area of about 0.2 sq. in. per cubic foot of volume of fire chamber 88.

The above detailed description has been given for ease of understanding only. No unnecessary limitations should be understood therefrom, since modifications will be obvious to those skilled in the art.

We claim:

1. A stove for burning solid fuel comprised of flammable solids that among other things produce one or more flammable gases when heated and burned, said stove having at least two modes of operation, the second mode of operation providing a lower level of combustion than the first, which comprises:

(a) a fire grate for receiving pieces of said solid fuel;

(b) a stove cabinet surrounding said grate and providing (i) a fire chamber above said grate, said fire chamber being defined by said fire grate, generally vertical side walls, and an upper wall, and (ii) an ash collecting space directly beneath said fire grate, the walls of said stove cabinet defining:

(i) a fuel access opening for depositing said pieces of solid fuel upon said grate, (ii) first, lower level air inlet means adjacent said fire grate, said first air inlet means having a finite plurality of predetermined, fixed air transmitting conditions and no other air transmitting conditions, one of said predetermined, fixed air transmitting conditions being a maximum air transmitting condition and one a minimum, said air inlet means providing communication between the air surrounding said stove and said fire chamber adjacent the bottom of said chamber, (iii) second air inlet means located above said first, lower level air inlet means in a wall of the cabinet that defines said fire chamber, the path by which air flows from outside the stove through said second air inlet means into said fire chamber being entirely separate from the path by which air flows from outside said stove through said first air inlet means into said fire chamber, (iv) an exhaust outlet opening communicating with the top portion of said fire chamber, and (v) an ash removal opening communicating with said ash collecting space below the fire grate;

(c) air metering means providing communication at all times between the air surrounding said stove and said second air inlet means, said air metering means having a finite number of predetermined, fixed air transmitting conditions, the first of said predetermined, fixed air transmitting conditions being a maximum air transmitting condition and any predetermined, fixed air transmitting conditions present in said air metering means in addition to said first one allowing the passage of successively smaller amounts of air, said air metering means including, when at least one of said additional air transmitting conditions is present, preselector means having a finite plurality of predetermined positions available for selection by the user of the stove, movement of said preselector means into one of its said predetermined positions selecting a corresponding one of said finite number of predetermined, fixed air transmitting conditions, said air metering means having no other air transmitting conditions besides said finite number of predetermined, fixed air transmitting conditions so long as said preselector means is placed in no other position than one of its said finite number of predetermined positions, said stove cabinet and any adjoining fire viewing chamber being substantially airtight except for all the aforesaid openings and air inlet means in said cabinet walls and said air metering means, said fuel access opening, said first, lower level air inlet means, and said ash removal opening being selectively opened or closed, or placed in their respective predetermined, fixed air transmitting conditions, independently of each other, said first, lower level air inlet means in its said predetermined, fixed maximum air transmitting condition, said second air inlet means, and said air metering means in its said predetermined, fixed maximum air transmitting condition being of a size to introduce air into said fire chamber for said first mode of operation, said first, lower level air inlet means in its said predetermined, fixed minimum air transmitting condition, said second air inlet means, and said air metering means in one of its said predetermined, fixed air transmitting conditions being of a size to introduce air into said fire chamber for said second mode of operation; and (d) covers for (i) said fuel access opening, (ii) said first, lower level air inlet means, and (iii) said ash removal opening, respectively, to produce, except for any opening present when said first, lower level air inlet means is in its said predetermined, fixed minimum air transmitting condition, substantially airtight closures of said two openings and said lower level air inlet means.

2. The stove of claim 1 in which said first, lower level air inlet means includes at least one air inlet opening.

3. The stove of claim 1 in which said second air inlet means includes at least one air inlet opening.

4. The stove of claim 3 in which said second air inlet means includes a plurality of air inlet openings.

5. The stove of claim 1 in which said first, lower level air inlet means is located at a level entirely below said fire grate.

6. The stove of claim 1 in which said first, lower level air inlet means in its minimum air transmitting condition is entirely closed.

7. The stove of claim 1 in which said first, lower level air inlet means (a) has two predetermined, fixed air transmitting conditions, one of which is a maximum and one a minimum air transmitting condition, and (b) has no other air transmitting conditions.

8. The stove of claim 7 in which said air metering means (a) has one predetermined, fixed air transmitting condition, and (b) has no other air transmitting conditions.

9. The stove of claim 8 which includes means for sensing the temperature of the space being heated by said stove and automatically placing said first, lower level air transmitting means in its said predetermined, fixed minimum air transmitting condition when the temperature of the space being heated by said stove as thus sensed rises above a predetermined figure, said first, lower level air inlet means in its said predetermined, fixed minimum air transmitting condition, said second air inlet means, and said air metering means in its said predetermined, fixed air transmitting condition being of a size to introduce air into said fire chamber or said second mode of operation.

10. The stove of claim 8 which includes means for sensing the temperature of the space being heated by said stove and automatically placing said first, lower level air transmitting means in its said predetermined, fixed maximum air transmitting condition when the temperature of the space being heated by said stove as thus sensed falls below a predetermined figure, said first, lower level air inlet means in its said predetermined, fixed maximum air transmitting condition, said second air inlet means, and said air metering means in its said predetermined, fixed air transmitting condition being of a size to introduce air into said fire chamber for said first mode of operation.

11. The stove of claim 7 which has a third mode of operation in which the level of combustion is lower than in said second mode of operation, in which stove said air metering means has two predetermined, fixed air transmitting conditions, one of which is a maximum and one a minimum air transmitting condition, said stove including preselector means for selectively placing said air metering means in one of its said predetermined, fixed air transmitting conditions by movement of said preselector means into one of two predetermined positions, said preselector means having only two such predetermined positions, said air metering means having no other air transmitting conditions besides said maximum and minimum air transmitting conditions so long as said preselector means is placed in either of its said two predetermined positions, said first, lower level air inlet means in its said predetermined, fixed minimum air transmitting condition, said second air inlet means, and said air metering means in its said predetermined, fixed minimum air transmitting condition being of a size to introduce air into said fire chamber for said third mode of operation.

12. The stove of claim 11 which includes means for sensing the temperature of the space being heated by said stove and automatically placing said first, lower level air transmitting means in its said predetermined, fixed minimum air transmitting condition when the temperature of the space being heated by said stove as sensed by said sensing means rises above a predetermined figure, said first, lower level air inlet means in its said predetermined, fixed minimum air transmitting condition, said second air inlet means, and said air metering means in its said predetermined, fixed minimum air transmitting condition being of a size to introduce air into said fire chamber for said third mode of operation.

13. The stove of claim 11 which includes means for sensing the temperature of the space being heated by said stove and automatically placing said first, lower level air inlet means in its said predetermined, fixed maximum air transmitting condition when the temperature of the space being heated by said stove as sensed by said sensing means falls below a predetermined figure, said first, lower level air inlet means in its said predetermined, fixed maximum air transmitting conditions, said second air inlet means, and said air metering means in its said predetermined, fixed maximum air transmitting condition being of a size to introduce air into said fire chamber for said first mode of operation.

14. The stove of claim 7 which includes means for sensing the temperature of the space being heated by said stove and automatically placing said first, lower level air inlet means in its said predetermined, fixed minimum air transmitting condition when the temperature of the space being heated by said stove as thus sensed rises above a predetermined figure, said first, lower level air inlet means in its said predetermined, fixed minimum air transmitting condition, said second air inlet means, and said air metering means in one of its said predetermined, fixed air transmitting conditions being of a size to introduce air into said fire chamber for said second mode of operation.

15. The stove of claim 7 which includes means for sensing the temperature of the space being heated by said stove and automatically placing said first, lower level air transmitting means in its said predetermined, fixed maximum air transmitting condition when the temperature of the space being heated by said stove as sensed by said sensing means falls below a predetermined figure, said first, lower level air inlet means in its said predetermined, fixed maximum air transmitting condition, said second air inlet means, and said air metering means in one of its said predetermined, fixed air transmitting conditions being of a size to introduce air into said fire chamber for said first mode of operation.

16. The stove of claim 1 in which said upper wall of the fire chamber includes at least one sloping portion 17. The stove of claim 1 in which said fire chamber has a predetermined average height measured from the fire grate at the bottom of said chamber to said upper wall at the top of said chamber, and said second air inlet means includes a middle level air inlet opening located in a wall of the cabinet that defines said fire chamber, the bottom edge of said middle level air inlet opening being at a level between about 1/10 and about $\frac{1}{3}$ of said predetermined fire chamber average height above said fire grate, and the top edge thereof being at a level between about ½ and about 4/5 of said predetermined height above said fire grate.

18. The stove of claim 17 in which the bottom edge of said middle level air inlet opening is located at a level between about ⅛ and about ¼ of said predetermined fire chamber average height above said fire grate, and the top edge thereof is at a level between about 3/5 and about ¾ of said predetermined height above said fire grate.

19. The stove of claim 17 in which the bottom edge of said middle level air inlet opening is at a level approximately 1/6 of said predetermined fire chamber average height above said fire grate, and the top edge thereof is at a level about ⅔ of said predetermined height above said fire grate.

20. A stove for burning solid fuel comprised of flammable solids that among other things produce one or more flammable gases when heated and burned, said stove having a rapid burning mode of operation and a normal burning mode of operation, which comprises:

(a) a fire grate for receiving a predetermined maximum weight of pieces of standard test wood piled to a predetermined maximum height;

(b) a stove cabinet surrounding said grate and providing (i) a fire chamber above said grate, said fire chamber being defined by said fire grate, generally vertical side walls, and an upper wall, and having a predetermined average height measured from the fire grate at the bottom of said chamber to said upper wall at the top of said chamber, an (ii) an ash collecting space directly beneath said fire grate, the walls of said stove cabinet defining:

(i) a fuel access opening for depositing said pieces of solid fuel upon said grate, (ii) first, lower level air inlet means, said lower level air inlet means having two predetermined, fixed air transmitting conditions one of which is a maximum and one a minimum air transmitting condition, said air inlet means having no other air transmitting conditions, said air inlet means providing communication between the air surrounding said stove and said fire chamber adjacent the bottom of said chamber, (iii) second air inlet means located above said frist, lower level air inlet means in a wall of the cabinet that defines said fire chamber, the path by which air flows from outside the stove through said second air inlet means into said fire chamber being entirely separate from the path by which air flows from outside said stove through said first, lower level air inlet means into said fire chamber, (iv) an exhaust outlet opening communicating with the top portion of said fire chamber, and (v) an ash removal opening communicating with said ash collecting space below the fire grate, said predetermined average fire chamber height being at least about one-and-a-half times said predetermined maximum height for the fuel to be piled on said grate;

(c) air metering means providing communication at all times between the air surrounding said stove and said second air inlet means, said air metering means having a finite number of predetermined, fixed air transmitting conditions, the first of said predetermined, fixed air transmitting conditions being a maximum air transmitting condition and any predetermined, fixed air transmitting conditions present in said air metering means in addition to said first one allowing the passage of successively smaller amounts of air, said air metering means including, when at least one of said additional air transmitting conditions is present, preselector means having a finite plurality of predetermined positions available for selection by the user of the stove, movement of said preselector means into one of its said predetermined positions selecting a corresponding one of said finite number of predetermined, fixed air transmitting conditions, said air metering means having no other air transmitting conditions besides said finite number of predetermined, fixed air tramsitting conditions so long as said preselector means is placed in no other position than one of its said finite plurality of predetermined positions, said stove cabinet and any adjoining fire viewing chamber being substantially airtight except for all the aforesaid openings and air inlet means in said cabinet walls and said air metering means, said fuel access opening, said first, lower level air inlet means, said air metering means, and said ash removal opening being selectively opened or closed, or placed in their respective predetermined, fixed maximum or minimum air transmitting conditions, independently of each other, said first, lower level air inlet means in its said predetermined, fixed maximum air transmitting condition, said second air inlet means, and said air metering means in its said predetermined, fixed maximum air transmitting condition being of a size to introduce air into said fire chamber for said rapid burning mode of operation in an amount, when a barometric damper is employed providing a controlled draft of about 0.05 inch of water column and no more than said predetermined maximum weight of solid fuel in the form of standard test wood is present on said fire grate in a pile no higher than said predetermined maximum height, which pile has been burning for at least about +minutes after ignition but has not yet been substantially transformed into charcoal, that is (i) sufficient to sustain a freely burning fire with yellowish-orange flames present above at least a portion of said solid fuel on said grate, but (ii) not sufficient to heat the exposed top or front of said stove above an acceptable temperature, said first, lower level air inlet means in its said predetermined, fixed minimum air transmitting condition, said second air inlet means, and said air metering means in its said predetermined, fixed maximum air transmitting condition being of a size to introduce air into said fire chamber for said normal burning mode of operation in an amount, when a barometric damper is employed providing a controlled draft of about 0.05 inch of water column and no more than said predetermined maximum weight of solid fuel in the form of standard test wood is present on said fire grate in a pile no higher than said predetermined maximum height, which pile has been burning for at least about 30 minutes after ignition but has not yet been substantially transformed into charcoal, that is (i) sufficient to sustain the combustion of a bed of glowing hot coals on said grate and after approximately 15 minutes of such combustion to maintain combustion of flammable gases driven off said bed of hot coals, with flickering blue and yellowish-blue flames visible above at least a portion of said bed of glowing hot coals, but (ii) after the passage of said approximately 15 minutes of combustion, not sufficient to sustain a freely burning fire with yellowish-orange flames present above any substantial portion of said solid fuel on said grate; and (d) covers for (i) said fuel access opening, (ii) said first, lower level air inlet means, and (iii) said ash removal opening, respectively, to produce, except for any opening present when said first, lower level air inlet means is in its said predetermined, fixed minimum air transmitting condition, substantially airtight closures of said two openings and said lower level air inlet means.

21. The stove of claim 20 which in addition to said rapid burning and normal burning modes of operation has a banked mode of operation, and in which:

said air metering means has a predetermined, fixed, maximum air transmitting condition and a predetermined, fixed minimum air transmitting condition, said air metering means includes preselector means having two, and only two, predetermined positions available for selection by the user of the stove, movement of said preselector means into one of its said two predetermined positions selecting said predetermined, fixed maximum air transmitting condition, and movement of said selector means into the other of its said predetermined positions selecting said predetermined, fixed minimum air transmitting condition, said air metering means having no other air transmitting conditions besides said two predetermined, fixed air transmitting conditions so long as said preselector means is placed in no other position than one of its said two predetermined positions, and said first, lower level air inlet means in its said predetermined, fixed minimum air transmitting condition, said second air inlet means, and said air metering means in its said predetermined, fixed minimum air transmitting condition are of a size to introduce air into said fire chamber for said banked mode of operation in an amount, when a barometric damper is employed providing a controlled draft of about 0.05 inch of water column and no more than said predetermined maximum weight of solid fuel in the form of standard test wood is present on said fire grate in a pile no higher than said predetermined maximum height, which pile has been burning for at least about 30 minutes after ignition but has not yet been substantially transformed into charcoal, that is:

(i) sufficient to sustain the combustion of a bed of glowing hot coals and grayish red coals on said grate, but (ii) after approximately 15 minutes of such combustion, not sufficient to produce any substantial quantity of visible flames above the pile of coals.

22. The stove of claim 20 in which:

the bottom edge of said second air inlet means is at a level between about 1/10 and about $\frac{1}{3}$ of said predetermined fire chamber average height above said fire grate, and the top edge thereof is at a level between about $\frac{1}{2}$ and about 4/5 of said predetermined height above said fire grate, and said air metering means has a terminal aperture and said air metering means, its terminal aperture, and the structural members of said stove cabinet and of any fire viewing box adjoining said cabinet are disposed and arranged to guide a part of the air admitted through said metering means, when the stove is in its said normal burning mode of operation, along paths that enter said fire chamber through the lower half of said second air inlet means.

23. The stove of claim 22 in which the bottom edge of said second air inlet means is at a level between about $\frac{1}{8}$ and about $\frac{1}{4}$ of said predetermined fire chamber average height above said fire grate, and the top edge thereof is at a level between about 3/5 and about $\frac{3}{4}$ of said predetermined height above said fire grate.

24. The stove of claim 22 in which the bottom edge of said second air inlet means is at a level approximately 1/6 of said predetermined fire chamber average height above said fire grate, and the top edge thereof is at a level about $\frac{2}{3}$ of said predetermined height above said fire grate.

25. A stove for burning solid fuel comprised of flammable solids that among other things produce one or more flammable gases when heated and burned, said stove having a first mode of operation and a second mode of operation in which combustion of said fuel proceeds at a slower rate than in said first mode of operation, which comprises:

(a) a fire grate for receiving pieces of said solid fuel;

(b) a stove cabinet surrounding said grate and providing (i) a fire chamber above said grate, said fire chamber being defined by said fire grate, generally vertical side walls, and an upper wall, and having a predetermined average height measured from the fire grate at the bottom of said chamber to said upper wall at the top of said chamber, and (ii) an ash collecting space directly beneath said fire grate, the walls of said stove cabinet defining:

(i) a fuel access opening for depositing said pieces of solid fuel upon said grate, (ii) first, lower level air inlet means, said lower level air inlet means having two predetermined, fixed air transmitting conditions one of which is a maximum and one a minimum air transmitting condition, said air inlet means having no other air transmitting conditions, said air inlet means providing communication between the air surrounding said stove and said fire chamber adjacent the bottom of said chamber, (iii) second air inlet means located above said first, lower level air inlet means in a wall of the cabinet that defines said fire chamber, the path by which air flows from outside the stove through said second air inlet means into said fire chamber being entirely separate from the path by which air flows from outside said stove through said first, lower level air inlet means into said fire chamber, (iv) an exhaust outlet opening communicating with the top portion of said fire chamber, and (v) an ash removal opening communicating with said ash collecting space below the fire grate;

(c) air metering means providing communication at all times between the air surrounding said stove and said second air inlet means, said air metering means having a finite number of predetermined, fixed air transmitting conditions, the first of said predetermined, fixed air transmitting conditions being a maximum air transmitting condition and any predetermined, fixed air transmitting conditions present in said air metering means in addition to said first one allowing the passage of successively smaller amounts of air, said air metering means including, when at least one of said additional air transmitting conditions is present, preselector means having a finite plurality of predetermined positions available for selection by the user of the stove, movement of said preselector means into one of its said predetermined positions selecting a corresponding one of said finite number of predetermined, fixed air transmitting conditions, said air metering means having no other air transmitting conditions besides said finite number of predetermined, fixed air transmitting conditions so long as said preselector means is placed in no other position than one of its said finite number of predetermined positions, said air metering means in its said predetermined, fixed maximum air transmitting condition providing a passage for unassisted air flow having an effective cross sectional area between about 0.6 sq. in. and about 1.55 sq. in. for every cubic foot of volume of said fire chamber, and the equivalent thereof if said air flow is assisted, said stove cabinet and any adjoining fire viewing chamber being substantially airtight except for all the aforesaid openings and air inlet means in said cabinet walls and said air metering means, said fuel access opening, said first, lower level air inlet means, said air metering means, and said ash removal opening being selectively open or closed, or placed in their respective predetermined maximum or minimum air transmitting condition, independently of each other, said first, lower level air inlet means in its said predetermined, fixed maximum air transmitting condition, said second air inlet means, and said air metering means in its said predetermined, fixed maximum air transmitting condition introducing air into said fire chamber for said first mode of operation, the amount of air introduced through said first, lower level air inlet means for said first mode being between about 0.6 and about 1.0 times the amount of air introduced through said air metering means for said mode, said first, lower level air inlet means in its said predetermined, fixed minimum air transmitting condition, said second air inlet means, and said air metering means in its said predetermined, fixed maximum air transmitting condition introducing air into said fire chamber for said second mode of operation, and (d) covers for (i) said fuel access opening, (ii) said first, lower level air inlet means, and (iii) said ash removal opening, respectively, to produce, except for any opening present when said first, lower level air inlet means is in its said predetermined, fixed minimum air transmitting condition, substantially airtight closures of said two openings and said lower level air inlet means,

26. The stove of claim 25 which includes a damper for said first, lower level air inlet means that is moved from a predetermined, fixed maximum open position to a completely closed position, and vice versa, while said air metering means is in its said predetermined, fixed minimum air transmitting condition, by actuation of a thermostat located in the space to be heated.

27. The stove of claim 25 in which:

the bottom edge of said second air inlet means is at a level between about 1/10 and about ⅓ of said predetermined fire chamber average height above said fire grate, and the top edge thereof is at a level between about ½ and about 4/5 of said predetermined height above said fire grate, and said air metering means has a terminal aperture and said air metering means, its terminal aperture, and the structural members of said stove cabinet and of any fire viewing box adjoining said cabinet are disposed and arranged to guide a part of the air admitted through said metering means, when the stove is in its said normal burning mode of operation, along paths that enter said fire chamber through the lower half of said second air inlet means.

28. The stove of claim 27 in which the bottom edge of said second air inlet means is at a level between about ⅛ and about ¼ of said predetermined fire chamber average height above said fire grate, and the top edge thereof is at a level about 3/5 to about ¾ of said predetermined height above said fire grate.

29. The stove of claim 27 in which the bottom edge of said second air inlet means is at a level approximately 1/6 of said predetermined fire chamber average height above said fire grate, and the top edge thereof is at a level about ⅔ of said predetermined height above said fire grate.

30. The stove of claim 25 in which said terminal aperture of said air metering means has the shape of an elongated slot.

31. The stove of claim 30 in which said fire chamber is longer than it is wide, and said terminal aperture extends along the long side of said chamber.

32. The stove of claim 30 in which said elongated slot is at least about 75 times as long as it is wide.

33. The stove of claim 30 in which said elongated slot is at least about 150 times as long as it is wide.

34. The stove of claim 25 which includes means defining a shallow preheating channel in which air that is admitted to said fire chamber through said second air inlet means passes through said preheating channel and absorbs heat from an external wall of said stove cabinet before being introduced into said fire chamber.

35. The stove of claim 34 in which said shallow preheating channel has a substantially uniform depth from its inlet end to its outlet end.

36. The stove of claim 25 in which the walls of said stove cabinet also define an exhaust space, said exhaust space lying between and communicating with said fire chamber and said exhaust outlet opening.

37. The stove of claim 36 in which the upper wall defining said fire chamber is a baffle plate positioned to slant upward from back to front to deflect substantial portions of rising currents of gas and air from the burning fuel on said fire grate back into said fire chamber and at the same time to permit the exhaust from the stove to pass upward out of said fire chamber and into said exhaust space.

38. The stove of claim 37 in which said baffle plate is maintained in said upwardly slanted position by spaced support means that occupy no more than a small fraction of the perimeter of said plate, to keep the flow of heat from the plate at as low a level as is consistent with the support required for the plate.

39. The stove of claim 38 in which said baffle plate lies loosely upon said support means.

40. The stove of claim 38 in which said baffle plate is attached to at least some of said support means.

41. The stove of claim 38 in which said small fraction is about 1/10.

42. The stove of claim 37 in which said baffle plate rests upon support means affixed to the vertical walls of the fire chamber, said support means being formed of a heat insulating material.

43. The stove of claim 37 in which said stove cabinet includes a front wall, a rear wall and two end walls, and said baffle plate extends substantially from one of said end walls to the other, provides clearance at its front edge for exhaust to pass from said fire chamber to said exhaust space and out said exhaust outlet, and extends to within a short distance of said stove cabinet rear wall at its rear portion to provide a narrow ash drop aperture through which solid particles falling out of said exhaust can fall downward into said fire chamber and from there into said ash collecting space.

44. The stove of claim 36 in which the upper wall defining said fire chamber includes two baffle plates one spaced beneath the other in overlapping relationship, the lower baffle plate being positioned to slant upward from said fire chamber front wall to a point in the rear half of the fire chamber, the upper baffle plate being positioned to slant upward from said fire chamber rear wall to a point in the front half of the fire chamber, so that substantial portions of rising currents of gas and air from the burning fuel on said fire grate are deflected back into said fire chamber to follow a serpentine path around and between said baffle plates, and at the same time exhaust passes upward past the front edge of said upper baffle plate out of said fire chamber and into said exhaust space.

45. The stove of claim 44 which includes support means for said baffle plates to maintain the same in their respective upwardly slanted positions, said baffle plates lying upon their respective support means.

46. The stove of claim 25 in which the ratio of (a) the amount of air admitted to said fire chamber through said air metering means, when said metering means is in its said predetermined, fixed maximum air transmitting condition, to (b) the amount of air admitted to said fire chamber through said first, lower level air inlet means, when the latter means is in its said predetermined, fixed maximum air transmitting condition, is about 6:5.

47. The stove of claim 25 in which said first lower level air inlet means is located at a level below said fire grate, and communicates with said fire chamber through said ash collecting space.

48. The stove of claim 25 in which said first lower level air inlet means when in its said predetermined, fixed minimum air transmitting condition is substantially closed.

49. The stove of claim 25 which includes a damper for said first lower level air inlet means that is moved from a predetermined, fixed maximum open condition to a predetermined, fixed minimum open condition by actuation of a thermostat located in the space to be heated.

50. The stove of claim 25 which includes a damper for said first lower level air inlet means that is moved from a predetermined, fixed maximum open position to a completely closed position, and vice versa, by actuation of a thermostat located in the space to be heated.

51. The stove of claim 25 which has a third mode of operation in which combustion of said fuel proceeds at a lower rate than in said second mode of operation and in which said air metering means has a predetermined, fixed maximum and a predetermined, fixed minimum air transmitting condition, and which includes said preselector means in the form of manually operated damper means to move said metering means from one of said conditions to the other as desired, said air metering means in its said predetermined, fixed minimum air transmitting condition, said second air inlet means, and said first, lower level air inlet opening in its said predetermined, fixed minimum air transmitting condition being of a size to introduce air into said fire chamber for said third mode of operation.

52. The stove of claim 51 in which said air metering means in its said predetermined, fixed minimum air transmitting condition, said second air inlet means, and said first lower level air inlet opening in its said predetermined, fixed minimum air transmitting condition are of a size to introduce air into said fire chamber for said third mode of operation in an amount, when a barometric damper is employed providing a controlled draft of about 0.05 inch of water column and no more than said predetermined maximum weight of solid fuel in the form of standard test wood is present on said fire grate in a pile no higher than said predetermined maximum height, which pile has been burning for at least about 30 minutes but has not yet been substantially transformed into charcoal, that is (a) sufficient to sustain the combustion of a bed of glowing hot coals and grayish red coals on said grate, but (b) after approximately 15 minutes of such combustion, not sufficient to produce any substantial quantity of visible flames above the pile of coals.

53. The stove of claim 25 which includes:

(a) means defining at least one air heating passageway adjacent said fire chamber but having no fluid communication with said chamber, said passageway admitting air to absorb heat from the walls defining the fire chamber and to be discharged in its resulting heated condition from said passageway into the space surrounding said stove; and (b) heat conductive elements mounted on exterior walls defining said fire chamber, said heat conductive elements extending into said at least one air passageway.

54. The stove of claim 53 in which air is moved into said at least one air passageway, and after being heated is moved outward from the stove, by a mechanical blower.

55. The stove of claim 54 in which said blower means is actuated by a thermostat mounted on the stove and responsive to the temperature of the air in said at least one air passageways.

56. The stove of claim 55 in which said thermostat is operative to actuate said blower means when the temperature of the air in said at least one air passageway rises to a first predetermined figure, and to turn the blower means off when said temperature falls to a second, lower predetermined figure.

57. The stove of claim 53 in which said heat conductive elements are metal fins that extend into said at least one air passageway from the general location of the inlet end of said passageway.

58. The stove of claim 53 which includes a damper for said first lower level air inlet means that is moved from a predetermined minimum to a predetermined maximum air transmitting condition, and vice versa, by actuation of a thermostat mounted on the stove and responsive to the temperature of the air in said at least one air passageway.

59. The stove of claim 58 in which said damper in its said predetermined minimum air transmitting condition is fully closed.

60. The stove of claim 58 in which said damper is electrically operated, and is actuated by two thermostats connected in series in the electrical circuit by which said damper is opened, the first thermostat being located in the space to be heated and adapted to close said circuit whenever the temperature of said space drops below a selected level, and the second thermostat being a normally conductive thermostat mounted on the stove and responsive to the temperature of the air in said at least one air passageway to open said electrical circuit when said latter temperature rises to a predetermined maximum figure.

61. The stove of claim 53 which includes an ash pan in said ash collecting space that is removable through said ash removal opening, said ash pan having one end wall, a handle mounted on said end wall, a bottom wall, and two side walls, said ash pan being free of any end wall at its opposite end.

62. The stove of claim 53 which includes a fire viewing box, said viewing box having generally horizontal walls at its bottom and top, two end walls, a front wall, and a planar, transparent viewing window as a part of said front wall through which window the fuel burning within said stove can be observed, said viewing box walls and window defining a fire viewing chamber extending forward from said fire chamber and communicating with said fire chamber through said middle level air inlet opening, said air metering means comprising means, including one wall integral with one of said generally horizontal walls and a second wall defining a shallow air transmitting channel extending along said one generally horizontal wall of the viewing box and terminating in a narrow aperture to discharge a thin, planar sheet of preheated air from said aperture, with a first part of said sheet of air moving (a) across substantially the width of the interior surface of said viewing window so as to prevent said viewing window from being obscured by deposition of solid particles thereon, (b) thereafter against the other of said generally horizontal walls of the viewing box, and (c) from there through said fire viewing chamber toward said fire chamber to mix with and move upward with the column of hotter gases rising from said burning fuel, the amount of air admitted into said fire viewing chamber by any air metering means in addition to said first mentioned air metering means being substantially less than the amount of air admitted into the chamber by said first mentioned metering means, said fire viewing box walls and window forming a substantially airtight structure except for the terminal aperture in said shallow air transmitting channel and the terminal aperture in any additional air metering means.

63. The stove of claim 62 in which said viewing box top wall defines a supplemental air inlet opening in the form of a narrow rectangular slot immediately behind said viewing window to admit a thin, planar sheet of air to move downward across substantially the width of the interior surface of said window to assist in preventing the window from being obscured by deposition of solid particles thereon, said rectangular slot being no wider than about 1/16 ".

64. The stove of claim 62 in which said shallow air transmitting channel is located at the bottom of said viewing box and which includes a wall in the upper rear portion of said viewing box that extends downward below the top wall of said box.

65. The stove of claim 64 in which said shallow air transmitting channel has substantially the same cross sectional shape and dimensions throughout its entire length as its said terminal aperture.

66. The stove of claim 64 in which at least one of the upper and lower walls defining said shallow air transmitting channel is curved in the last portion of said channel immediately adjacent the terminal aperture thereof.

67. The stove of claim 64 in which both said upper and lower walls are curved along paths parallel to each other so that said channel has a curved cross section in the last portion thereof immediately adjacent its terminal aperture.

68. The stove of claim 64 in which concavely curved means is provided at the top inside portion of said viewing box to direct said upwardly moving first part of a sheet of air back downward toward the lower portion of said fire chamber.

69. The stove of claim 64 in which said transparent viewing window is formed of a material having a coefficient of heat expansion different from the coefficient of heat expansion of the material of which the top wall of said viewing box is formed, and said window is inserted in a long narrow aperture in said top wall, the width of said aperture being slightly greater than the thickness of said window, whereby a narrow gap is formed between said window and the top wall of the viewing box when the window is inserted in said aperture, said gap being filled with a packing formed of a resilient, nonflammable material.

70. The stove of claim 64 in which said air metering means defined by the bottom wall of said viewing box and any supplemental air inlet opening in the walls of said viewing box together have a predetermined, fixed maximum and a predetermined, fixed minimum air transmitting condition, and in which said air metering means includes damper means to move the same from one of said conditions to the other as desired.

71. The stove of claim 70 in which said air metering means defined by the bottom wall of said viewing box and any supplemental air inlet opening in their said predetermined, fixed minimum air transmitting condition, said second air inlet means, and said first lower level air inlet means in its said predetermined, fixed minimum air transmitting condition are of a size to introduce air into said fire chamber for said banked mode of operation in an amount, when a barometric damper is employed providing a controlled draft of about 0.05 inch of water column and no more than said predetermined maximum weight of solid fuel in the form of standard test wood is present on said fire grate in a pile no higher than said predetermined maximum height, which pile has been burning for at least about 30 minutes but has not yet been substantially transformed into charcoal, that is (i) sufficient to sustain the combustion of a bed of glowing hot coals and grayish red coals on said grate, but (ii) after approximately 15 minutes of such combustion, not sufficient to produce any substantial quantity of visible flames above the pile of coals.

72. The stove of claim 64 in which said fire chamber and said fire viewing chamber are substantially free of any structure preventing a second part of said thin sheet of preheated air that exits from said terminal aperture of the air metering means from flowing substantially directly to said fire chamber to enter the fire chamber through the lower portion of said second air inlet means through which said fire viewing chamber communicates with said fire chamber .

73. The stove of claim 64 in which said means defining a shallow air transmitting channel extends along the entire bottom wall of said viewing box.

74. The stove of claim 73 in which said means defining a shallow air transmitting channel extends not only along the entire bottom wall of said viewing box but also along the front wall of said fire chamber.

75. The stove of claim 23 in which said air metering means in its said predetermined, fixed maximum air transmitting condition provides a passage for unassisted air flow having an effective cross sectional area between about 0.8 sq. in and about 1.35 sq. in for every cubic foot of volume of said fire chamber, and the equivalent thereof if said air flow is assisted, for said first mode of operation of said stove.

76. The stove of claim 25 in which said air metering means in its said predetermined, fixed maximum air transmitting condition provides a passage for unassisted air flow having an effective cross sectional area between about 0.9 sq. in. and about 1.25 sq. in. for every cubic foot of volume of said fire chamber, and the equivalent thereof if said air flow is assisted, for said first mode of operation of said stove.

77. The stove of claim 25 in which:

the bottom edge of said second air inlet means is at a level between about 1/10 and about ⅓ of said predetermind fire chamber average height above said fire grate, and the top edge thereof is at a level between about ½ and about 4/5 of said predetermined average height above said fire grate, said air metering means has terminal aperture means, all of said terminal aperture means being located at a level below the vicinity of the level of said top edge of said second air inlet means, and said air metering means in its said predetermined, fixed maximum air transmitting condition provides a passage for unassisted air flow that has an effective cross sectional area between about 0.6 sq. in. and about 1.2 sq. in. for every cubic foot of volume of said fire chamber, and the equivalent thereof if said air flow is assisted, for said first mode of operation of said stove.

78. The stove of claim 77 in which said air metering means in its said predetermined, fixed maximum air transmitting condition provides a passage for unassisted air flow having an effective cross sectional area between about 0.7 sq. in. and about 1.1 sq. in. for every cubic foot of volume of said fire chamber, and the equivalent thereof if said air flow is assisted, for said first mode of operation of said stove.

79. The stove of claim 77 in which said air metering means in its said predetermined, fixed maximum air transmitting condition provides a passage for unassisted air flow having an effective cross sectional area between about 0.8 sq. in. and about 1.0 sq. in. for every cubic foot of volume of said fire chamber, and the equivalent thereof if said air flow is assisted, for said first mode of operation of said stove.

80. The stove of claim 77 in which said air metering means in its said predetermined, fixed maximum air transmitting condition provides a passage for unassisted air flow having an effective cross sectional area of about 0.9 sq. in. for every cubic foot of volume of said fire chamber, and the equivalent thereof if said air flow is assisted, for said first mode of operation of said stove.

81. The stove of claim 77 in which:

said predetermined, fixed minimum air transmitting condition of said first, lower level air inlet means is a substantially closed condition, and said second air inlet means and said air metering means in its said predetermined, fixed maximum air transmitting condition, with said first, lower level air inlet means substantially closed, introduce air into said fire chamber for said second mode of operation of said stove.

82. The stove of claim 81 in which said air metering means in its said predetermined, fixed maximum air transmitting condition provides a passage for unassisted air flow that has an effective cross sectional area between about 0.8 sq. in. and about 1.0 sq. in. for every cubic foot of volume of said fire chamber, and the equivalent thereof if said air flow is assisted, for said second mode of operation of said stove.

83. The stove of claim 81 in which said air metering means in its said predetermined, fixed maximum air transmitting condition provides a passage for unassisted air flow that has an effective cross sectional area of about 0.9 sq. in. for every cubic foot of volume of said fire chamber, and the equivalent thereof if said air flow is assisted, for said second mode of operation of said stove.

84. The stove of claim 81 in which said air metering means in its said predetermined, fixed maximum air transmitting condition provides a passage for unassisted air flow that has an effective cross sectional area between about 0.7 sq. in. and about 1.1 sq. in. for every cubic foot of volume of said fire chamber, and the equivalent thereof if said air flow is assisted, for said second mode of operation of said stove.

85. The stove of claim 77 in which said predetermined, fixed minimum air transmitting condition of said first, lower level air inlet means is a substantially closed condition, said air metering means in its said predetermined, fixed minimum air transmitting condition provides a passage for unassisted air flow that has an effective cross sectional area between about 0.09 sq. in. and about 0.55 sq. in. for every cubic foot of volume of said fire chamber, and the equivalent thereof if said air flow is assisted, and said second air inlet means and said air metering means in its said predetermined, fixed minimum air transmitting condition, with said first, lower level air inlet means substantially closed, introduce air into said fire chamber for said third mode of operation of said stove.

86. The stove of claim 85 in which said air metering means in its said predetermined, fixed minimum air transmitting condition provides a passage for unassisted air flow that has an effective cross sectional area between about 0.13 sq. in. and about 0.45 sq. in. for every cubic foot of volume of said fire chamber, and the equivalent thereof if said air flow is assisted, for said third mode of operation of said stove.

87. The stove of claim 85 in which said air metering means in its said predetermined, fixed minimum air transmitting condition provides a passage for unassisted air flow that has an effective cross sectional area between about 0.17 sq. in. and about 0.3 sq. in. for every cubic foot of volume of said fire chamber, and the equivalent thereof if said air flow is assisted, for said third mode of operation of said stove.

88. The stove of claim 85 in which said air metering means in its said predetermined, fixed minimum air transmitting condition provides a passage for unassisted air flow that has an effective cross sectional area of about 0.2 sq. in. for every cubic foot of volume of said fire chamber, and the equivalent thereof if said air flow is assisted, for said third mode of operation of said stove.

89. The stove of claim 25 in which:

the bottom edge of said second air inlet means is at a level between about 1/10 and about ⅓ of said predetermined fire chamber average height above said fire grate, and the top edge thereof is at a level between about ½ and about 4/5 of said predetermined average height above said fire grate, said air metering means has terminal aperture means, a portion of said terminal aperture means being located at a level below the vicinity of said top edge of said second air inlet means and a separate, supplementary portion of said terminal aperture means being located at a level in said vicinity, and said air metering means in its said predetermined, fixed maximum air transmitting condition provides a passage for unassisted air flow that has an effective cross sectional area between about 0.95 sq. in. and about 1.55 sq. in. for every cubic foot of volume of said fire chamber, and the equivalent thereof if said flow is assisted, for said first mode of operation of said stove.

90. The stove of claim 89 in which said air metering means in its said predetermined, fixed maximum air transmitting condition provides a passage for unassisted air flow that has an effective cross sectional area between about 1.05 sq. in. and about 1.45 sq. in. for every cubic foot of volume of said fire chamber, and the equivalent thereof if said flow is assisted, for said first mode of operation of said stove.

91. The stove of claim 89 in which said air metering means in its said predetermined, fixed maximum air transmitting condition provides a passage for unassisted air flow that has an effective cross sectional area between about 1.15 sq. in. and about 1.35 sq. in. for every cubic foot of volume of said fire chamber, and the equivalent thereof if said flow is assisted, for said first mode of operation of said stove.

92. The stove of claim 89 in which said air metering means in its said predetermined, fixed maximum air transmitting condition provides a passage for unassisted air flow that has an effective cross sectional area of about 1.25 sq. in. for every cubic foot of volume of said fire chamber, and the equivalent thereof if said flow is assisted, for said first mode of operation of said stove.

93. The stove of claim 89 in which:

said predetermined, fixed minimum air transmitting condition of said first, lower level air inlet means is a substantially closed condition, and said second air inlet means and said air metering means in its said predetermined, fixed maximum air transmitting condition, with said first, lower level air inlet means substantially closed, introduce air into said fire chamber for said second mode of operation of said stove.

94. The stove of claim 93 in which said air metering means in its said predetermined, fixed maximum air transmitting condition provides a passage for unassisted air flow that has an effective cross sectional area between about 1.05 sq. in. and about 1.45 sq. in. for every cubic foot of volume of said fire chamber, and the equivalent thereof if said air flow is assisted, for said second mode of operation of said stove.

95. The stove of claim 93 in which said air metering means in its said predetermined, fixed maximum air transmitting condition provides a passage for unassisted air flow that has an effective cross sectional area between about 1.15 sq. in. and about 1.35 sq. in. for every cubic foot of volume of said fire chamber, and the equivalent thereof if said air flow is assisted, for said second mode of operation of said stove.

96. The stove of claim 93 in which said air metering means in its said predetermined, fixed maximum air transmitting condition provides a passage for unassisted air flow that has an effective cross sectional area of about 0.9 sq. in. for every cubic foot of volume of said fire chamber, and the equivalent thereof if said air flow is assisted, for said second mode of operation of the stove.

97. The stove of claim 89 in which:

said predetermined, fixed minimum air transmitting condition of said first, lower level air inlet means is a substantially closed condition, said air metering means in its said predetermined, fixed minimum air transmitting condition provides a passage for unassisted air flow that has an effective cross sectional area between about 0.45 sq. in. and about 0.9 sq. in. for every cubic foot of volume of said fire chamber, and the equivalent thereof if said air flow is assisted, and said second air inlet means and said air metering means in its said predetermined, fixed minimum air transmitting condition, with said first, lower level air inlet means substantially closed, introduce air into said fire chamber for said third mode of operation of said stove.

98. The stove of claim 97 in which said air metering means in its said predetermined, fixed minimum air transmitting condition provides a passage for unassisted air flow that has an effective cross sectional area between about 0.48 sq. in. and about 0.8 sq. in. for every cubic foot of volume of said fire chamber, and the equivalent thereof if said air flow is assisted, for said third mode of operation of said stove.

99. The stove of claim 97 in which said air metering means in its said predetermined, fixed minimum air transmitting condition provides a passage for unassisted air flow that has an effective cross sectional area between about 0.52 sq. in. and about 0.65 sq. in. for every cubic foot of volume of said fire chamber, and the equivalent thereof if said air flow is assisted, for said third mode of operation of said stove.

100. The stove of claim 97 in which said air metering means in its said predetermined, fixed minimum air transmitting condition provides a passage for unassisted air flow that has an effective cross sectional area of about 0.55 sq. in. for every cubic foot of volume of said fire chamber, and the equivalent thereof if said air flow is assisted, for said third mode of operation of said stove.

101. The stove of claim 25 in which:

said predetermined, fixed minimum air transmitting condition of said first, lower level air inlet means is a substantially closed condition, said air metering means in its said predetermined, fixed minimum air transmitting condition provides a passage for unassisted air flow that has an effective cross sectional area between about 0.09 sq. in. and about 0.9 sq. in. for every cubic foot of volume of said fire chamber, and the equivalent thereof if said air flow is assisted, and said second air inlet means and said air metering means in its said predetermined, fixed minimum air transmitting condition, with said first, lower level air inlet means substantially closed, introduce air into said fire chamber for said third mode of operation of said stove.

102. The stove of claim 101 in which said air metering means in its said predetermined, fixed minimum air transmitting condition provides a passage for unassisted air flow that has an effective cross sectional area between about 0.13 sq. in. and about 0.8 sq. in. for every cubic foot of volume of said fire chamber, and the equivalent thereof if said air flow is assisted, for said third mode of operation of said stove.

103. The stove of claim 101 in which said air metering means in its said predetermined, fixed minimum air transmitting condition provides a passage for unassisted air flow that has an effective cross sectional area between about 0.17 sq. in. and about 0.65 sq. in. for every cubic foot of volume of said fire chamber, and the equivalent thereof if said air flow is assisted, for said third mode of operation of said stove.

104. The stove of claim 101 in which said air metering means in its said predetermined, fixed minimum air transmitting condition provides a passage for unassisted air flow that has an effective cross sectional area between about 0.2 sq. in. and about 0.55 sq. in. for every cubic foot of volume of said fire chamber, and the equivalent thereof if said air flow is assisted, for said third mode of operation of said stove.

105. The stove of claim 25 in which:

said predetermined, fixed minimum air transmitting condition of said first, lower level air inlet means is a substantially closed condition, and said second air inlet means and said air metering means in its said predetermined, fixed maximum air transmitting condition, with said first, lower level air inlet means substantially closed, introduce air into said fire chamber for said second mode of operation of said stove.

106. The stove of claim 105 in which said air metering means in its said predetermined, fixed maximum air transmitting condition provides a passage for unassisted air flow that has an effective cross sectional area between about 0.7 sq. in. and about 1.45 sq. in. for every cubic foot of volume of said fire chamber, and the equivalent thereof if said air flow is assisted, for said second mode of operation of said stove.

107. The stove of claim 105 in which said air metering means in its said predetermined, fixed maximum air transmitting condition provides a passage for unassisted air flow that has an effective cross sectional area between about 0.8 sq. in. and about 1.35 sq. in. for every cubic foot of volume of said fire chamber, and the equivalent thereof if said air flow is assisted, for said second mode of operation of said stove.

108. The stove of claim 105 in which said air metering means in its said predetermined, fixed maximum air transmitting condition provides a passage for unassisted air flow that has an effective cross sectional area between about 0.9 sq. in. and about 1.25 sq. in. for every cubic foot of volume of said fire chamber, and the equivalent thereof if said air flow is assisted, for said second mode of operation of said stove.

109. The stove of claim 25 in which said air metering means in its said predetermined, fixed maximum air transmitting condition provides a passage for unassisted air flow having an effective cross sectional area between about 0.7 sq. in. and about 1.45 sq. in. for every cubic foot of volume of said fire chamber, and the equivalent thereof if said air flow is assisted, for said first mode of operation of said stove.

110. A stove for burning solid fuel comprised of flammable solids that among other things produce one or more flammable gases when heated and burned, said stove having a rapid burning mode of operation, a normal burning mode of operation, and a banked mode of operation, which comprises:

(a) a fire grate for receiving pieces of said solid fuel, said fire grate being formed of fire bricks having passageways for air therebetween;

(b) a stove cabinet including a front wall, a rear wall and two end walls, said stove cabinet surrounding said grate and providing (i) a fire chamber above said grate, said fire chamber being defined by said fire grate, generally vertical side walls, and an upper wall, and having a predetermined average height measured from the fire grate at the bottom of said chamber to said upper wall at the top of said chamber, (ii) an exhaust space above said fire chamber, and (iii) an ash collecting space directly beneath said fire grate, said upper wall defining the fire chamber being a baffle plate positioned to slant upward from back to front to deflect substantial portions of rising currents of gas and air from the burning fuel on said fire grate back into said fire chamber and at the same time to permit the exhaust from the stove to pass upward out of said fire chamber and into said exhaust space, said baffle plate extending substantially from one of said end walls of the stove cabinet to the other, providing clearance at its front edge for exhaust to pass from said fire chamber to said exhaust space and out said exhaust outlet, and at its rear portion extending to within a short distance of said fire cabinet rear wall to provide a narrow ash drop aperture through which solid particles falling out of said exhaust can fall downward into said fire chamber and from there into said ash collecting space, the walls of said stove cabinet defining:

(i) a fuel access opening for depositing said pieces of solid fuel upon said grate, (ii) first, lower level air inlet means, said lower level air inlet means having a predetermined, fixed maximum air transmitting condition in which it provides communication between the air surrounding said stove and said fire chamber adjacent the bottom of said chamber, and having a substantially closed condition and no other air transmitting conditions, (iii) second air inlet means located above said first, lower level air inlet means in a wall of the cabinet that defines said fire chamber, the bottom edge of said second air inlet means being at a level between about 1/10 and about ⅓ of said predetermined fire chamber average height above said fire grate and the top edge thereof being between about ½ and about 4/5 of said predetermined height above said fire grate, the path by which air flows from outside the stove through said second air inlet means into said fire chamber being entirely separate from the path by which air flows from outside said stove through said first, lower level air inlet means into said fire chamber, (iv) an exhaust outlet opening communicating with said exhaust space, and (v) an ash removal opening communicating with said ash collecting space below the grate;

(c) a viewing box outside said fire chamber extending forward from the front wall of said stove cabinet, said viewing box having a bottom wall, a top wall, two end walls, a front wall, a wall in its upper rear portion that extends downward below its said top wall, and a planar, transparent viewing window in said front wall through which the fuel burning within said stove can be observed, said viewing box walls defining a fire viewing chamber extending forward from said fire chamber and communicating therewith, (d) air metering means providing communication at all times between the air surrounding said stove and said second air inlet means, said air metering means having a terminal aperture and a predetermined, fixed maximum and a predetermined, fixed minimum air transmitting condition, and no other air transmitting conditions, said stove cabinet and the adjoining fire viewing chamber being substantially airtight except for all the aforesaid openings and air inlet means in said cabinet walls and said air metering means, said fuel access opening, said first, lower level air inlet means, said air metering means, and said ash removal opening being selectively opened or closed, or placed in their respective predetermined maximum or minimum air transmitting conditions, independently of each other, said air metering means in its said predetermined maximum air transmitting condition providing a passage for unassisted air flow having an effective cross sectional area between about 0.9 sq. in. and about 1.25 sq. in. for every cubic foot of volume of said fire chamber, and the equivalent thereof if said air flow is assisted, and in its said predetermined, fixed minimum air transmitting condition providing a passage for unassisted air flow having an effective cross sectional area between about 0.2 sq. in. and about 0.55 sq. in. for every cubic foot of volume of the fire chamber, and the equivalent thereof if said air flow is assisted, said first, lower level air inlet means in its said predetermined, fixed maximum air transmitting condition, said second air inlet means, and said air metering means in its said predetermined, fixed maximum air transmitting condition introducing air into said fire chamber for said rapid burning mode of operation, the amount of air introduced through said first, lower level air inlet means for said rapid mode being about 0.83 times the amount of air introduced through said air metering means, said second air inlet means and said air metering means in its said predetermined, fixed maximum air transmitting condition, with said lower level air inlet opening substantially closed, introducing air into said fire chamber for said normal burning mode of operation;

(e) covers for (i) said fuel access openings, (ii) said first, lower air inlet means, and (iii) said ash removal opening, respectively, to produce substantially airtight closures of both said two openings and said lower level air inlet means;

(f) damper means to move said air metering means from its said predetermined, fixed maximum to its said predetermined, fixed minimum air transmitting condition as desired, said second air inlet means and said air metering means in its said predetermined, fixed minimum air transmitting condition, with said lower level air inlet opening substantially closed, introducing air into said fire chamber for said banked mode of operation;

(g) means defining at least one air passageway adjacent said fire chamber but having no fluid communication with said chamber, said passageway admitting air to absorb heat from the walls defining the fire chamber and to be discharged in its resulting heated condition from said passageway into the space surrounding said stove;

(h) heat conducting elements mounted on the exterior walls defining said fire chamber and extending into said at least one air passageway;

(i) a mechanical blower for moving air into said air passageway and, after it is heated, outward from the stove, the operation of said blower being controlled by a first thermostat that measures the temperature of the air in said at least one air passageway;

(j) means for moving the cover for said lower level air inlet opening selectively from an open to a closed position by actuation of a second thermostat located in the space to be heated;

(k) means, including a bottom wall and an upper wall integral with said viewing box bottom wall, defining a shallow air transmitting channel extending along the bottom of said viewing box and terminating in a narrow aperture to discharge a thin planar sheet of preheated air from said aperture with a first part of said sheet of air moving (i) upward across substantially the width of said viewing window so as to prevent said viewing window from being obscured by deposition of solid particles thereon, (ii) thereafter against said top wall and said upper rear wall of the viewing box, and (iii) from there through said fire viewing chamber toward said fire chamber to mix with and move upward with the column of hotter gases rising from said burning fuel, said viewing box walls forming a substantially airtight structure except for the terminal aperture in said shallow air transmitting channel, said fire chamber and said fire viewing chamber being free of any structure preventing a second part of said thin sheet of preheated air from flowing substantially directly to said fire chamber at approximately the level of the bottom edge of said second air inlet means through which said fire viewing chamber communicates with said fire chamber, portions of said upper and lower walls which define said shallow air transmitting channel being curved along paths parallel to each other so that said channel has a curved cross section in the last portion thereof immediately adjacent its terminal aperture; and (l) an ash pan in said ash collecting space that is removable through said ash removal opening, said ash pan having one end wall, a handle mounted on said end wall, a bottom wall, and two side walls, each ash pan being free of any end wall at its opposite end.

* * * * *

UNITED STATES PATENT AND TRADEMARK OFFICE

CERTIFICATE OF CORRECTION

PATENT NO. : 4,469,083

DATED : September 4, 1984

INVENTOR(S) : Gordon W. Helle, Homer C. Adams and Richard A. Kleine

It is certified that error appears in the above-identified patent and that said Letters Patent are hereby corrected as shown below:

Col. 48, line 41, plus sign should be -- 30 --

Signed and Sealed this

*Fourteenth* Day of *May 1985*

[SEAL]

*Attest:*

DONALD J. QUIGG

*Attesting Officer* *Acting Commissioner of Patents and Trademarks*